US009580204B2

(12) United States Patent
Cherian

(10) Patent No.: US 9,580,204 B2
(45) Date of Patent: Feb. 28, 2017

(54) PT2 PULL TAB LIDS STACKING

(76) Inventor: Gabe Cherian, Sun Valley, ID (US)

( * ) Notice: Subject to any disclaimer, the term of this patent is extended or adjusted under 35 U.S.C. 154(b) by 374 days.

(21) Appl. No.: 12/924,816

(22) Filed: Oct. 5, 2010

(65) Prior Publication Data

US 2011/0139782 A1 Jun. 16, 2011

Related U.S. Application Data

(63) Continuation-in-part of application No. 10/941,797, filed on Sep. 14, 2004, now Pat. No. 7,617,945.

(60) Provisional application No. 61/278,279, filed on Oct. 5, 2009.

(51) Int. Cl.
*B65D 17/32* (2006.01)
*B65D 17/00* (2006.01)
*B65D 17/34* (2006.01)

(52) U.S. Cl.
CPC .... *B65D 17/165* (2013.01); *B65D 2517/0014* (2013.01); *B65D 2517/0073* (2013.01); *B65D 2517/0079* (2013.01)

(58) Field of Classification Search
CPC ..... B65D 17/165; B65D 2517/0014; B65D 2517/0073; B65D 2517/00079
USPC ..... 220/269, 380; 206/508
See application file for complete search history.

(56) References Cited

U.S. PATENT DOCUMENTS

| | | | | |
|---|---|---|---|---|
| 4,703,857 | A * | 11/1987 | Jahnen et al. | 206/503 |
| 5,456,378 | A * | 10/1995 | DeMars | 220/269 |
| 5,819,973 | A * | 10/1998 | Traub et al. | 220/271 |
| 2001/0002671 | A1* | 6/2001 | Heinicke et al. | 220/269 |
| 2005/0252917 | A1* | 11/2005 | Turner et al. | 220/269 |
| 2007/0007294 | A1* | 1/2007 | Jentzsch et al. | 220/619 |
| 2007/0029324 | A1* | 2/2007 | Watson et al. | 220/269 |
| 2007/0108208 | A1* | 5/2007 | Dickie | 220/269 |
| 2007/0131693 | A1* | 6/2007 | Matsukawa et al. | 220/269 |
| 2007/0284374 | A1* | 12/2007 | Chen | 220/269 |
| 2010/0059517 | A1* | 3/2010 | An | 220/269 |

* cited by examiner

*Primary Examiner* — J. Gregory Pickett
*Assistant Examiner* — Niki M Eloshway

(57) ABSTRACT

The invention relates to food and beverage containers and the lids that are used to close such containers. During the manufacturing process, it is desirable to stack the lids one on top of the other before presenting them to the machine that will join the lids to the bodies of the containers. Some lids according to my previous invention have ancillary components attached to their main bodies, such as pull tabs that have raised lifter tips or punch tips. Sometimes, the lids have also certain recesses and/or protrusions below or above the main body of the lids. Such ancillaries and/or recesses or protrusions could disturb the integrity of the stacks. Some experts in the industry indicated that they consider that such a stack could be unacceptably SQUISHY. This invention proposes ways and methods and construction designs, which would eliminate such stacking problems, even in the presence of such ancillaries and/or recesses or protrusions or other similar irregular shapes. The stacks will not be squishy.

22 Claims, 60 Drawing Sheets

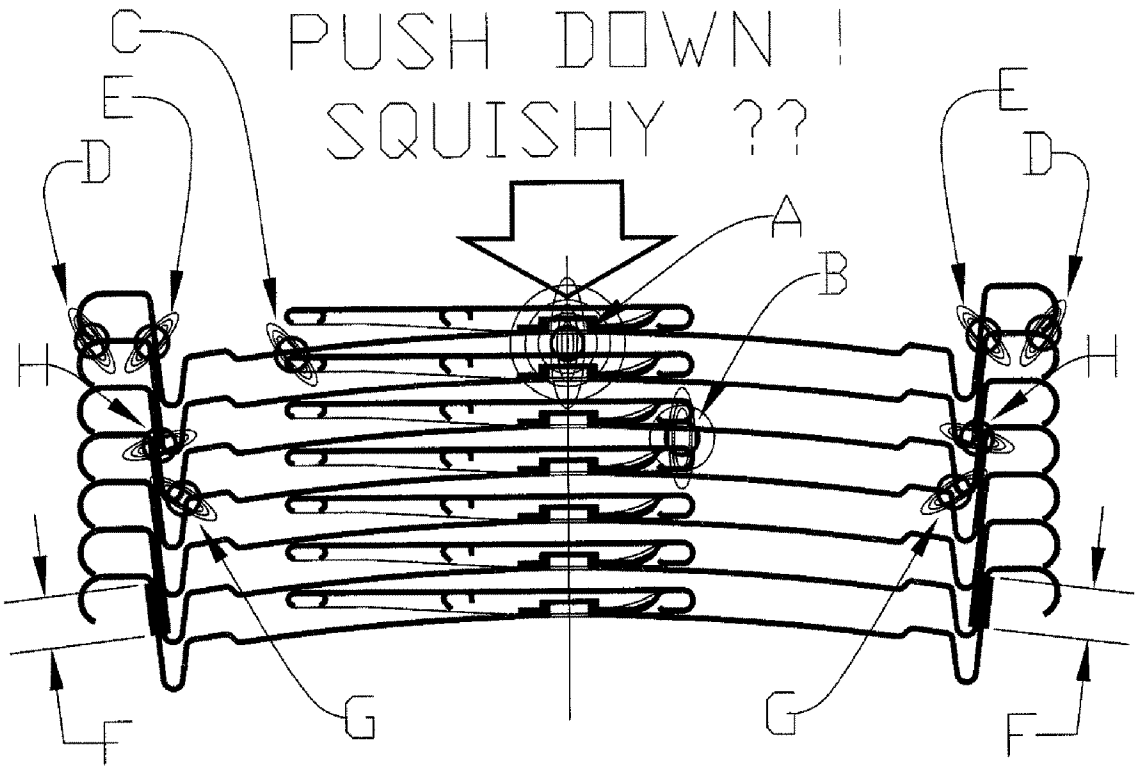
FIG. 1-A Prior Art

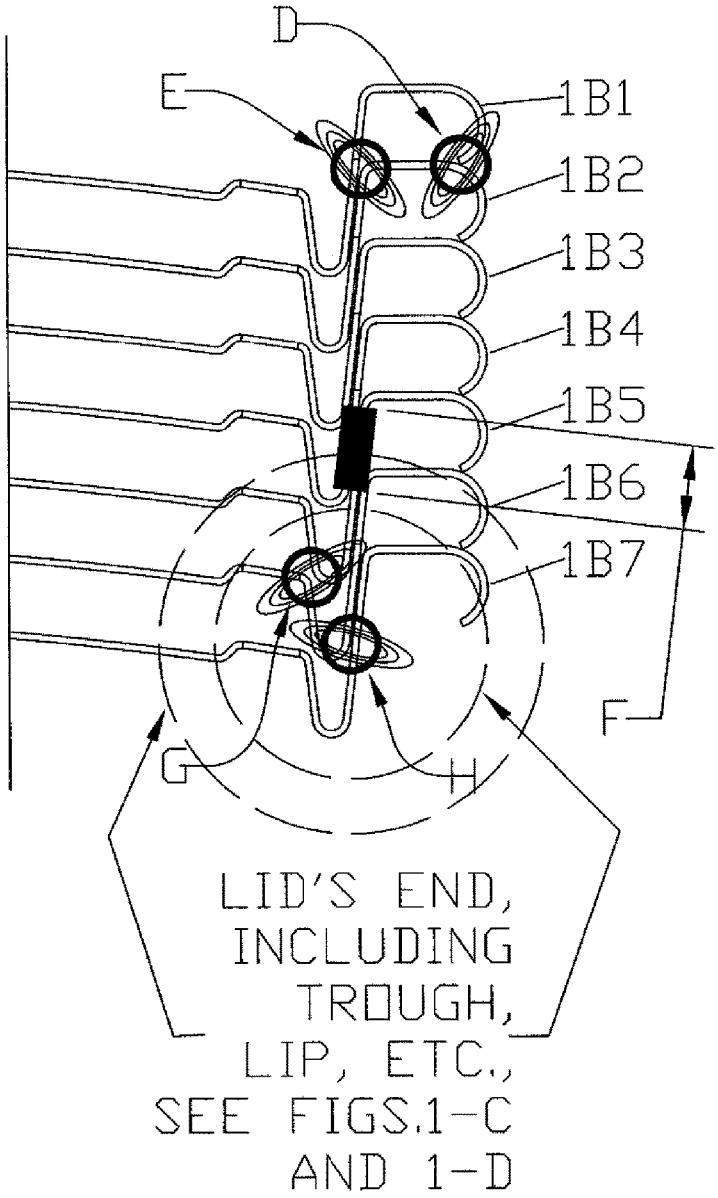
FIG. 1-B Prior Art

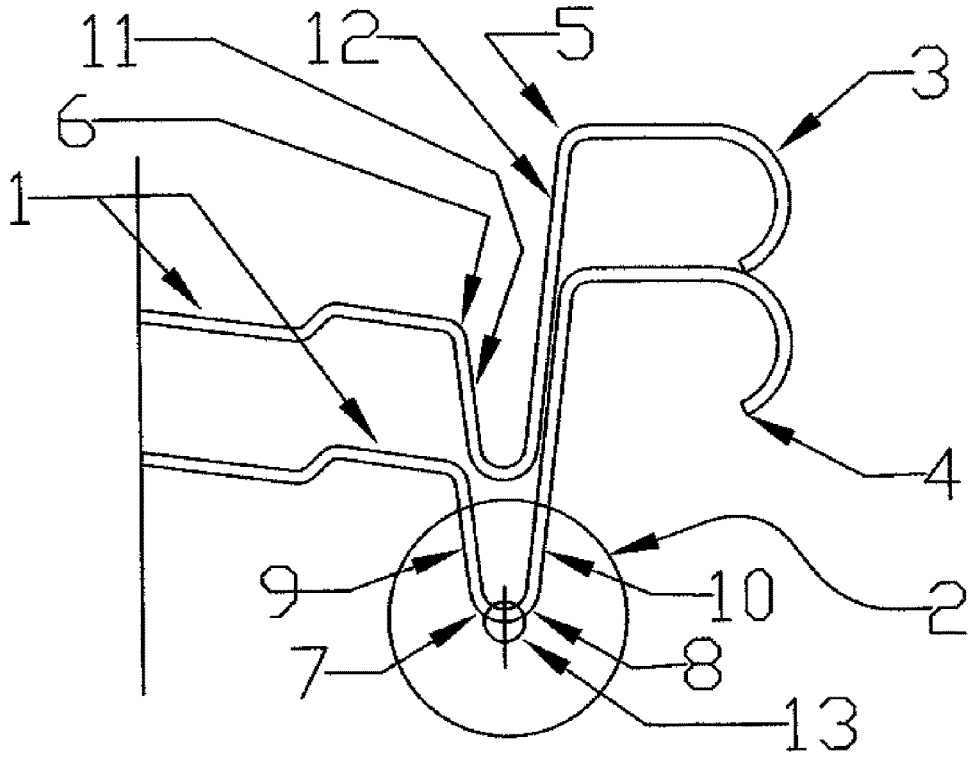
FIG. 1-C Prior Art

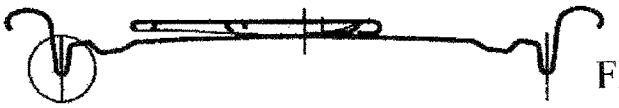
FIG. 13-A
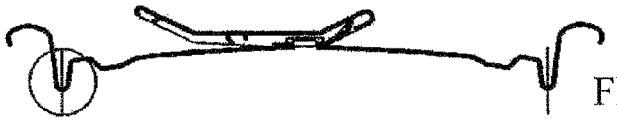
FIG. 13-B
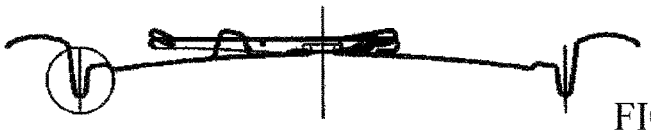
FIG. 13-C
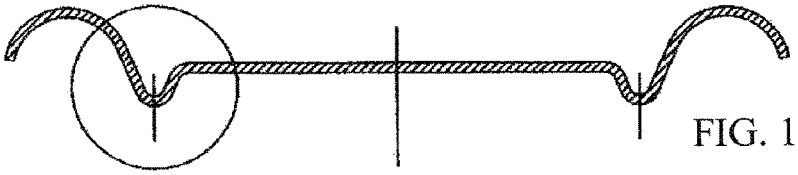
FIG. 13-D
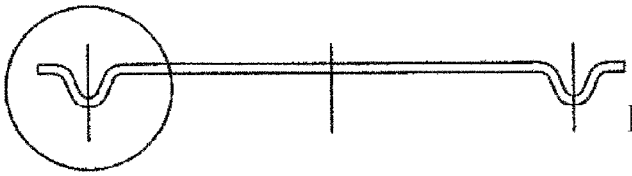
FIG. 13-E
FIG. 13 A.B.C are Prior Art

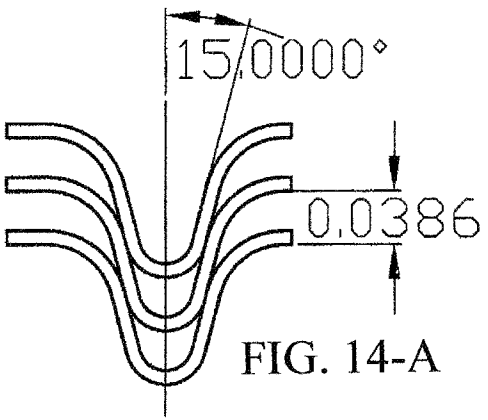
FIG. 14-A
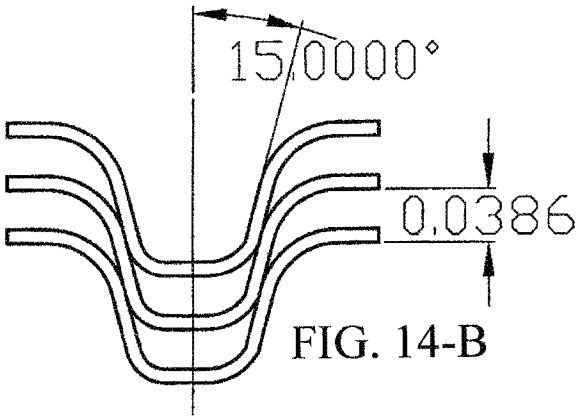
FIG. 14-B
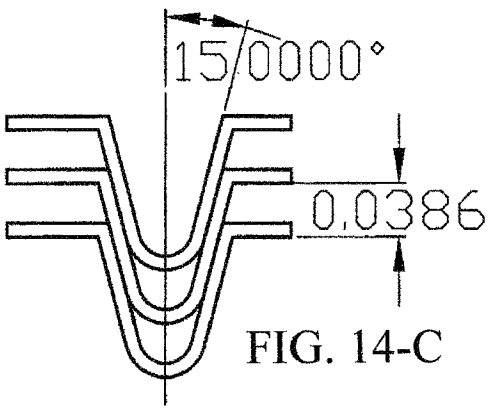
FIG. 14-C
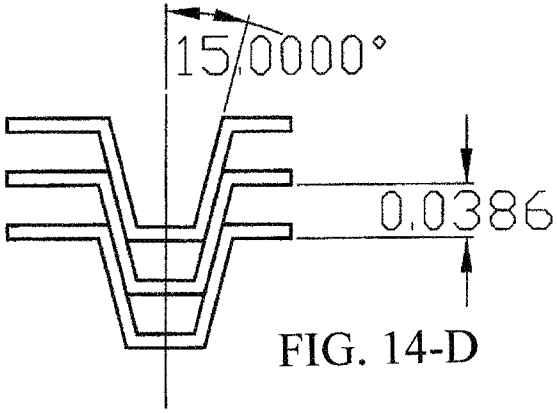
FIG. 14-D

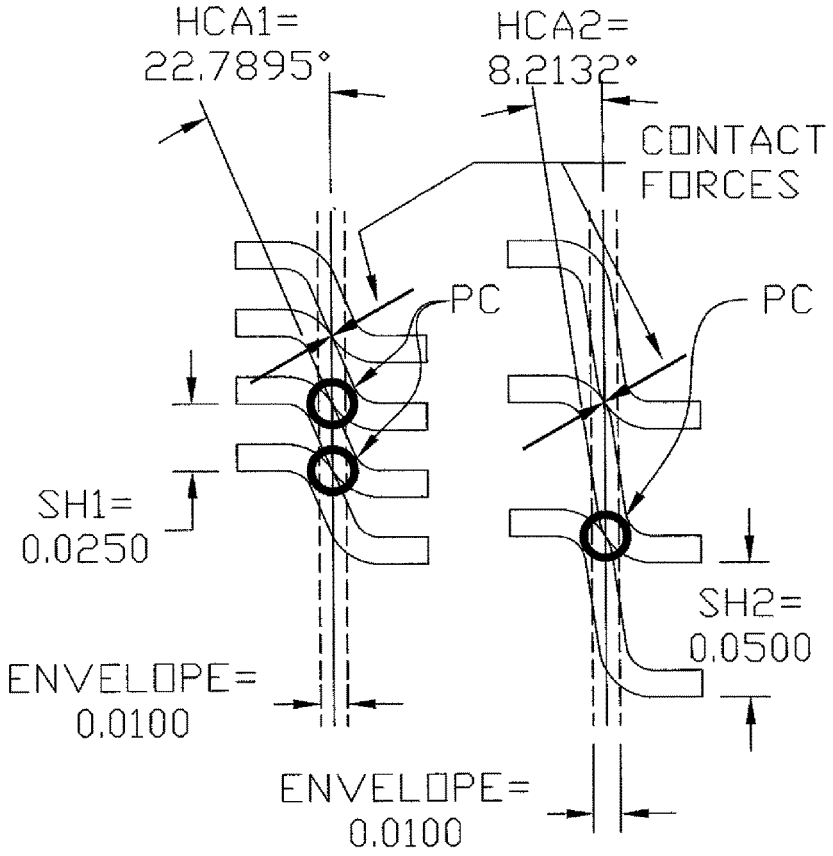
FIG. 15-A FIG. 15-B

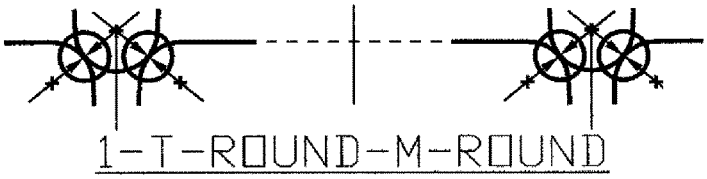
FIG. 21-A
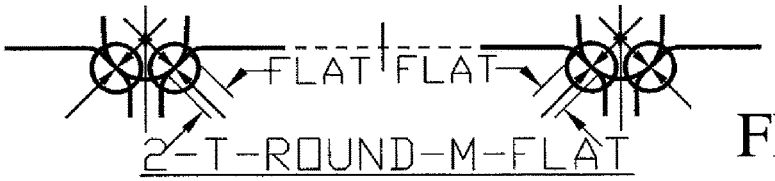
FIG. 21-B
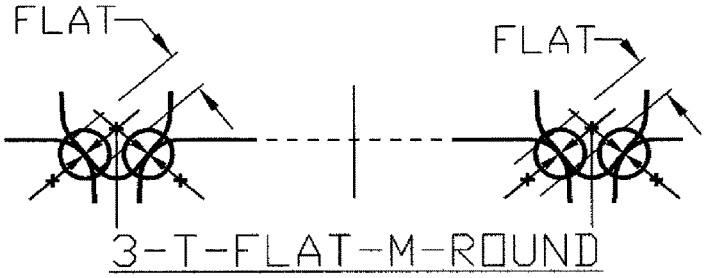
FIG. 21-C
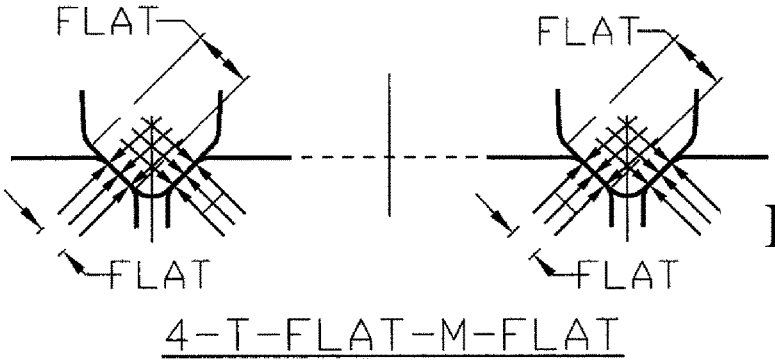
FIG. 21-D FIG. 23-A
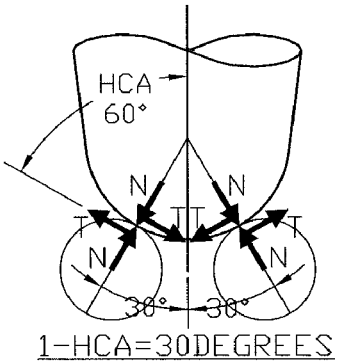
FIG. 23-B
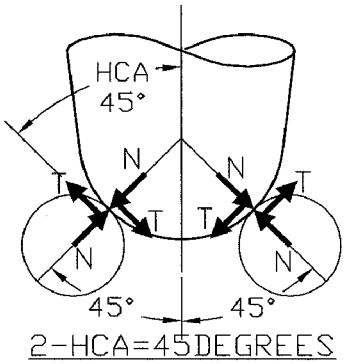
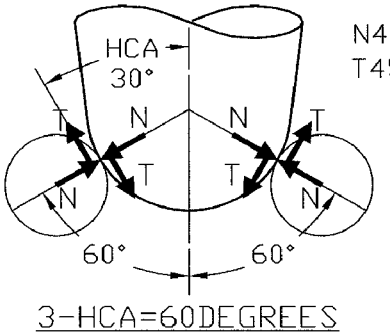
FIG. 23-C
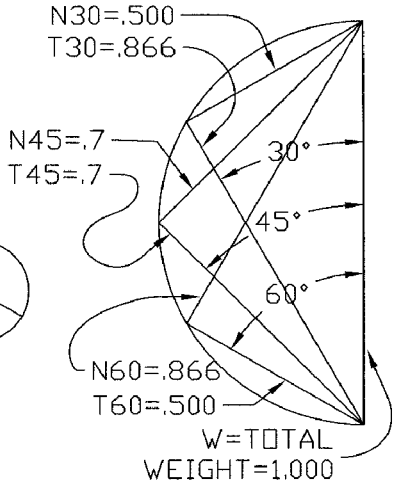
FIG. 23-D

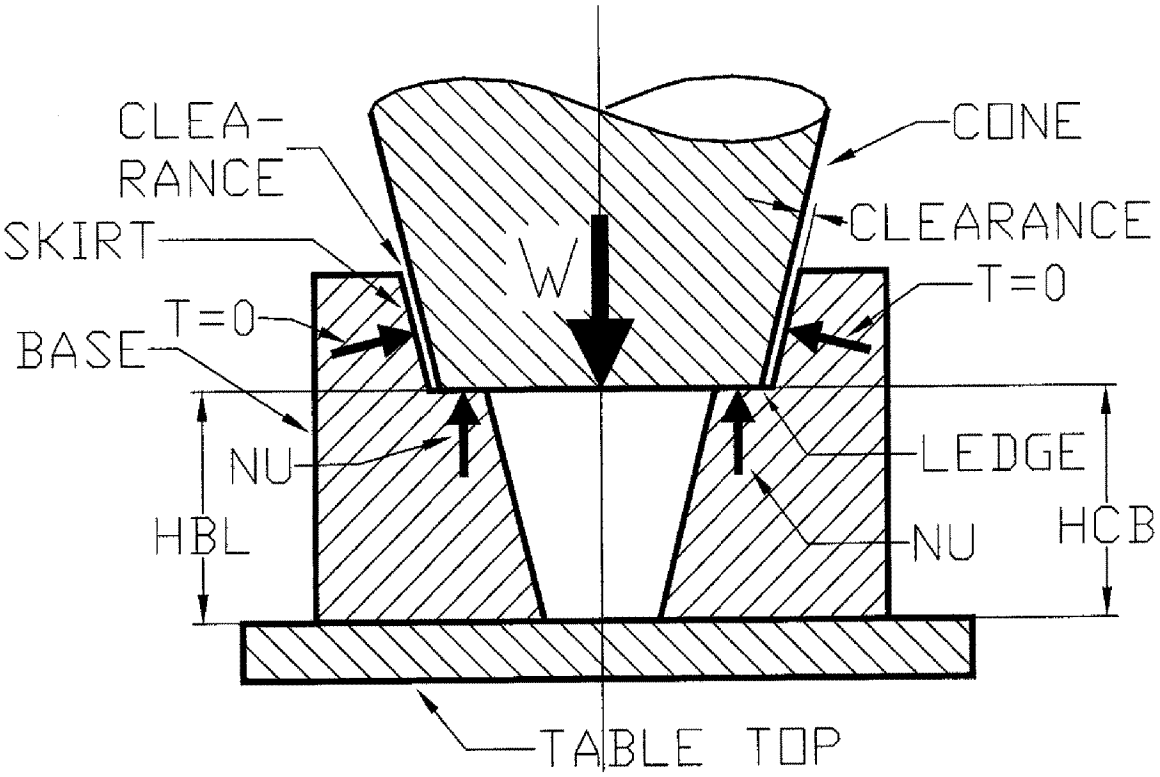
FIG. 24-A

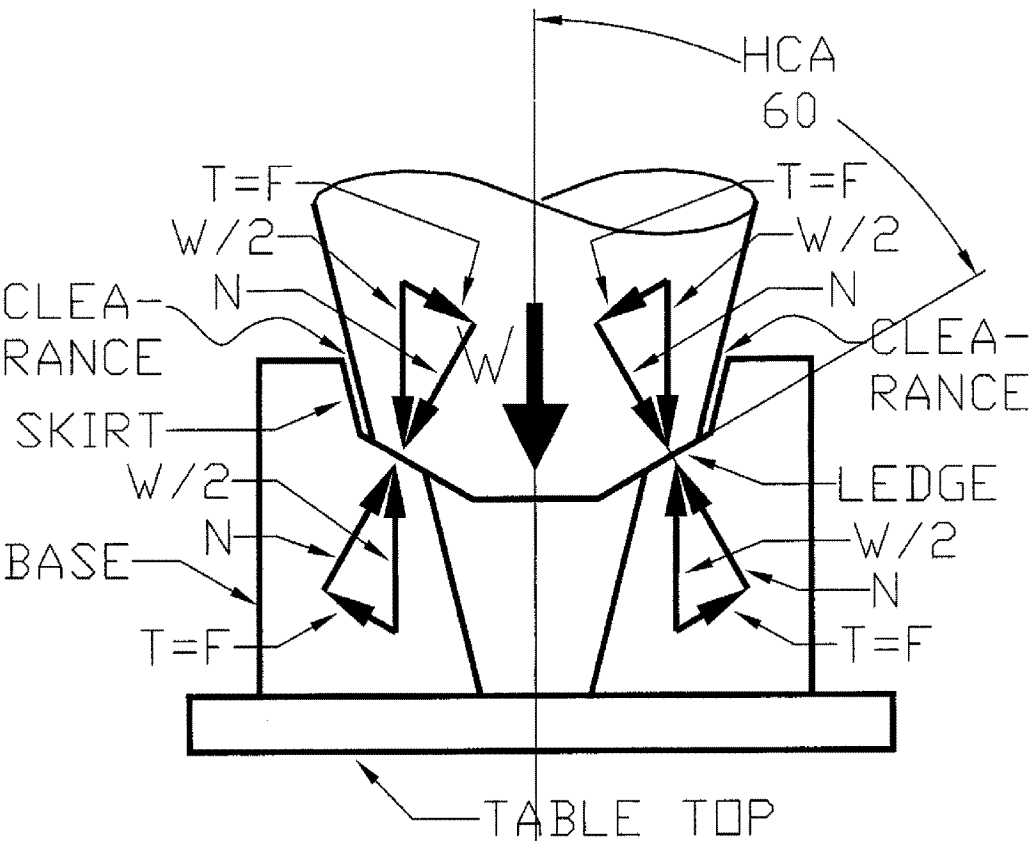
FIG. 24-B

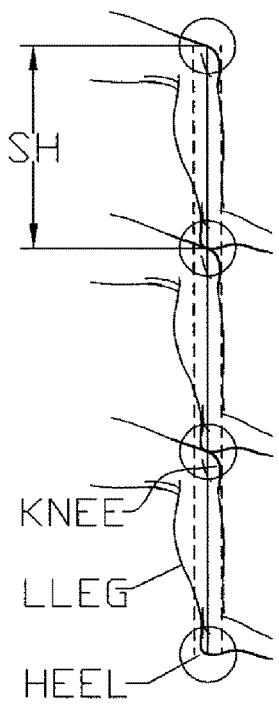
FIG 26-A
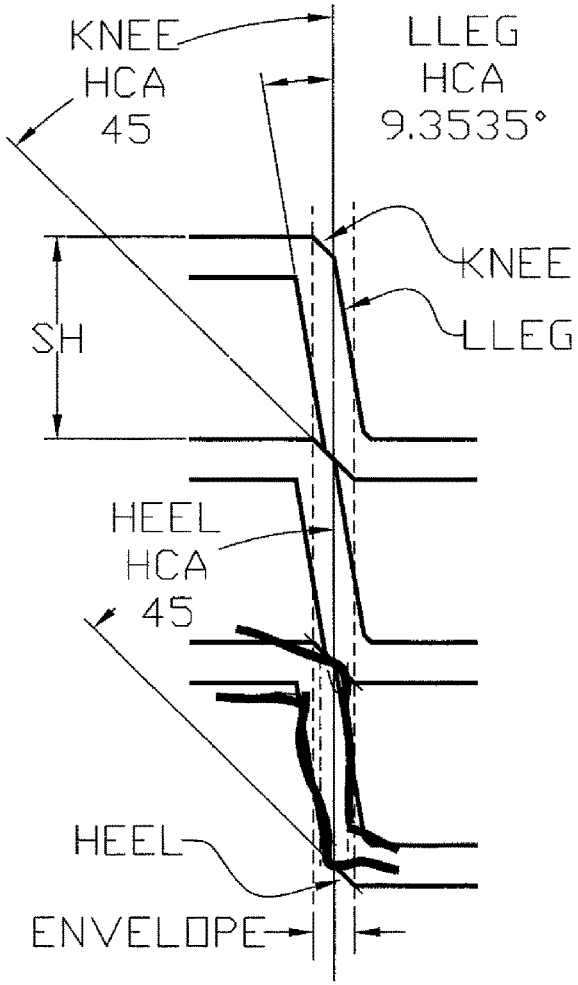
FIG 26-B

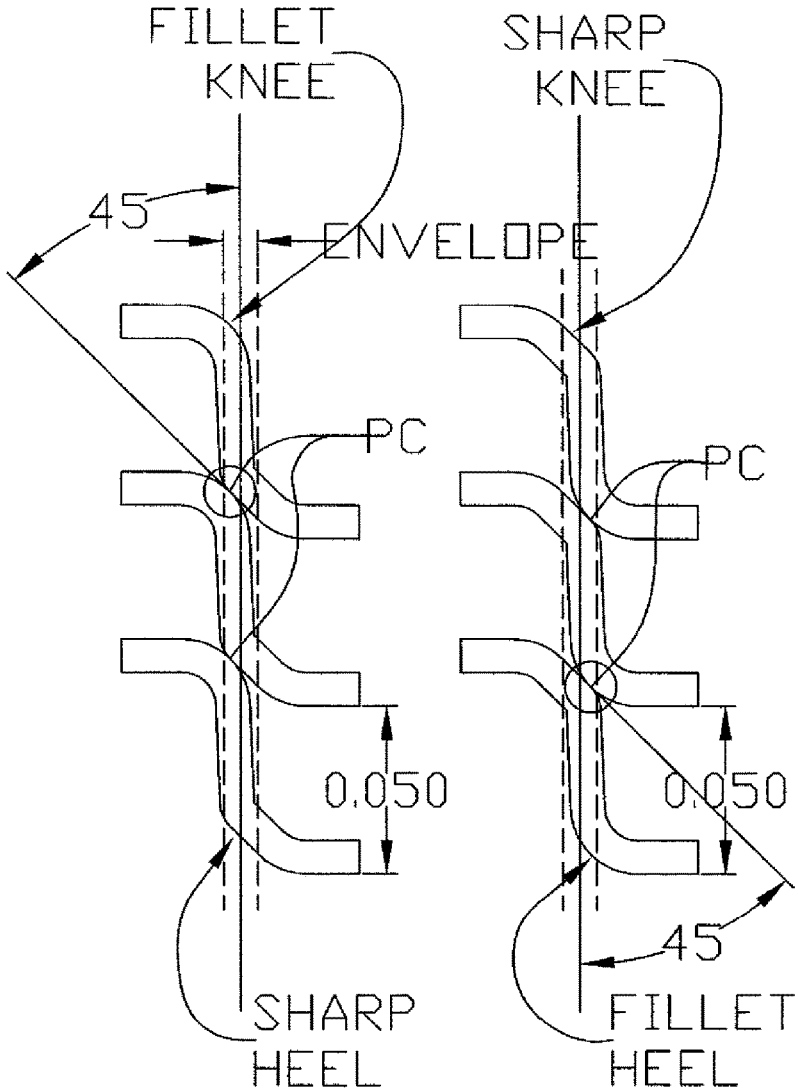
FIG. 27-A FIG. 27-B

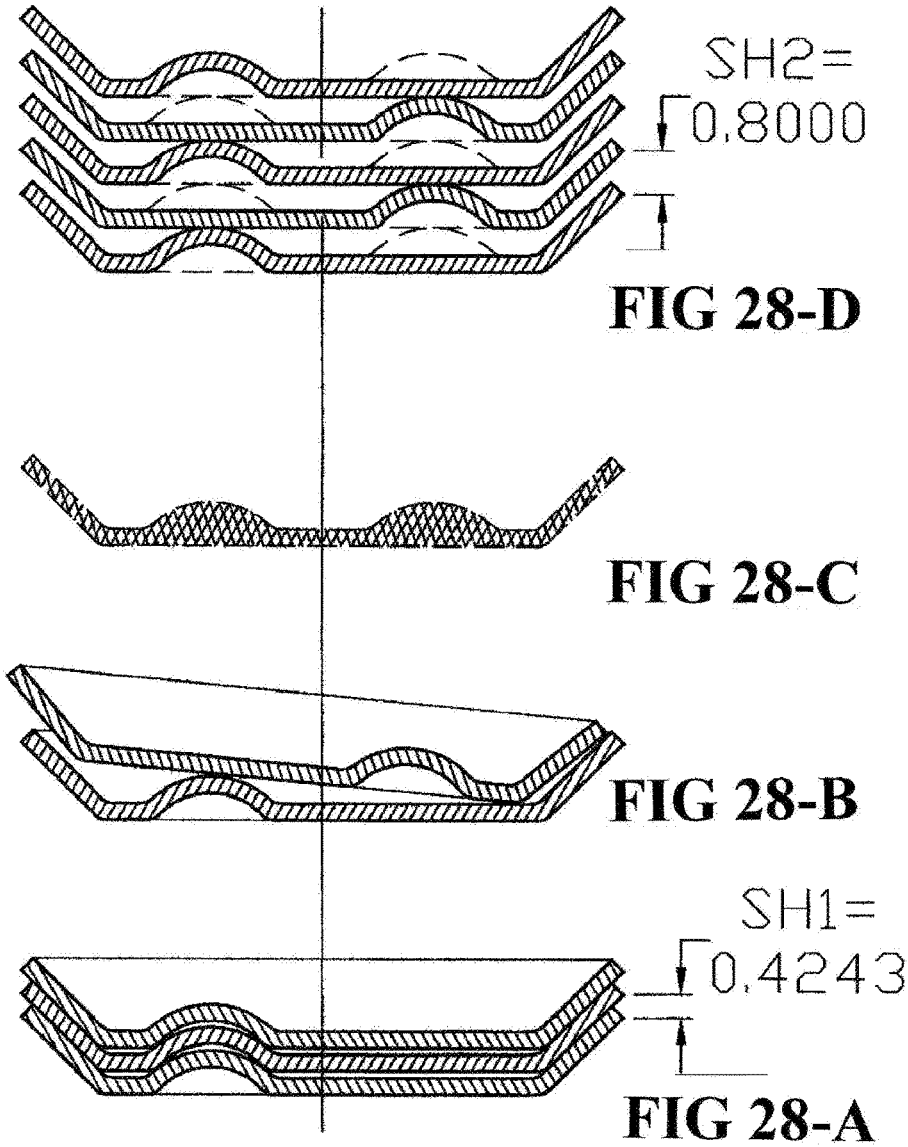
FIG 28-D
FIG 28-C
FIG 28-B
FIG 28-A

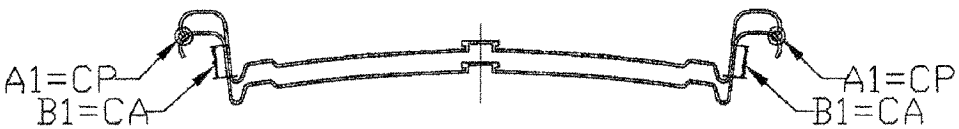
FIG 33-A OPTION #1
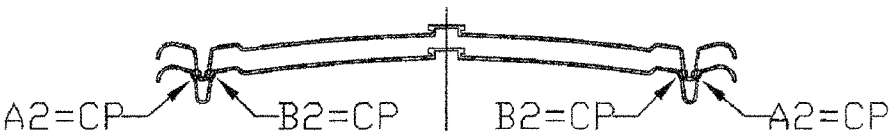
FIG 33-B OPTION #2
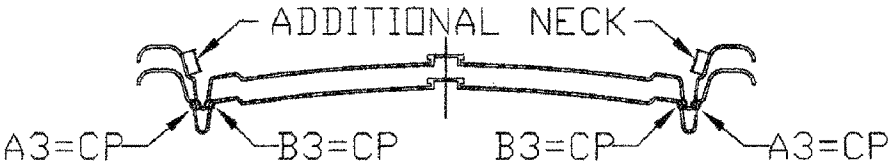
FIG 33-C OPTION #3
FIG. 33-A is Prior Art)

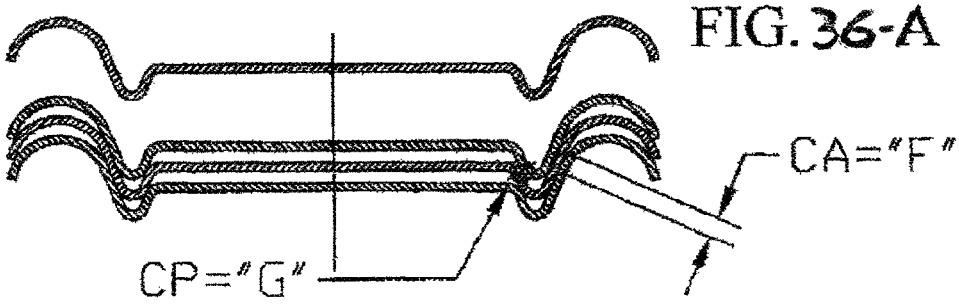
FIG. 36-A
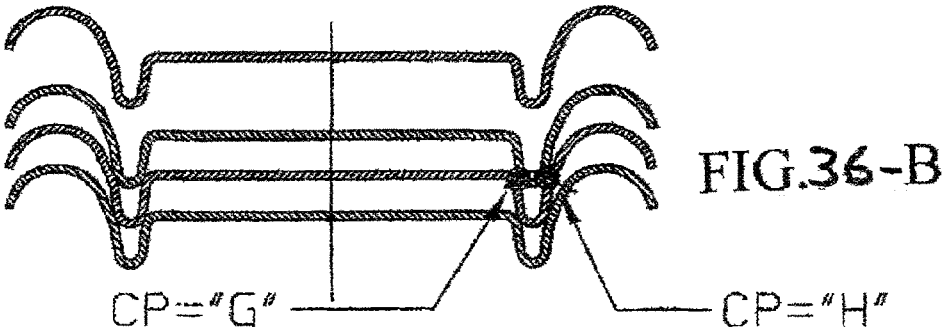
FIG. 36-B
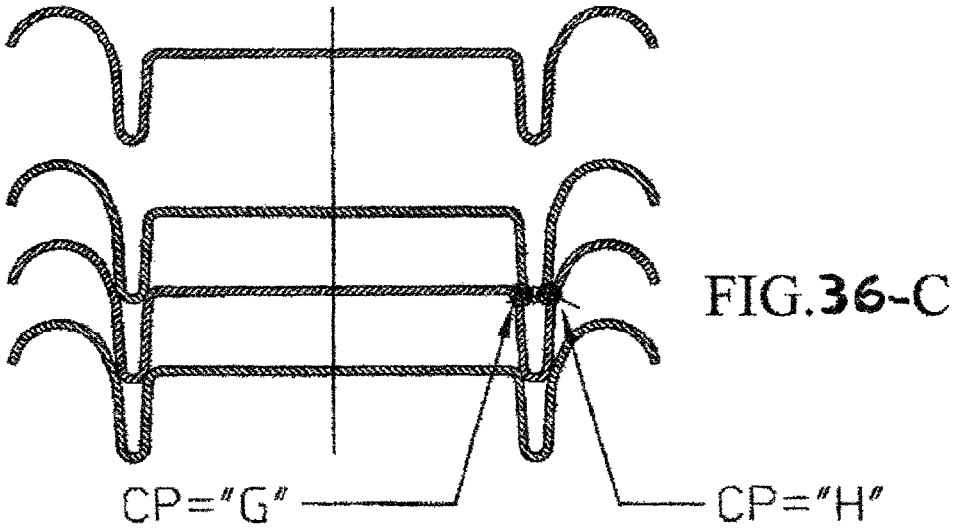
FIG. 36-C

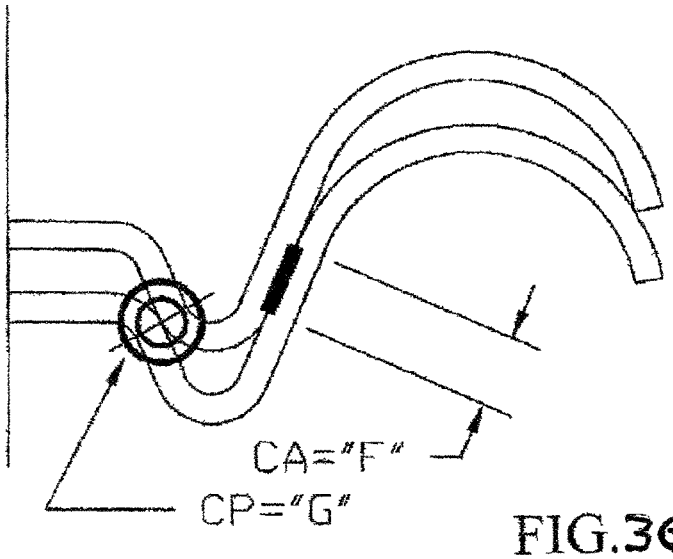
FIG.36-D
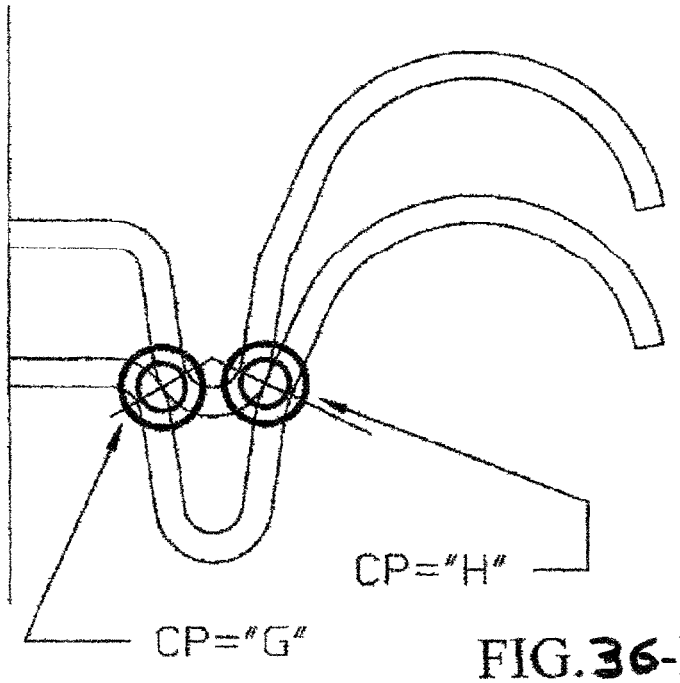
FIG.36-E

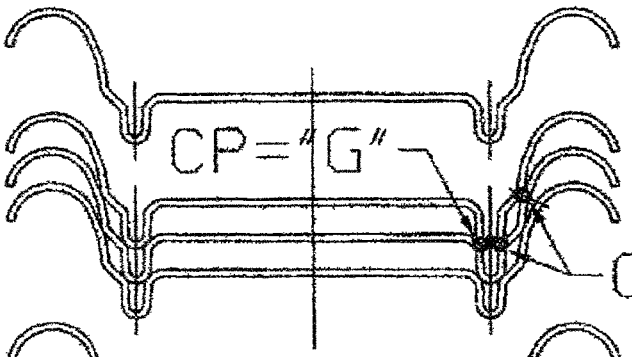
FIG.37-A
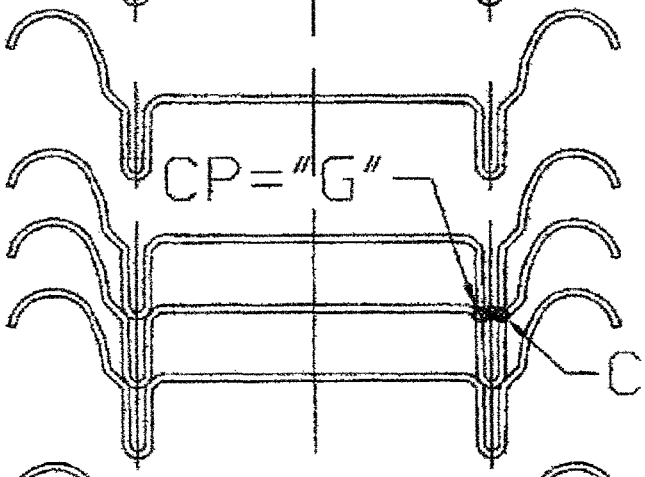
FIG.37-B
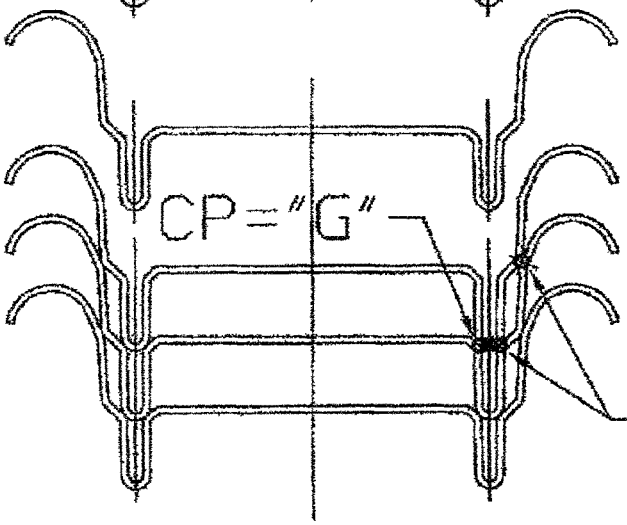
FIG.37-C

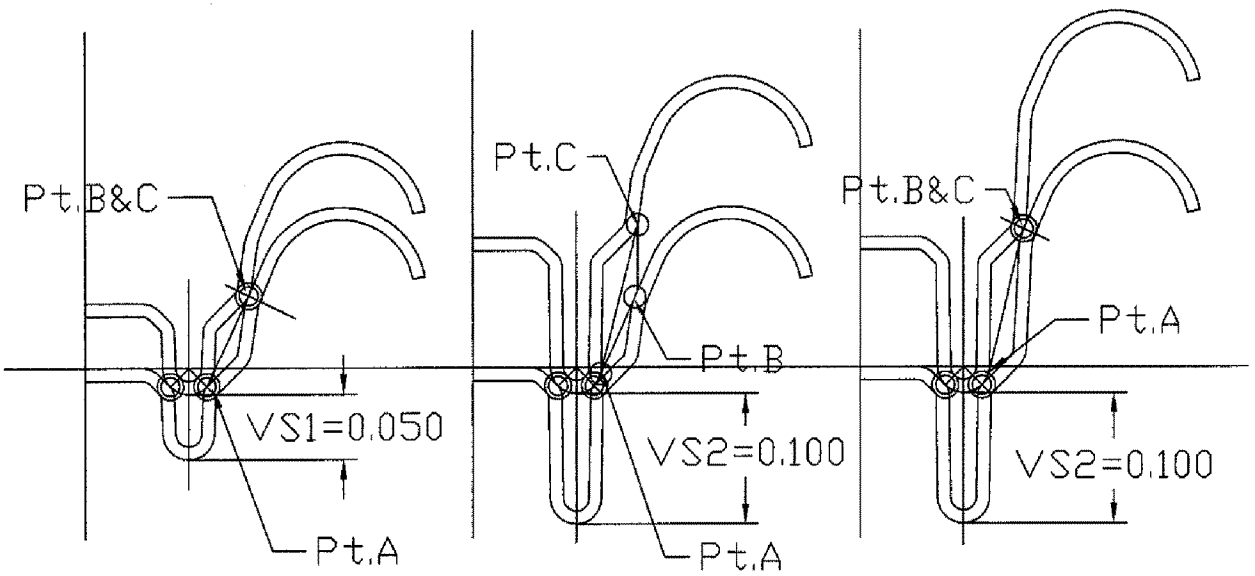
FIG. 37-D FIG. 37-E FIG. 37-F

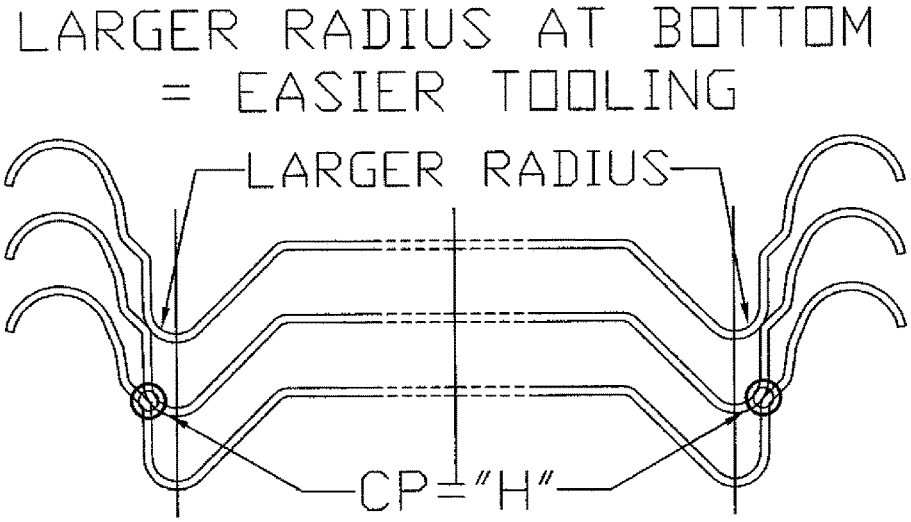
FIG. 39-A

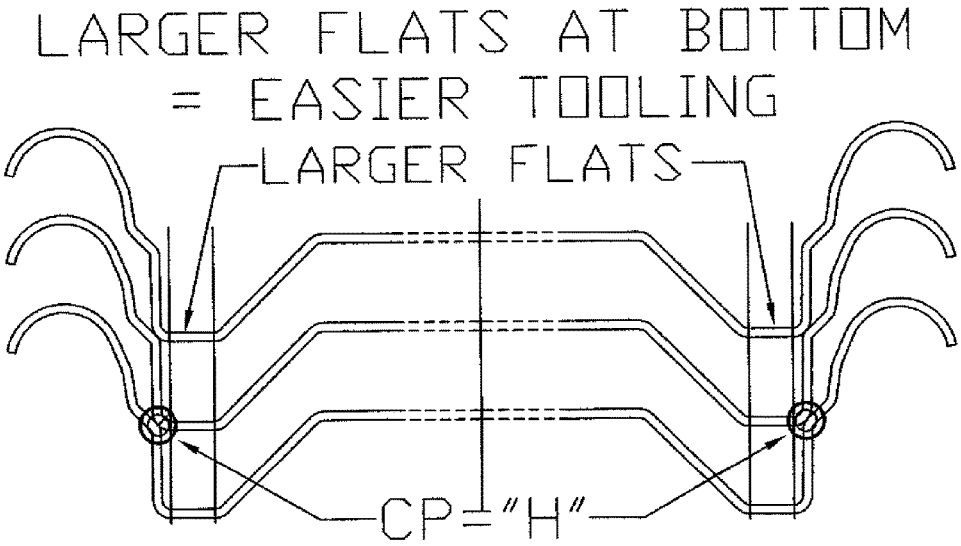
FIG. 39-B

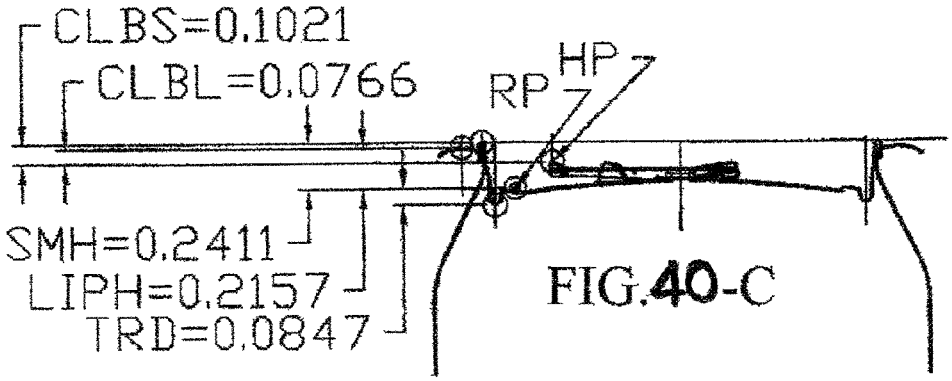
FIG.40-C
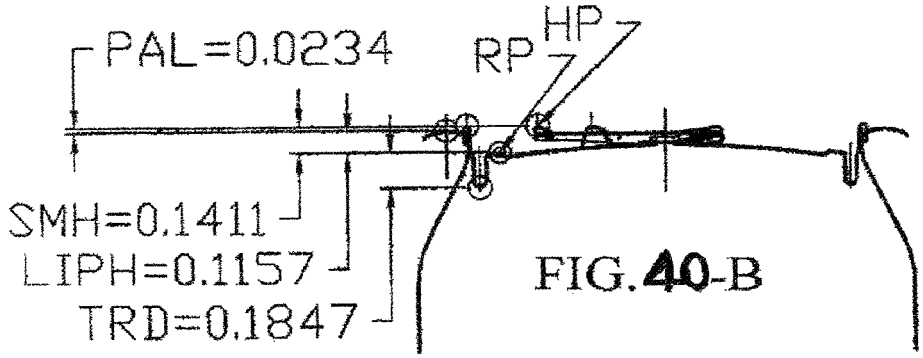
FIG.40-B
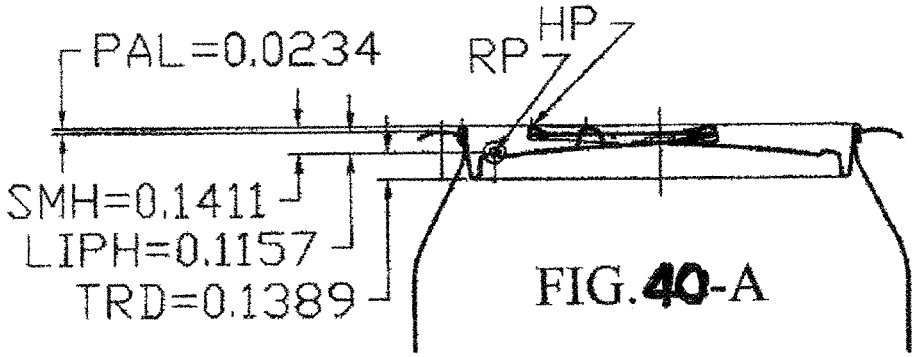
FIG.40-A
(Fig. 40-A is Prior Art)

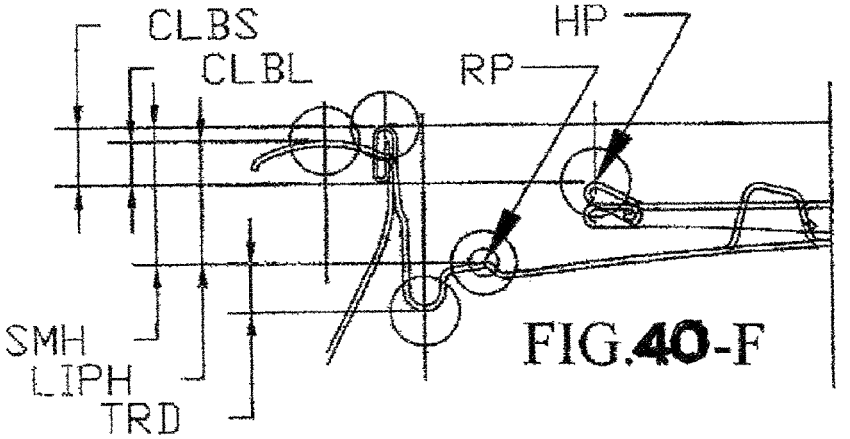
FIG.40-F
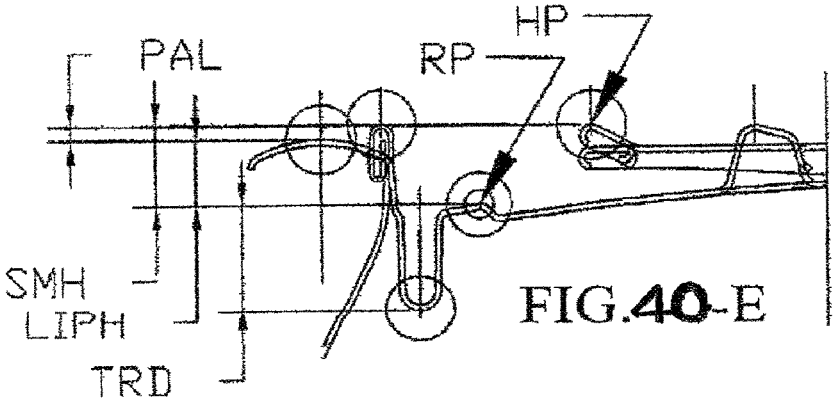
FIG.40-E
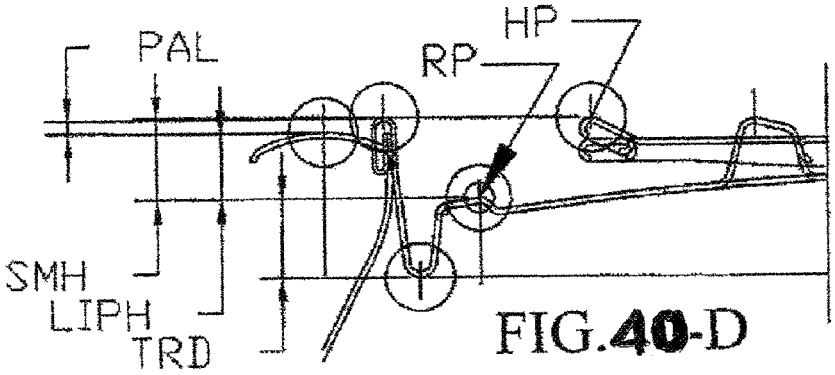
FIG.40-D
(Fig. 40-D is Prior Art)

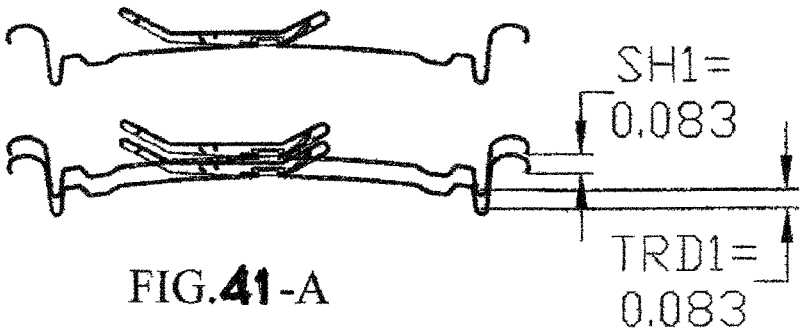
FIG.41-A
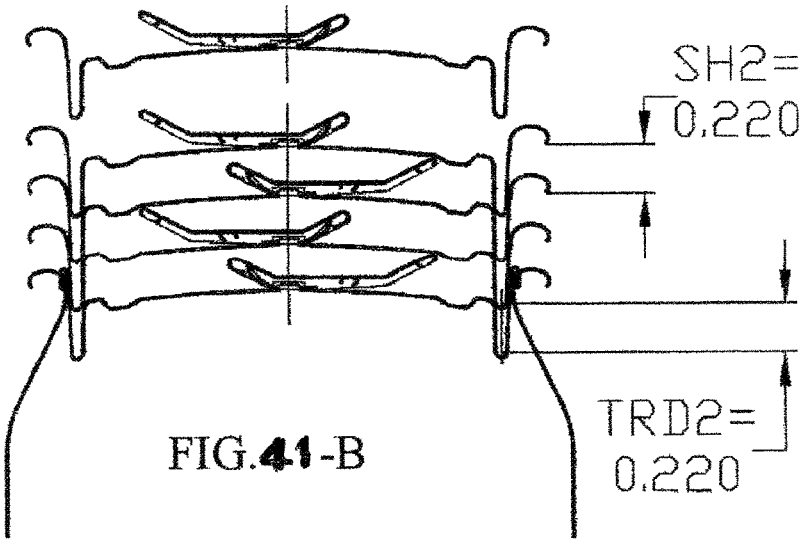
FIG.41-B
(Fig. 41-A is Prior Art)

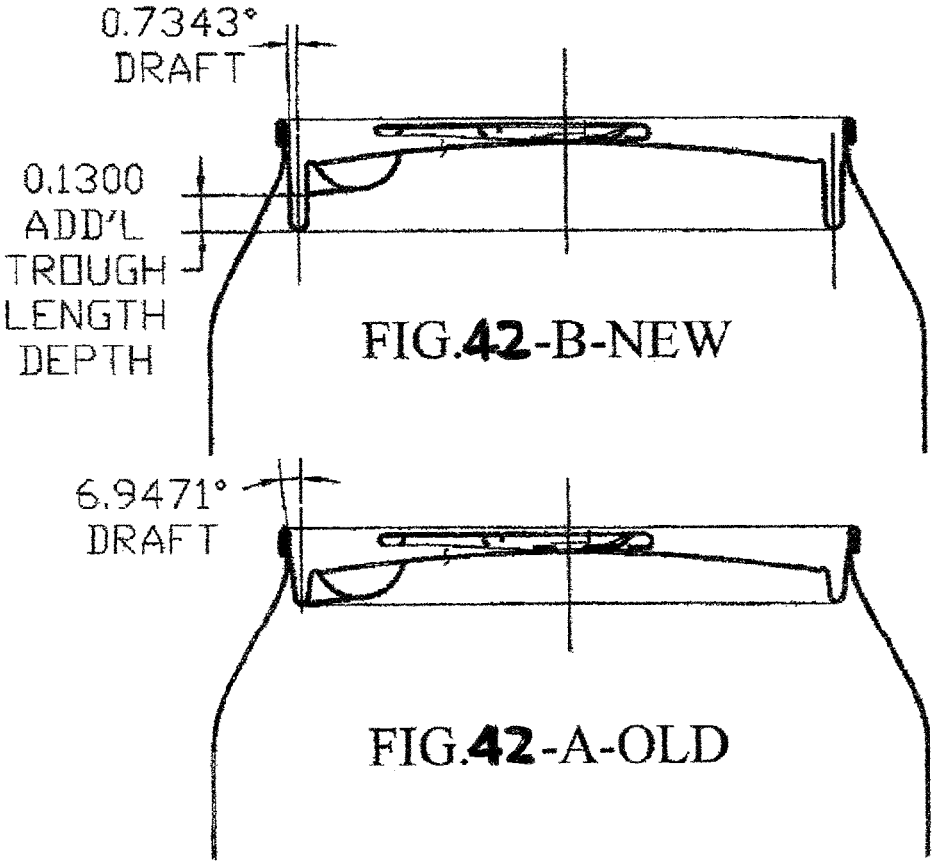
(Fig. 42-A is Prior Art)

FIG.43-B-NEW
NO INTERFERENCE
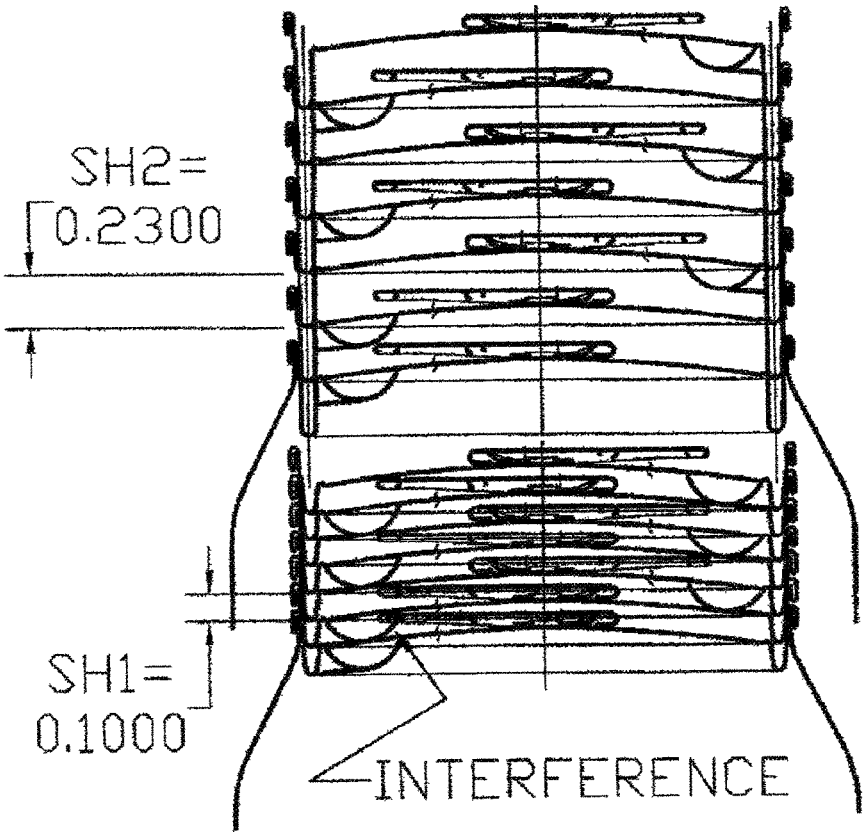
FIG.43-A-OLD
(Fig. 43-A is Prior Art)

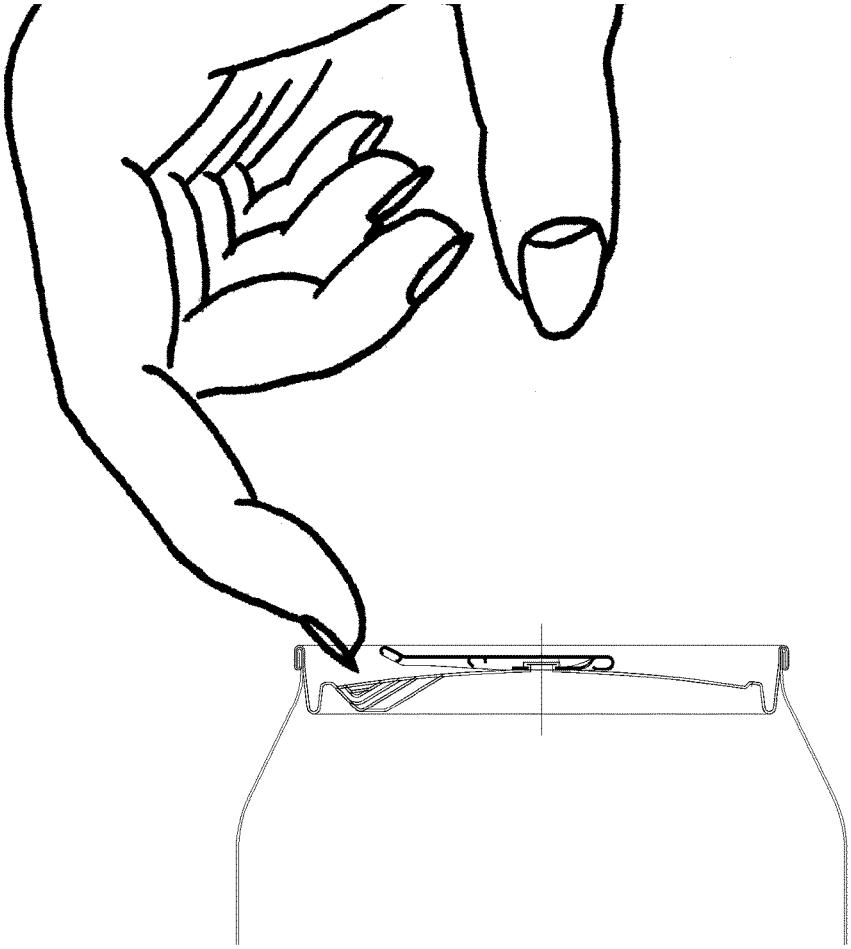
PRIOR ART
FIG. 48-A

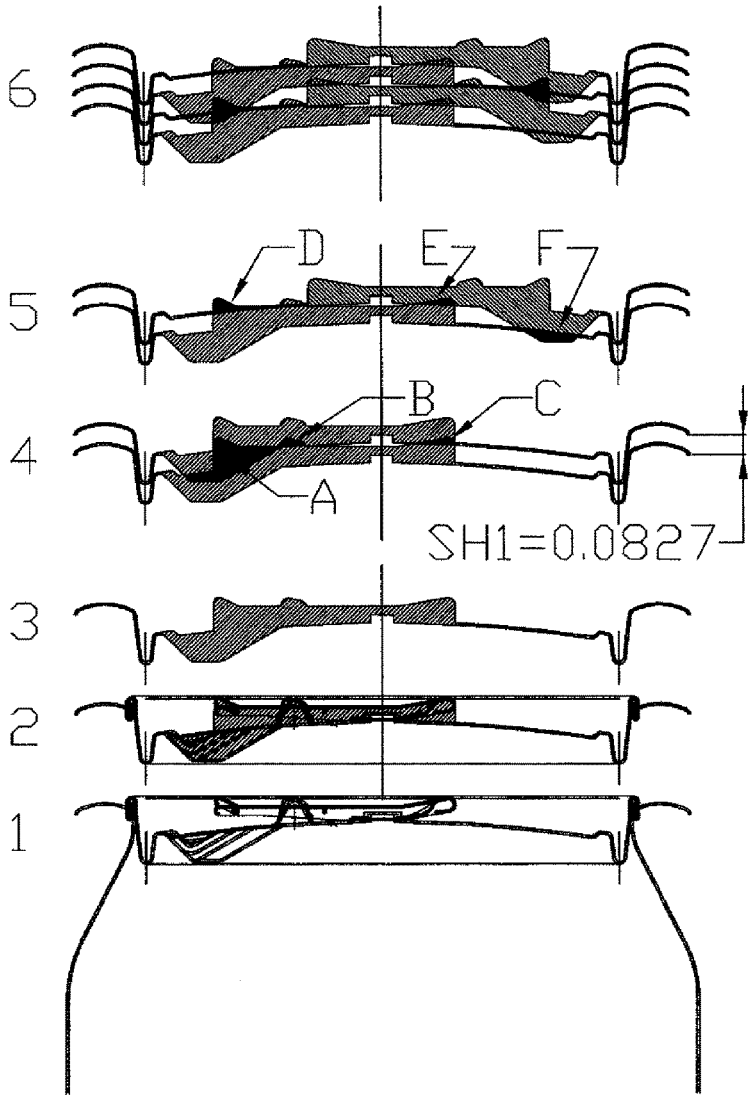
FIG. 48-B

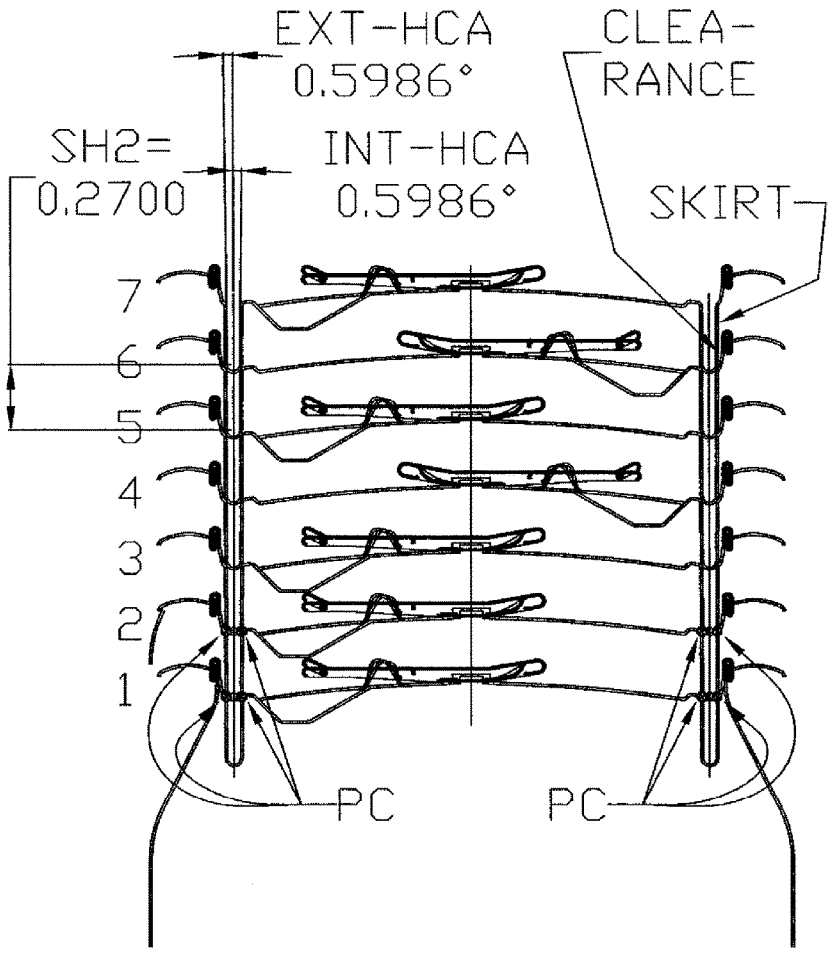
FIG. 48-C

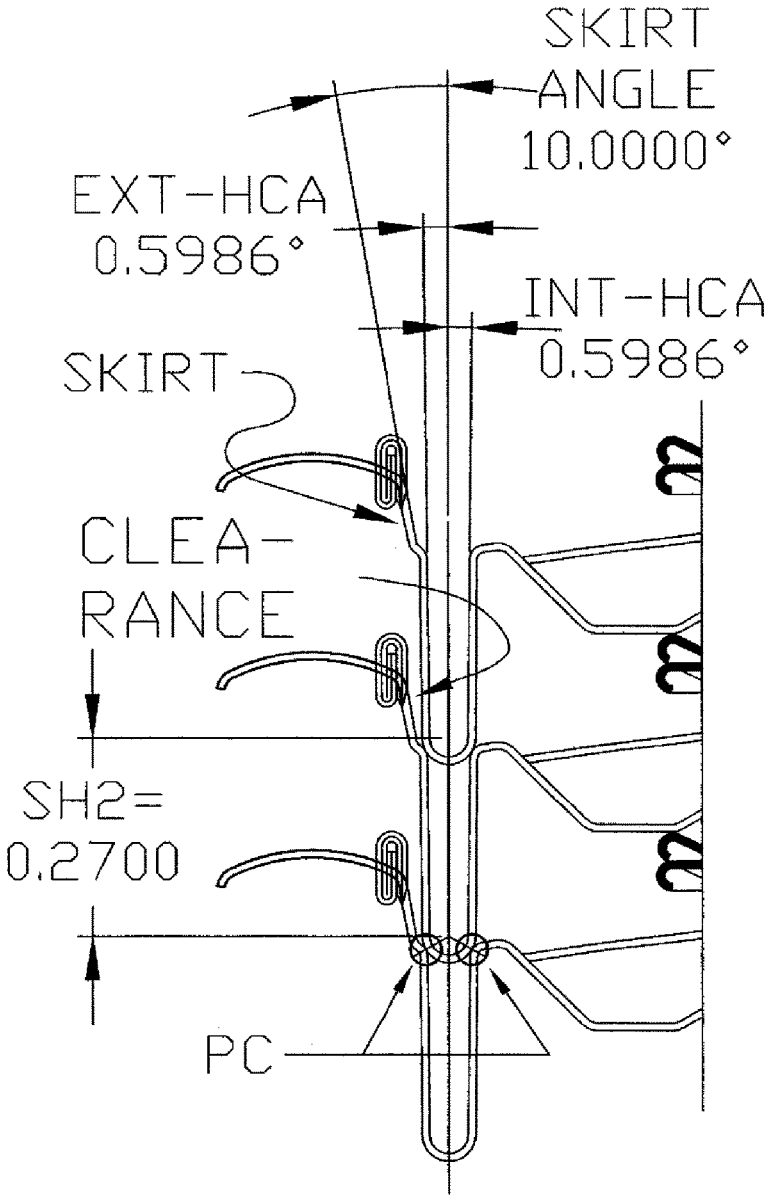
FIG. 48-D

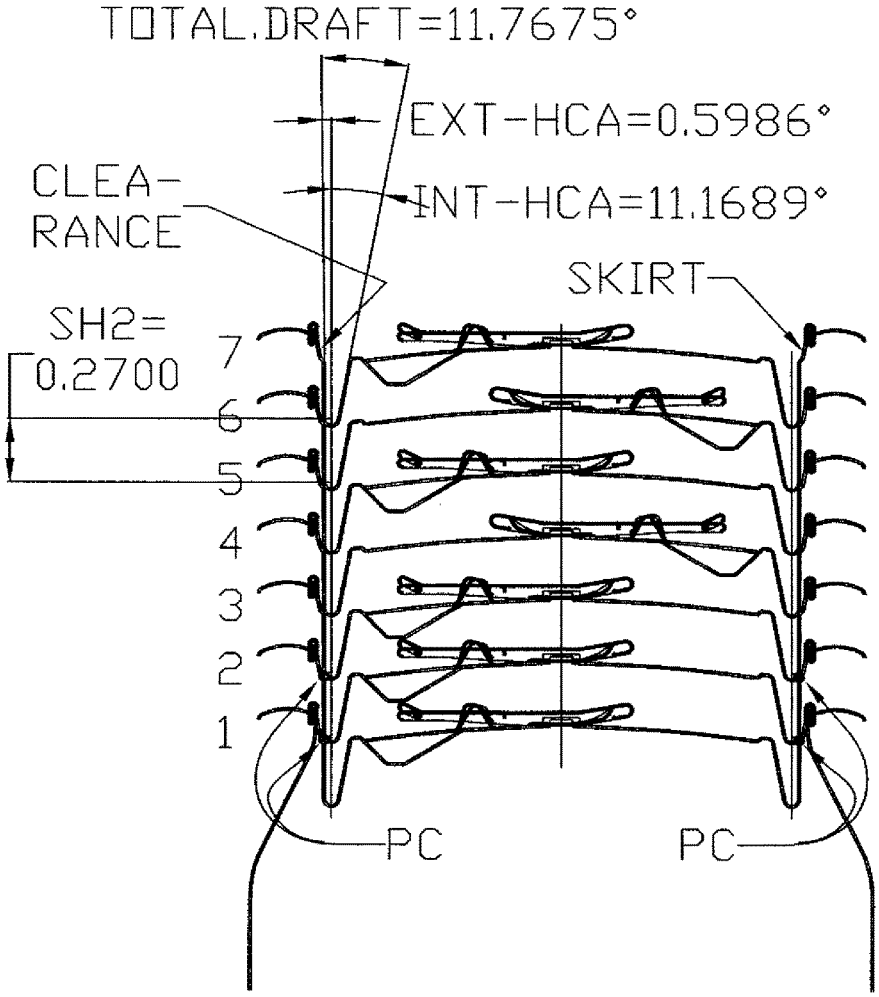
FIG. 48-E

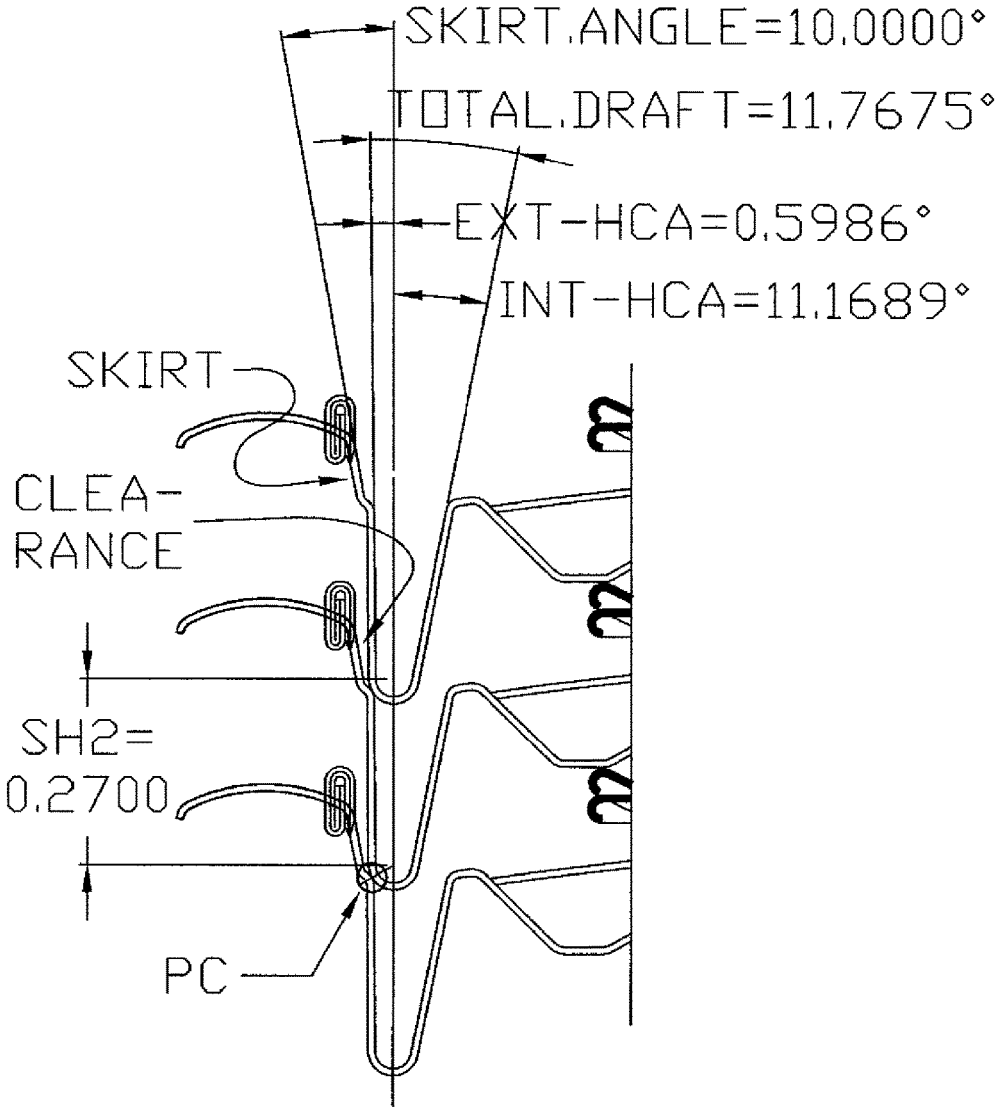
FIG. 48-F

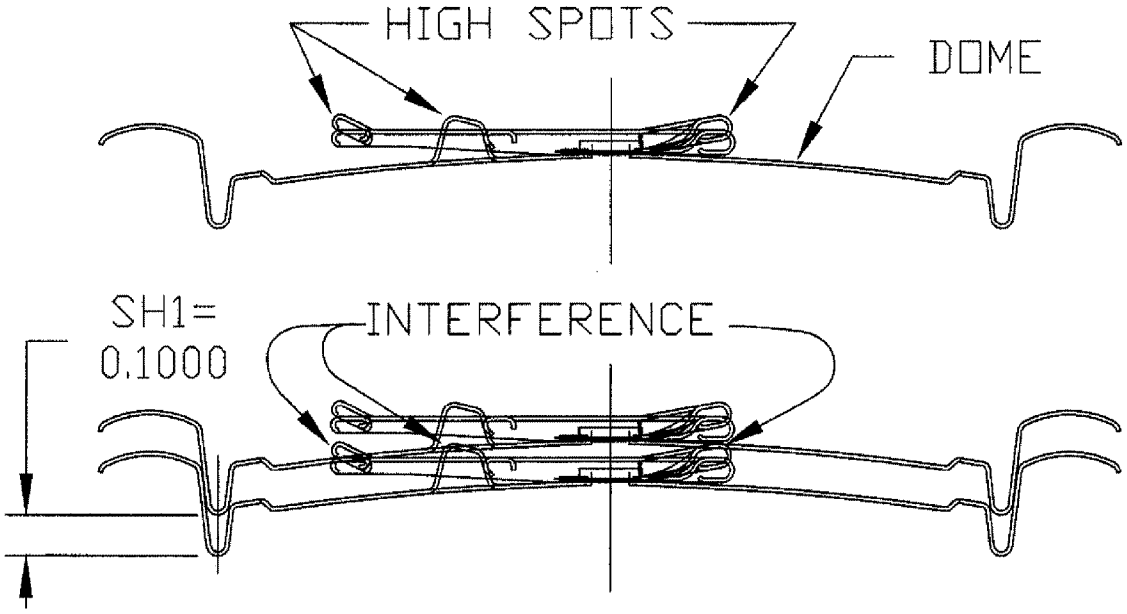
FIG. 49-A
FIG. . 49-B
FIG. 49-A is Prior Art

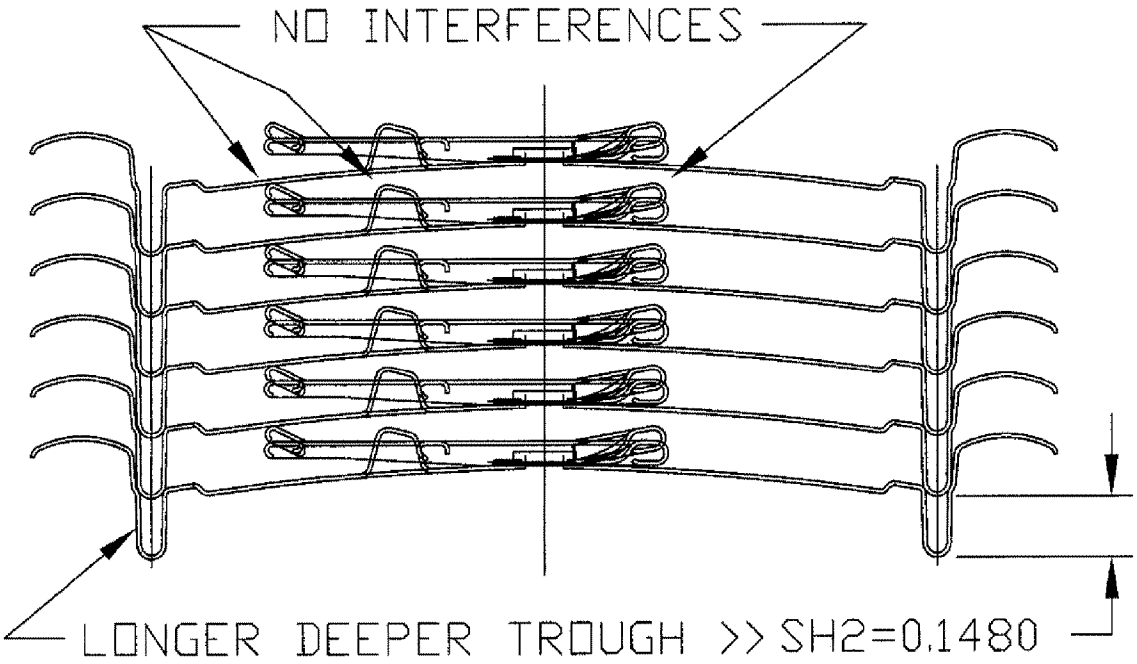
FIG. 49-C

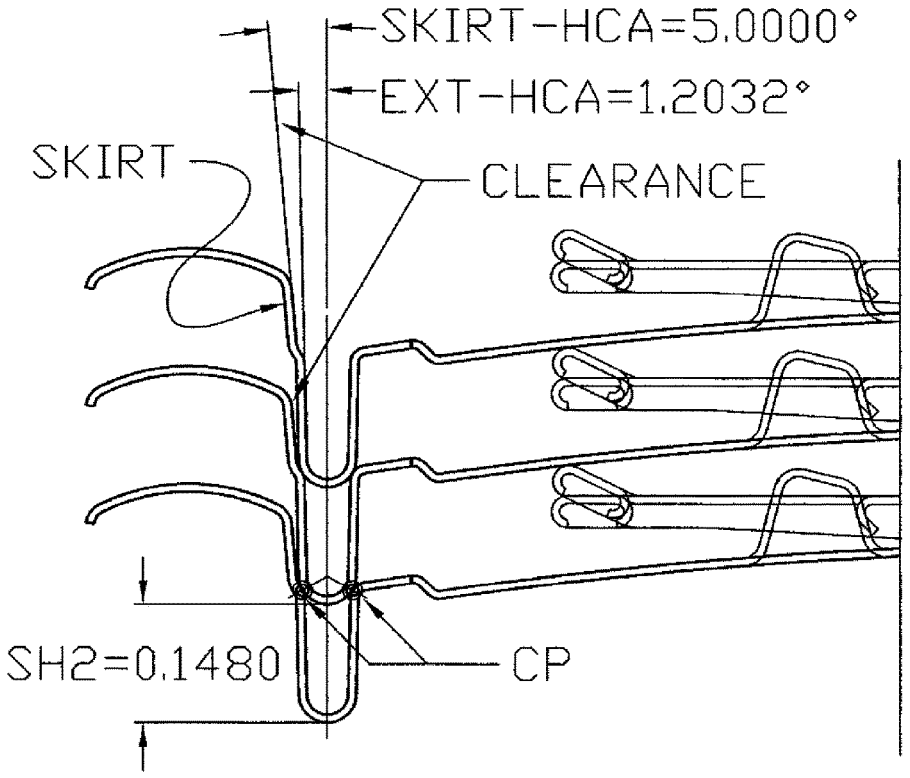
FIG. 49-D

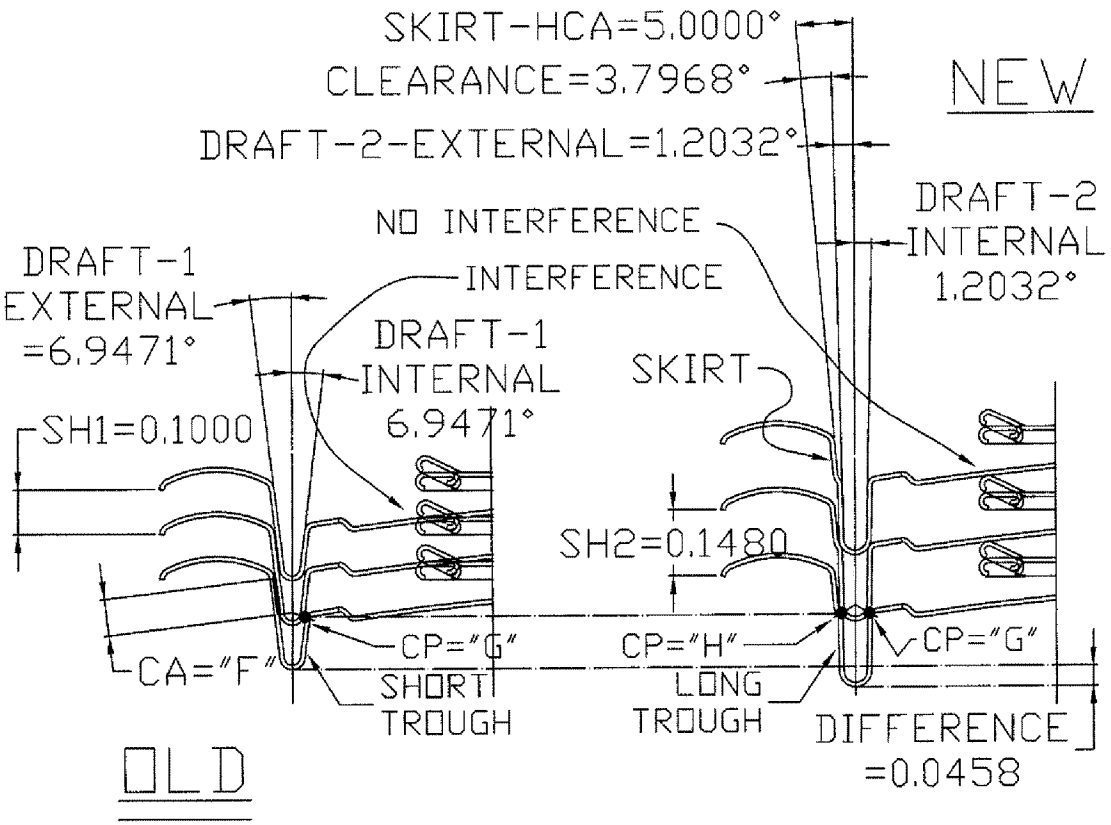
FIG. 49-E (Prior Art)
FIG. 49-F

PT2 PULL TAB LIDS STACKING

CROSS-REFERENCE TO RELATED APPLICATIONS

This present application is a NON-PROVISIONAL UTILITY PATENT APPLICATION claiming the priority and benefits of the seven previous applications, listed in the table below, which include two provisional patent applications and one non-provisional utility patent application, and four design applications, all of which are incorporated herein in their entirety by reference:

This non-provisional patent application is to convert my provisional patent application No. 61/278,279, filed Oct. 5, 2009 to a NON-Provisional, and it is to be considered as a CONTINUATION IN PART to the above Provisional application as well as CONTINUATION IN PART to my utility patent application Ser. No. 10/941,797, filed Sep. 14, 2004, now issued as U.S. Pat. No. 7,617,945, issued Nov. 17, 2009. It also could be considered as a CONTINUATION IN PART to my four Design patent applications listed in the table below, which have issued as US Design patents as listed.

This present patent application is claiming the priority and benefits of all these seven previous applications. It takes advantage of all the benefits of all these earlier patent applications as listed. Five of the referenced patent applications have been granted patents, as listed in the table below.

| MY CODE | patent application No. | Filing Date | TITLE | Issued Pat. No. | Patent Issue Date |
|---|---|---|---|---|---|
| PT2 | 61/278,279 | Oct. 5, 2009 | PT2 | | |
| PT1 | 60/503,823 | Sep. 19, 2003 | PULL TAB | | |
| PT1 | 10/941,797 | Sep. 14, 2004 | PULL TAB | 7,617,945 | Nov. 17, 2009 |
| ETD1-1 | 29/286,717 | May 16, 2007 | LID WITH PULL TAB | D579,771 | Nov. 4, 2008 |
| ETD1-2 | 29/312,178 | Oct. 2, 2008 | LID WITH PULL TAB | D602,776 | Oct. 27, 2009 |
| ETD2-1 | 29/291,638 | Sep. 6, 2007 | LID WITH PULL TAB | D600,116 | Sep. 15, 2009 |
| ETD2-2 | 29/312,177 | Oct. 4, 2008 | LID WITH PULL TAB | D612,724 | Mar. 30, 2010 |

STATEMENT REGARDING FEDERALLY SPONSORED RESEARCH OR DEVELOPMENT

Not Applicable

REFERENCE TO A MICROFICHE APPENDIX

Not Applicable

GENERAL BACKGROUND OF THE INVENTION

Field of the Invention

The present invention generally relates to means for opening cans and container, which have a pull tab that the user lifts and/or pulls to open the can.

Specifically, the invention relates to cans used to contain soft drinks, or beer or soups or sardines or drinks and foods in general or the like. The pull tab is usually lifted by the user to break a seal of some sort or shape. The pull tabs presently used on the market are difficult to grab and lift and some users revert to special tools to start the lifting process.

The mother patent application has proposed solutions to address the problem of opening the tab, but it was discovered that such solutions may create some difficulties with the present manufacturing methods.

The present invention relates to these manufacturing methods and suggests solutions.

Background Information

My mother patent application was granted a U.S. Pat. No. 7,617,945 on Nov. 17, 2009. I will refer to that application and patent as PT1.

But there are some areas where I can improve on PT1 and these are the areas or things that I want to cover in this present application.

So I will call this application the "PT2", and since this PT2 addresses mostly the stacking of lids and its effect on the spacing between lids and/or lids with pull tabs, and ways to provide more "space" between the lids, when they are stacked up one on top of the other, then I will also call this application the PT2 PULL TAB LIDS STACKING. Hence, the title shown above.

SUMMARY OF THE INVENTION

Technical Problem

The problem can be broken down into two parts.

The Problem, Part 1

FIG. 1-A shows the stacking of lids, as per present generally existing designs of the lids presently used on the market. These are "typical" lids which incorporate a pull tab.

Usually, the pull tab is shaped and is assembled onto the lid, in a way that ensures that the lids would stack on top of each other, taking a minimum distance in the height, i.e. in a direction perpendicular to the general surface of the lid, and in the direction of the center line (CL) of the lids, visualizing that the lid is sitting on top of a horizontal surface. I refer to this vertical distance, as the Stacking Height (SH), as shown in FIG. 8. [DEFINITION].

FIGS. 1-A and 1-B show the several possible/potential points of contacts, where the stacked lids can touch when they are placed one on top of the other. I am not sure which of these contact points is the one that the industry uses. It could vary from manufacturer to manufacturer and from lid to lid. But one encounter I had with one manufacturer implied that in their case, they prefer to have the lids touch at the rivets area. I will expand on this subject down below.

Please note that in FIG. 1, the ellipses and/or donuts around the points of contact are there just to highlight the location of those potential points of contact. The direction of the ellipses axes do not necessarily point to the direction of the forces acting at those contact points. Their direction is just to facilitate the location of these potential contact points.

I understand that for high speed production machines used to produce such containers with lids, it is desirable to collect many lids together into a so-called "bag", where the lids are collected and stacked one on top of the other and then bundled and wrapped to look like sticks, each stick containing dozens of lids. So they can be handled easily and at a high rate of production. They have a special machine that does this job, and it is even called the "bagger". It is desirable that the stack in the bundle be "solid", without too much empty gaps between the lids. Otherwise, the bundle could feel "SQUISHY".

When I showed my PT1 designs to an expert in the industry, let us call him Joe, for simplicity, Joe's main critique was that the lids will not stack properly. Joe showed me a handful of lids, which he stacked one on top of the other, and then he placed his finger on top of the rivet holding the tab to the lid and pressed down. The stack felt solid and did not compress down.

Joe explained that the machine that feeds the lids into the seamer, which is the machine that attaches the lids to the body of the containers, runs at a high rate of speed and needs to have a reliable continuous stream of lids. If the lids in the stick are not presented to the seamer properly, the seamer would not perform properly either and may jam. It may take hours to clear such a jam.

So, one of the requirements to ensure that the lids could feed properly is to make sure that the lids stacks are not "squishy". The lids should stack one on top of the other in a solid stack, with no appreciable play or clearance, when compressed.

Let me repeat to emphasize the important points.

The reason the lids are made the way they are, is to facilitate the process of assembling the lid (with its pull tab) onto the body of the container or "can", to end up with the finished goods, which are like the soda cans, beer cons, sardine cans, or the like.

The process of assembling the lid to the body, or rather, the machine that does this assembly procedure, is usually called the "seamer" or more appropriately, it is known as the "double Seamer", because the lips of the lid and the body are rolled over "twice" into and over each other.

The "double seam" operation has been improved over the years and automated to a high level, in order to accommodate the high volume demands of the market.

One of the features of the "double seamer" machines is that the lids (I will refer to the lids with their pull tab already attached to the lid base, simply as the "lid") are placed in a "tube-like" magazine, stacked one on top of the other, like the "PRINGLE" potato chips. I will refer to these magazines as the "tubes", although the experts in the field may have other names for them, such as "BAGS" or "SLEEVES", for example.

The bags/tubes are filled up with the lids and then brought to the "double seamer" machines and placed in such a way so that the machine would take one lid at a time and attach it to a respective body, and then the machine would "roll" the lips of the lid together with the lips of the body, to create the desired "seam" or rather "double seam" at it is referred to usually.

The operation of the seamer machine is so fast, that it requires a steady stream of lids and tubes to be brought to the line. I understand that the machine can handle hundreds or thousands of lid/bodies in an hour. So a lot of "tubes" would be required to "feed" the machine By the way, these bags or tubes are also referred to as "SLEEVES".

Consequently, the manufacturers strive to make sure that the lids are "thin" so that a max # of lids can fit in a tube of specific length or height. So they make sure that the pull tab is as flat as possible and the height cross-sectional profile of the lid is a "short" as possible, in the axial direction of the tube/sleeve.

However, this desire to make the lid as short as possible has created a few problems.

Because the tab is flat and is "riveted" to the lid so tightly, it is difficult to lift and pull the tab and to open the can. In order to solve this "opening" problem, I have filed my previous patent applications on a few concepts, which aim to make it easier to open such pull tab containers.

Please see my "mother" applications, PT1, etc. They include one "utility" patent application, PT1, which has been granted as listed in the table in the cross reference paragraph. They also include four (4) design patent applications, which have also been granted patents as listed in the same table above.

The Problem, Part 2

Many of the concepts in my above patents require that the pull tab be shaped to have a bend either at the lifter tip or at the punch nose, or elsewhere. It can also have certain protrusions below the standard surface of the conventional tabs.

Also, the lid body itself may be shaped to have certain features, such as a ramp on top of the lid surface or below it, or certain "recesses", such as finger wells, that go below the main flat or domed body of the lid. The end effect of these various features is that the "total/effective" height or thickness of the "assembly" of the lid and pull tab becomes higher or thicker than the normal lids that are presently used on the market/in the industry.

The "seamers" would object to such improvement in the lids and pull tabs, because they would need some changes in their present/existing manufacturing methods and possibly tooling.

To be more specific, I will list here below, the instances or embodiments, where there will be objections from the industry against my improved lids and pull tabs in my patents referred to earlier above. ALL of these objections can be solved by taking care of the stacking situation, using my proposed solutions, offered in this present invention, as will be explained down below.

1. The following figures of my old PT1 patent show embodiments, where my lid body has features below the generally accepted shape of lids presently used in the industry: In my PT1 patent No. U.S. Pat. No. 7,617,945: All the embodiments shown in FIGS. 11 through 17, 20, 21, 81, 82, 90 through 112. Plus all the embodiments shown in my Design U.S. Pat. No. D602, 776 and in Design U.S. Pat. No. 600,226.
2. The following figures of my old PT1 patent show embodiments, where my lid body has features above the generally accepted shape of lids presently used in the industry: In my PT1 U.S. Pat. No. 7,617,945: All the embodiments shown in FIGS. 31 through 74. Plus all the embodiments shown in my Design U.S. Pat. No. D612,724.
3. The following figures of my old PT1 patent show embodiments, where my pull tab has features either below or above the generally accepted shape of pull tabs presently used in the industry: In my PT1 U.S. Pat. No. 7,617,945: All the embodiments shown in FIGS. 16 through 21, 23 through 31, 46 through 57, 66 through 68, 75, 90 through 99 and 102 through 117. Plus all the embodiments shown in my Design Pat. U.S. Nos. D579,771, D602,776, D600,116 and D612,724.

By including these listed embodiments, from my previous old patents, here in this specification, I am claiming that each and every one of them are part of this present patent application and the solutions presented in this patent application are applicable to each and every one of them. Also, the present inventions and solutions are applicable to other devices that may be having similar problems.

Objective

The purpose of the designs and constructions and embodiments offered by the present invention is to satisfy the above stacking requirements and problems, in light of my PT1 patent and the 4 Design patents, and to show some examples of lids with pull tabs utilizing theses designs.

Possible Solutions to the Problem

One possible solution would be to adopt a different way of "feeding" the new lids into their machines. For example, the lids could be supplied on a conveyor system and by using a "pick and place" mechanism, each lid would be placed on its respective can/container body at the "seaming" station. Such a pick and place system is well known to manufacturers of automatic assembly machines and it is relatively easy to make and to adopt. However, this would require a "RETOOLING" which is not very desirable in any industry.

A second solution would be to find a way to "stack" the lids on top of each other in a way pretty similar to the present ways, to be able to place them into "sleeves" or "tubes" or "bag", similar to the present ones, but with some proper adaptive measures.

So, the present invention addresses certain improvements in the designs of the lids, to accommodate this second solution.

As will be seen further down below, I propose to stack the lids, having them resting on specific parts and points of the troughs, which I call the KNEES and the HEELS, and by shaping the trough's Lower Leg (LLEG) to have a certain length, so as to provide adequate space for any ancillary components that are introduced in the design of the lids.

Advantageous Effects of the Invention

The invention will solve two problems, which are blocking my previous prior art inventions from being accepted by important manufacturers in the industry:

1. It will provide room and space for the ancillary components and their various shapes and designs, that I have introduced by my previous prior art inventions, as listed in the References. It will help other similar inventions, like mine, which may come later, whether by me or by other inventors.
2. It will provide means, ways and methods to stack my prior art lids and similar lids, in stacks that are not SQUISHY, where the lids will be stacked solid in a more concrete, definite, predictable and reliable fashion.

BRIEF DESCRIPTION OF THE DRAWINGS

FIGS. 1-A, 1-B, and 1-C show the Prior Art lids and the way they are or could be stacked. The lids are shown with the typical shape of the lids presently on the market. The points where potential contact can occur are also shown.

FIG. 1-C shows the items that correlate with the entries under Abbreviations and Definitions.

FIG. 8 shows the location of the terms used throughout these FIGS. 3 through 11, as correlated with the section on Abbreviations and Definitions in this specification.

FIG. 3 shows the special or extreme case of when the HCA is 90 degrees, while FIG. 11 shows the other special or extreme case of when the HCA is Zero degrees.

FIG. 13 shows five sub-figures of prior art lids and of simplified ones.\

FIG. 14 shows a study of the troughs and the shape of certain parts of the troughs.

FIGS. 15-A and 15-B introduce one of my new proposed approaches, as per present invention. It moves from stacking the troughs on their flanks, as in the previous figures, to stacking them on certain points, within a certain envelope.

FIGS. 21-A through 21-D and 22 show and highlight in particular the possible shapes of the troughs at the point of interaction between on trough stacked on top of another.

FIGS. 23-A through 23-D expand on the concepts covered in FIGS. 18 through 22.

FIGS. 24-A and 24-B expands on the concepts covered by FIGS. 18 through 23-D, especially by FIGS. 18 through 20.

FIGS. 25 through 27-B introduce the concept of the ledge, in terms of the "Lower Leg" (LLEG), the HEEL and the KNEE, as parts of the lid's trough, which will interact with each other, when lids are stacked one on top of each other, as per this invention.

FIGS. 28-A through 28-D introduce the concept of the domain or the orbital domain.

FIGS. 33-A through 33-C show three possible situations of how the lids can be stacked.

FIGS. 36-A through 36-E show an arrangement similar to the one shown in FIGS. 31-A through 31-C, but with certain differences.

FIGS. 37-A through 37-F introduce another important point or feature. They show lids pretty similar to the ones shown in FIGS. 36-B, 36-C and 36-E. The difference here is that the lids have a skirt.

FIGS. 38, 39-A and 39-B show lids, with troughs that have been opened up to get larger draft angles etc for more ease of manufacturing and/or better tooling.

FIGS. 40-A through 40-F show a direct application of the previous concepts, applied to one of my PT1 lids.

FIGS. 41-A and 41-B show another application of the concepts of this invention, to solve a stacking problem with another one of my Prior Inventions.

FIGS. 42-A, 42-B, 43-A, 43-B and 44 show another application of the present invention's concepts to yet another lid of my PT1 patent.

FIGS. 48-A through 48-F show another application of this present invention to another one of my prior art PT1 patent's lids.

FIGS. 49-A through 49-F show vet another application of the present invention.

ABBREVIATIONS AND DEFINITIONS

Many new terms will be defined throughout the specification, and will be highlighted as such. Here are some other new definitions that will be used, dispersed in the specification text. Please see especially FIGS. 1-C, 8, 40-A through 40-F, etc., to help in understanding the following definitions:

Bell Mouth=the opening at the top of the trough.

CA=Contact Area (Length), or Carrying Area (Length), between two devices, stacked one on top of the other, as item F in FIG. 1-B, and item CA in FIGS. 36-A and 36-D. In most of the figures in this application, the views show the cross-sectional views of the lids and/or the containers. The distance designated as CA looks like a "line" in the cross-sectional view, along the flanks of the trough, but in fact it is the "generatrix" representing an area, if we look at it in a 3-dimensional view. It is usually a portion of a contact cone of the body of the devices being stacked one on top of the other. If the HCA of such CA's is small, there may be a tendency for the stacked devices to lock together, to create what is know as the Morse Taper Condition or Effect.

CL=Center Line, usually the Center Line of the lid or of the container.

CLBL=Clearance Below (Open) Lip, i.e. Clear Distance between HP and highest point of Open Lip, as in FIGS. 40-A through 40-F CLBS=Clearance Below Seam, i.e. Clear Distance between HP and highest point of Closed Seam, as in FIGS. 40-A through 40-F Clearance Angle=the draft angle of a part of the lid, which extends beyond the contact points between two lids stacked on top of another. It ensures that the lids would not have a "CA", i.e. a contact along a line or surface, between the two lids. This is illustrated on time in FIGS. 49-E and 49-F. It is also illustrated in a different way in FIGS. 37-D, 37-E and 37-F, especially by the angle "BAC" in FIG. 37-E CLT=Center Line of the Trough, even if the trough is not perfectly symmetrical about this center line.

Figure 8:
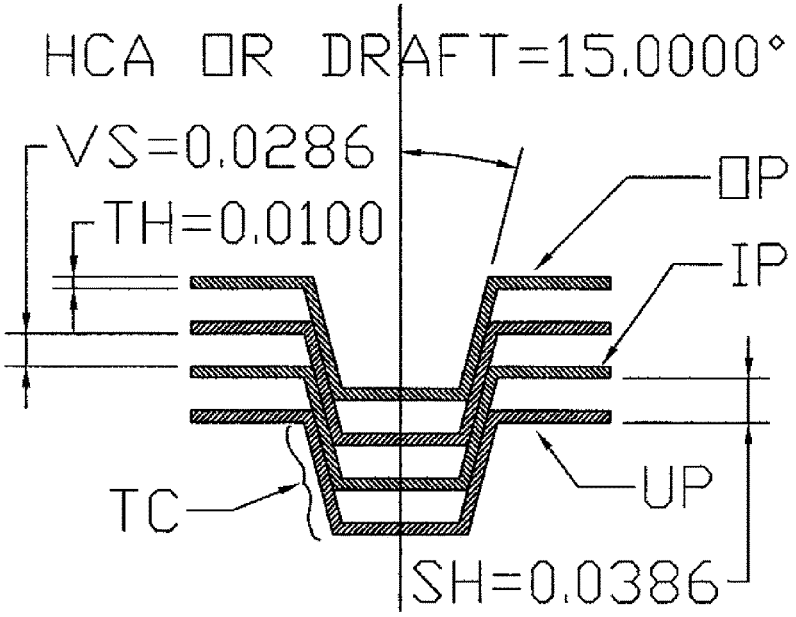
Figure 9:
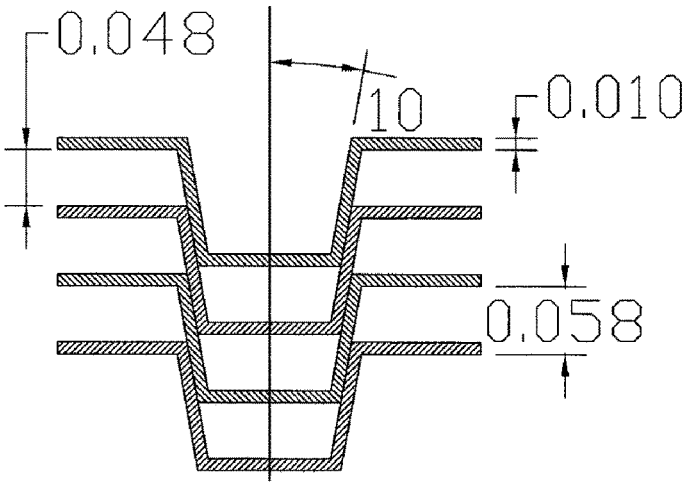
Figure 10:
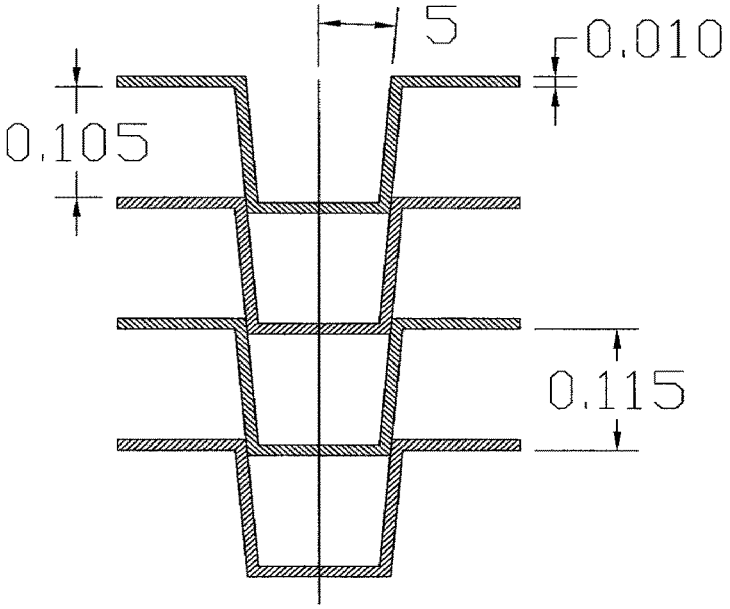

Cone=an imaginary cone, that shapes the slanted walls of a dish, cup, lid or similar objects stacked one on top of the other, as shown in FIG. 8. The inside/internal slanted surfaces of the lower "LowerPosed (LP)" or "Underposed (UP)" cup, which support the upper "OverPosed (OP)" or "Superposed (SP)" cup, sitting on top of said lower UP cup, represents a portion of such a cone. Usually, it is a portion of a cone, and sometimes I refer to it as the Truncated Cone "TC".

Cone, open at bottom=It is an inverted cone, as opposed to the "Cone, open at the top". It is a cone, as represented by the surfaces 9 and 11 in FIG. 1-C. We could also call it a "Cone, with bottom mouth".

Cone, open at top=It is a cone, as shown in FIG. 8. It is also represented by the surfaces 10 and 12 in FIG. 1-C. We could also call it a "Cone, with top mouth".

Containers, Body and Lid=Beverage or food containers and the like comprise at least a container body and a container lid. Most of the figures shown in this specification show a cross-sectional view of either the lid or the lid with the body. The containers can have a round circular shape, if we look at it from the top, like with soda and beer cans, or they can have a shape that can be described as oblong or square or rectangular, with rounded, filleted corners, like with sardine cans and the like. The lid and the body are joined together at their perimeters, by a process, usually done by a process machine, known as the Seamer or the Double Seamer. In many cases, I do not show any cross-hatching in the cross-sectional views, just for clarity and to avoid the clutter.

CP=Contact Point, or Carrying Point, between two devices, stacked one on top of the other. Examples of such points are represented by items D, E, G, and H in FIG. 1-BC, and by the two items CP in FIG. 36-D and 36-E, and Pt. A in FIG. 37-D, 37-E and 37-F. In reality, this CP point is the Generatrix of a contact line or circle, which shows as a single point in the cross-sectional view. Please note that sometimes, I use the Abbreviation 'PC", Point of Contact, in some instances. I use it as a synonymous word for CP.

Figure 29:
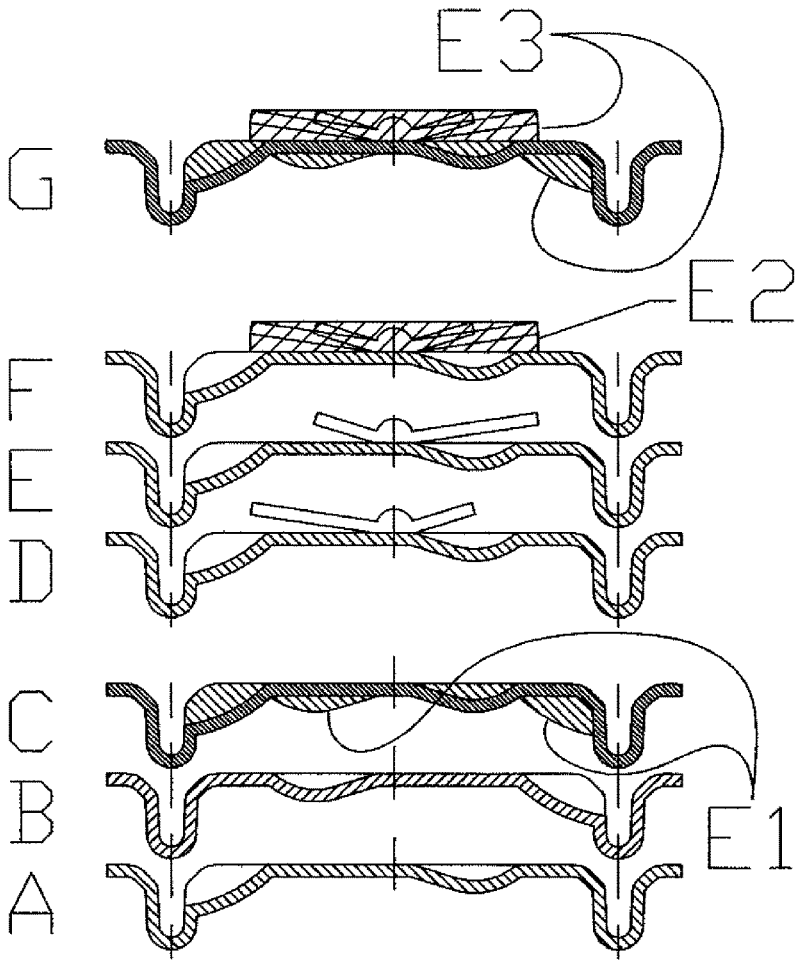
FIGS. 29 and 30 show an example of the orbital domain in connection with lids, similar to some of the lids of my PT1 patent.
Figure 30:
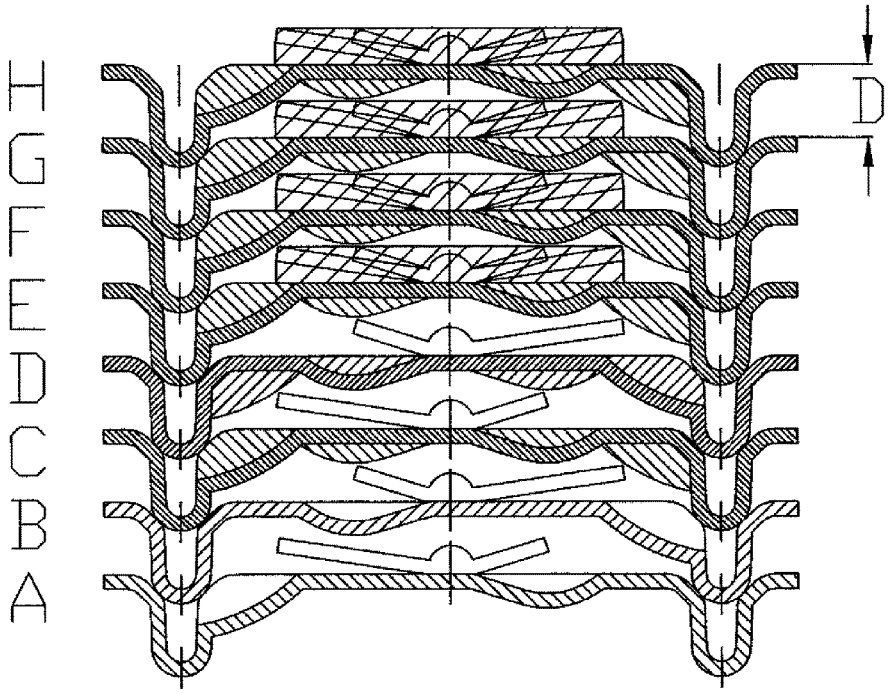

Domain or Orbital Domain=The space surrounding a stackable device, which encompasses all the components of said device, when such components are placed in any of the positions, that they possibly can be found at, if said device is placed/rotated around an imaginary rotation axis, where such axis is in the direction of the stacking arrangement. If a second such device is placed on top of a first such device and said second device encroaches on the domain space of said first device, then the stacking arrangement would be disrupted and interference can occur. This is illustrated in FIGS. 28-A through 28-D, 29 and 30. The domain of the device in FIGS. 28-A through 28-D is shown in FIG. 28-C. The domain of the Punch Recess and the Finger Well in FIG. 29 is represented by E1 in FIG. 29, view C. The domain of the tab with it raised punch and lifter ends is represented by E2 in FIG. 29, view F. And the total domain of the total lid is represented by E3 in FIG. 29, view G. If we want to stack such a lid, without getting interferences, then we need a stacking height of D or larger as shown in FIG. 30. The domain is also the basis of what is being shown in most of the figures of this application, but explicitly in FIGS. 40-ABC and 40-DEF through 44 and FIG. 49-A through 49-F.

Dome=See Lid Panel

Double Support Condition=this is where a superposed SP lid, sitting on an underposed UP lid, makes more than one contact between the two lids. Examples of such Double Support Conditions are shown by items CP in FIGS. 36-B, 36-C, 36-E, and Points A in FIGS. 37-D, 37-E and 37-F. This is usually difficult to control and could make for an unstable stack. It is better to have only one contact point or support point on each side of the Center Line.

Draft=Draft Angle, i.e. the slope of the trough wall in the case of a lid. It also equals the Half Cone Angle (HCA) of a cone or a truncated cone that represents the trough at the respective location.

Figure 44:
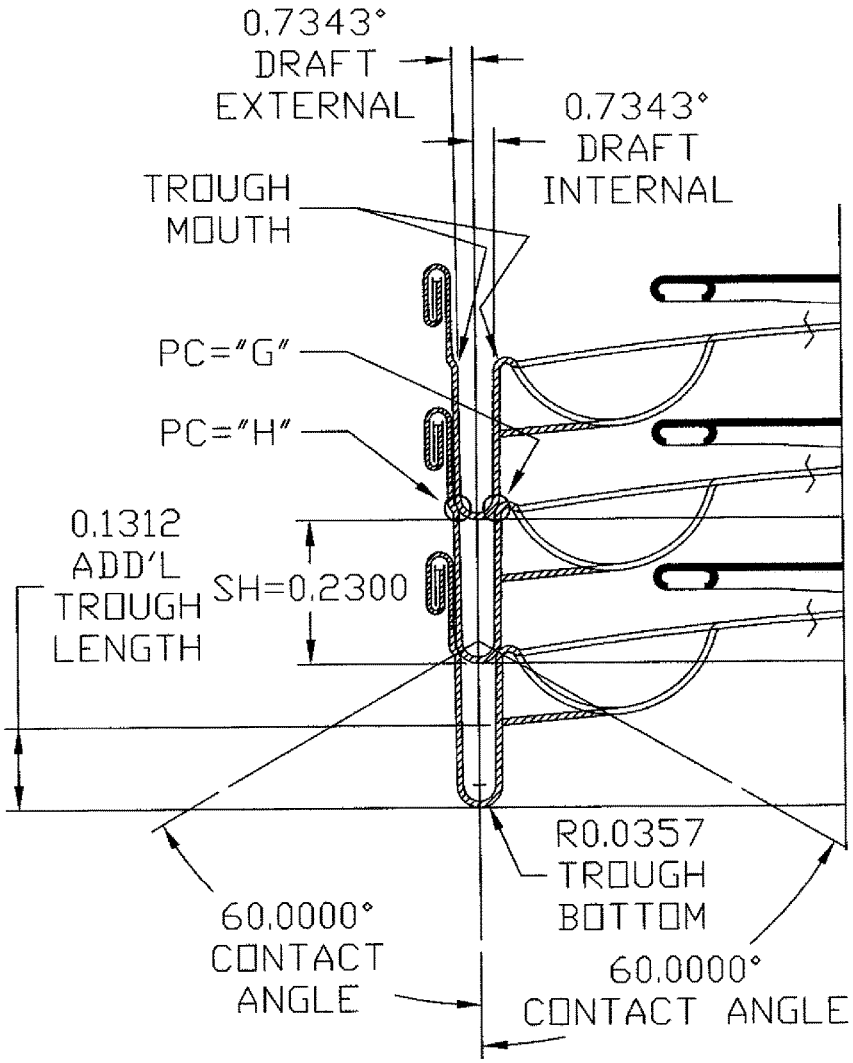

Draft, External=Draft Angle of the trough wall, such as that represented by item 12 or 10 in FIG. 1-C, or as shown in FIGS. 44 and 49-E and 49-F. This is equivalent to a HCA of a "Cone, open at top", passing through the walls 12/10 of FIG. 1-C. External refers to the fact that the draft angle is away from the Center Line of the Lid.

Draft, Internal=Draft Angle of the trough wall, such as that represented by item 11 or 9 in FIG. 1-C, or as shown in FIGS. 44 and 49-E and 49-F. This is equivalent to a HCA of an inverted Cone, "Cone, open at bottom", passing through the walls 11/9 of FIG. 1-C. Internal refers to the fact that the draft angle is towards the Center Line of the Lid.

Elevated Lifter End or Elevated Punch End=as shown in FIGS. 29, 30, 40-A through 40-F, 41-A and 41-B, and 49-A through 49-F.

Envelope (of the Domain)=See FIGS. 28-A through 28-D, 29, and 48-C.

Envelope (of the LLEG)=See FIGS. 15-A, 15-B, 25, 26-B and 27-A and 27-B.

Flank=The side wall of the trough, like items 9 and 11, and items 10 and 12, in FIG. 1-C.

Generatrix=As in the Random House Webster's College Dictionary, it is "an element, as a line, that generates a figure. In most of my figures, where I show cross-sectional views of lids and/or containers, it is the line, which when moved along a specific path, usually the center line of the figure, would generate a surface, which has the cross-sectional shape shown in the specific figure.

Groove=Used sometimes as synonymous with Trough

H=Horizontal Force.

HCA=Half Cone Angle, as shown in FIG. 8. In this case, the cone is a "cone, open at top". It also represents the Draft Angle of the cones represented by the surfaces 9 and 11 or the surfaces 10 and 12, in FIG. 1-C HEEL=As in the example shown in FIGS. 26-A and 26-B. It is the point of support of one OverPosed (OP) lid, which is carried and supported by an UnderPosed (UP) lid. The part of the UP lid is usually referred to as the KNEE of the UP lid.

HP=Highest Point, above RP, of any components located on top of the lid panel or dome, as in FIGS. 40-A through 40-F.

HTW=Half Trough Width

HW=Half the Weight, W/2.

IP=Interposed. An example of an IP cup is shown in FIG. 8. It is the second cup from the bottom. It is interposed in the cup beneath it, which I designate as the UP (UnderPosed) cup. This second cup from the bottom is also considered the UP cup for the cup above it, and so on.

KNEE=As in the example shown in FIGS. 26-A and 26-B. It is the point of support of one UnderPosed (UP) lid, which can carry and support an OverPosed (OP) lid. The part of the OP lid is usually referred to as the HEEL of the OP lid.

KNEE CIRCLE DIAMETER=The diameter of an imaginary circle, with its center at the CL of the lid, and passes through the effective point of contact of the KNEE of the trough, where the KNEE is supporting the HEEL above it.

LEG or LLEG=Lower Leg, i.e. the part of the human leg, between the knee and the heel/ankle. It includes the shin bone, tibia, fibula, muscles, etc. Sometimes, referred to as "Leg" of short. Please see FIG. 26-A, where I show a pictorial view of three acrobats making a sort of what is called a human pyramid, and where the top acrobat's heel is supported by the lower acrobat's knee. In FIG. 26-B, I am showing an analogy of that, by having the heel of a trough of a lid, supported by the knee of the trough underneath it. The distance between the trough heel and the trough knee can be referred to as the trough lower leg or simply the trough leg.

Lid Depressions=Sometimes certain depressions are incorporated into the lid body. One such depression is the deep finger well shown in FIGS. 42-A, 42-B, 43-A, 43-B and 44 and 48-A through 48-F. It can also be a depression to act as a caroming trough to lift the tab. Another such depression is the one shown in FIGS. 29 and 30, which is located beneath the punch end of the tab.

Lid Panel or Dome=The part of the lid body, represented by item 1 in FIG. 1-C.

Lid Protrusions=Sometimes certain protrusions are incorporated into the lid body. One such protrusion is the lifting cam shown in FIGS. 28-A through 28-D, 40-A through 40-F, 49-A through 49-D.

LIPH=Lip Height, i.e. Distance of highest point of Open Lip above RP, as in FIGS. 40-A through 40-F.

LP=LowerPosed. Synonymous with UP. An example of an UP cup is shown in FIG. 8. It is the lowest cup in the stack. However, any cup that has another cup above it and inserted in it, would be considered a LP or a UP cup for the one above it.

Morse Taper Condition=When the Cone Angle or the Half Cone Angle of two stackable devices is small, then the two devices can lock together, due to the friction, etc. This is a desirable condition, when attaching a machining tool into a holding device, like a chuck or mandrel. But it is not desirable, if we want to stack lids together, where we need to make sure that we can easily and quickly separate one lid out of the stack to place it on its respective container body.

N=Normal Force, normal acting or supporting force. Usually, the term "N" is used in connection with flat surfaces, while the term "R" is used in connection with curved surfaces. See FIG. 20 description.

Neck=Skirt

OP=OverPosed. An example of an UP cup is shown in FIG. 8. It is the highest cup in the stack. However, any cup that has another cup below it and supporting it, would be considered an OP cup for the one below it.

Open Lip & Seam=When a lid, which starts by having an Open Lip, is joined to a container body, which in turn has a matching/corresponding Open Lip, the two lips are rolled together and create what is called a Seam. Frequently, the material of the two lips is rolled together in a way that creates what is called a double seam.

PAL=Protrusion Above (Open) Lip. i.e. protrusion of HP above open lip, as in FIGS. 40-A through 40-F PAS=Protrusion Above Seam, i.e. protrusion of HP above open lip, as could have happened in FIGS. 40-A through 40-F, if the tab lifter tip were bent higher, or if the protruding cam were higher, than they are shown in the figure.

Pull Tab or simply Tab=Many of the container lids incorporate a tab, which is used to open the container and to access its contents. The tab usually is held in place by a rivet like approach. The tab comprises a lifter end and a punch end. Sometimes the lifter end and/or the punch end, shown in my patent applications, are not in line with the tab body, but they can be either shaped upwards or downwards.

R=Radial force, radial acting or supporting force. Usually, the term "N" is used in connection with flat surfaces, while the term "R" is used in connection with curved surfaces. See FIG. 20 description.

RP=Reference Point, as shown in the lid or can cross-sectional view, as in FIGS. 40-A through 40-F SH=(Vertical) Stacking Height between any two dishes, cups, lids or similar objects, that are stacked one on top of the other, as shown in FIGS. 8, 15-A, 15-B, 26-A and 26-B, 31-A through 31-C, 41-A and 41-B, 43-A and 43-B, 44, 49-A through 49-F.

SKIRT=See FIGS. 24-A and 24-B, 33-A through 33-C, 34, 48-D through 48-F, 49-D and 49-E and 49-F. I refer to it sometimes as the "Additional Neck". It is a portion of the lid of an UP lid, where the skirt extends outwards and upwards beyond the trough, and surrounds the sides of the trough of an OP lid, but with a specific clearance between the skirt's walls and the walls of the OP trough.

Figure 11:
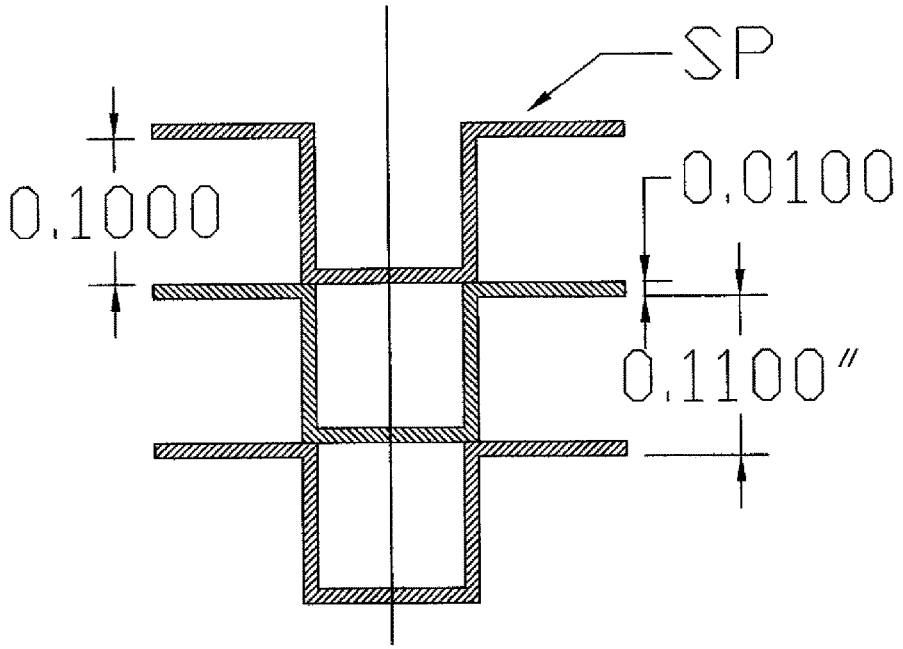

SMH=Seam Height, i.e. Distance of highest point of closed seam above RP, as in FIGS. 40-A through 40-F SP=SuperPosed. An example of a SP cup is shown in FIG. 11. It can not be inserted into a similar cup, because the outside diameter OD of the SP cup is larger than the inside diameter of any similar cup that would be placed underneath this SP one.

T=Tangential force, tangential acting or supporting force. Usually, it is the force that is related to "Friction".

TC=Truncated Cone. See Cone.

TH=Thickness the material of any two dishes, cups, lids or similar objects stacked one on top of the other, as shown in FIG. 8, assuming in this case, that the material of the stacked objects has a uniform thickness.

TR=Trough or Stacking Trough.

Figure 45:
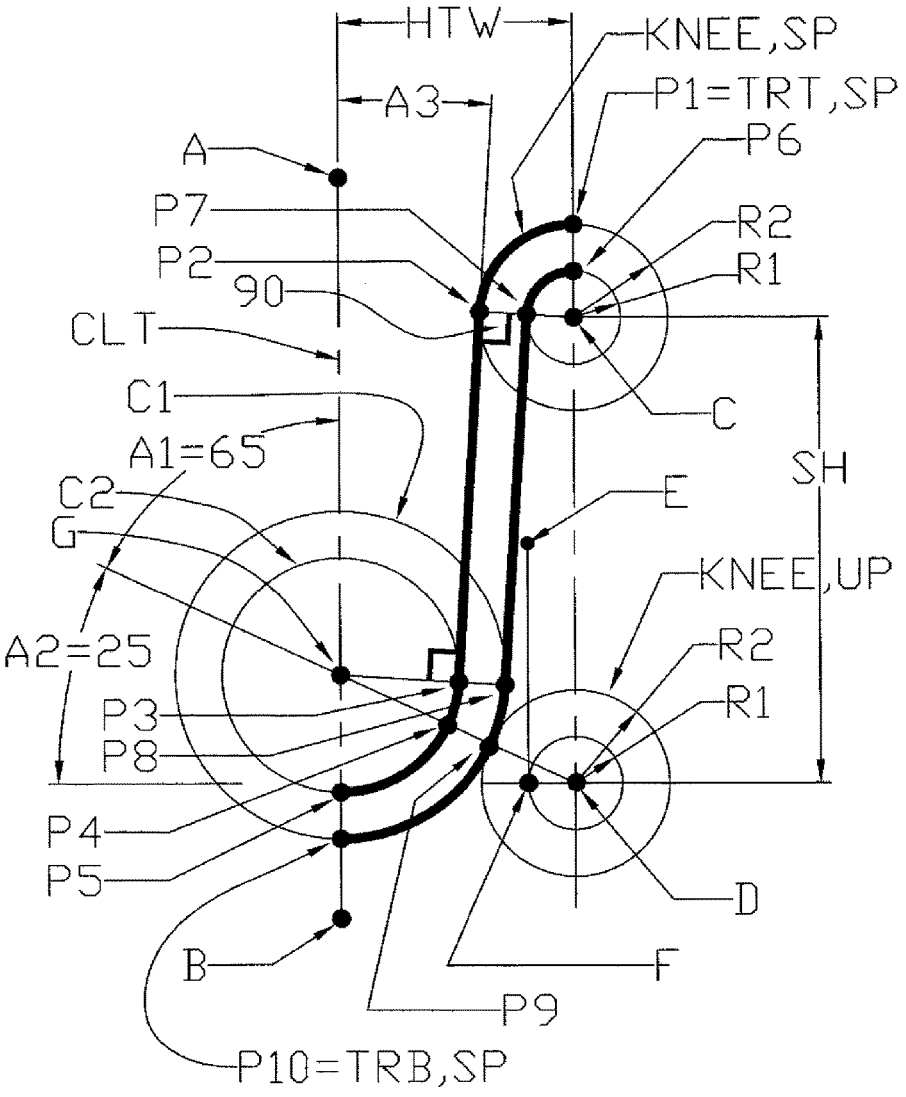
FIGS. 45, 46 and 47 show one way to design the trough as per this invention.

TRB=Trough bottom, i.e. lowest point at the bottom of the trough, as shown by point 13 in FIG. 1-C, and by point P10 in FIG. 45.

TRB,SP=Trough bottom, of the upper Superposed (SP) lid, supported by another lid underneath it, as shown by point P10 in FIG. 45.

TRD=Trough Depth, i.e. Distance of lowest point of Trough (TRB) below RP, as in FIGS. 40-A through 40-F. Another TRD is the distance between the lowest point of the Trough and its Bell Mouth. Sometimes, I refer to it as the Trough Length or as the Groove Death.

Figure 38:
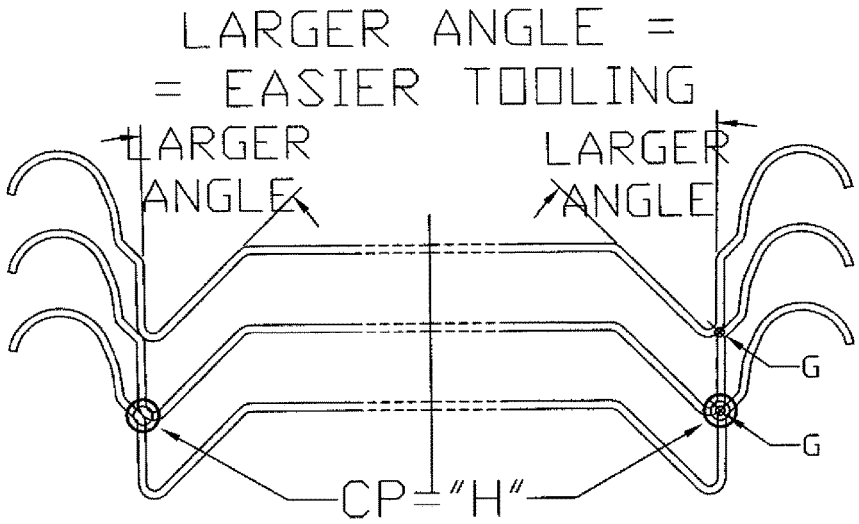

TRH=Trough heel, or simply heel, as item 7 in FIG. 1-C, or more pronounced as in FIG. 38.

Figure 32:
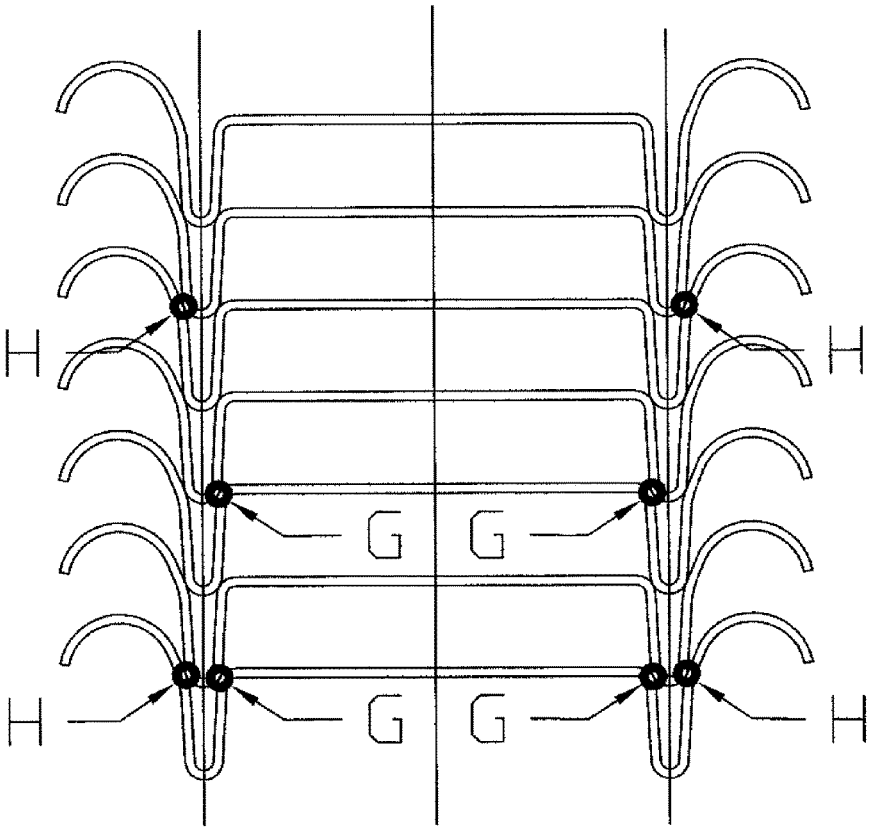
FIG. 32 highlights the possible points where we can have contact between the stacked lids.

TRHI=Trough heel, inside, as item 7 in FIG. 1-C, or more pronounced as in FIG. 32, item "G", and in FIGS. 37-A, 37-B and 37-C, item "G".

TRHO=Trough heel, outside, as item 8 in FIG. 1-C, or more pronounced as in FIG. 32, item "H", and in FIGS. 37-A, 37-B and 37-C, item "H".

TRL=Trough mouth Ledge, or what can act as the "Knee", as item 6 in FIG. 1-C, and as Pt.A in FIGS. 37-D, 37-E and 37-F, and as Point CP="H" in FIGS. 38, 39-A and 39-B.

TRLI=Trough mouth Ledge, Inside, as item 6 in FIG. 1-C and as Point CP="G" in FIGS. 37-A, 37-B and 37-C.

TRLO=Trough mouth Ledge, Outside, as item 5 in FIG. 1-C, and as Pt.A in FIGS. 37-D, 37-E and 37-F, and as Point CP="H" in FIGS. 38, 39-A and 39-B.

Trough Bell Mouth=It is the upper opening of the trough, which comprises the KNEE or the portion of the trough that can carry a Superposed (SP) lid's part on top of it.

TRT=Trough Top, as represented by point TRT, SP in FIG. 45. However, the trough may have a second neck beyond, i.e. higher than this TRT, as shown in FIGS. 37-A through 37-F, but that would be not considered as a part of the trough under consideration.

UP=UnderPosed. An example of an UP cup is shown in FIG. 8. It is the lowest cup in the stack. However, any cup that has another cup above it and inserted in it, would be considered an UP cup for the one above it. Sometimes, I use the abbreviation "LowerPosed (LP)" as a synonymous word.

V=Vertical force, vertical acting or supporting force.

VS=Vertical Spacing between any two dishes, cups, lids or similar objects stacked one on top of the other, as shown in FIG. 8. If the material thickness TH is uniform, then VS=SH−TH.

wrt=with respect to.

DESCRIPTION OF THE DRAWING AND THE PREFERRED EMBODIMENTS

Technical Review of Stacking Geometry

FIGS. 1-A, 1-B, and 1-C show the Prior Art lids and the way they are or could be stacked. The lids are shown with the typical shape of the lids presently on the market. The points where potential contact can occur are shown, and referred to as A, B, C etc. in FIGS. 1-A and 1-B. FIG. 1-C shows the items that correlate with the entries under Abbreviations and Definitions.

Figure 2:
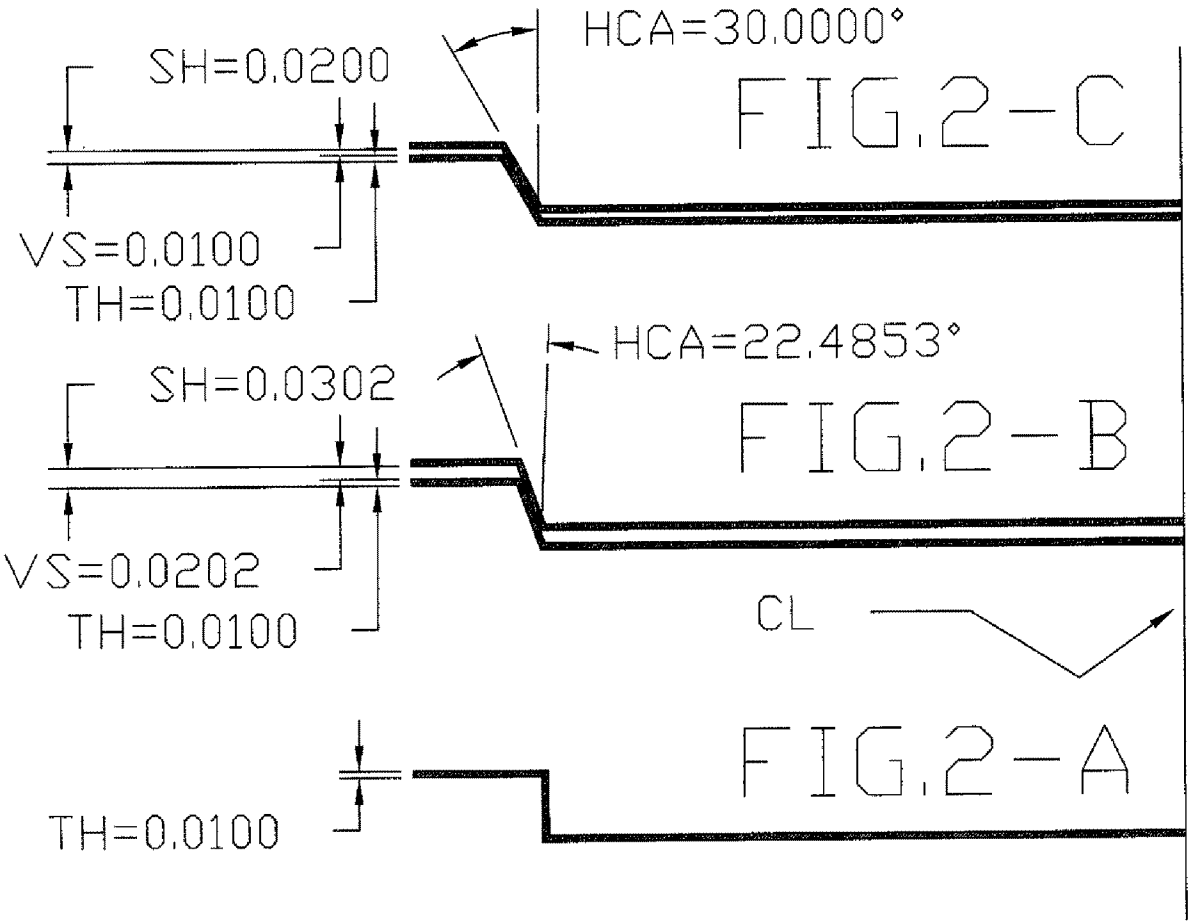
FIG. 2 shows how simple dishes could stack, if their upright portions are shaped at different angles.

FIG. 2 shows a simplified way to look at "STACKING". The shapes represent an example of stacking "plates" or "dishes" in a kitchen cupboard, for example. The shapes are only the LHS portions of the dishes, the RHS being a mirror image about the center line (CL) of the dishes.

The top pair of dishes, in FIG. 2-C, is supposed to have the "sloped" portion of the body, which I will refer to as the truncated cone, TC, see FIG. 8, shaped to have a taper HCA of 30 degrees. With this taper angle, we can get a vertical Stacking Height (SH) between the dishes of 0.020", for the shown "thickness" TH, which is 0.010 inch, of this pair of dishes. The Vertical Separation (VS) is only 0.010 inch. {VS=SH−TH}.

The middle pair of dishes, in FIG. 2-B, has a taper HCA of 22.4853 degrees, and the vertical "stacking" height SH is shown to be 0.0302 inch assuming that the "THICKNESS" of the dishes is similar to the thickness of the top pair of dishes.

The bottom pair of dishes, in FIG. 2-A, shows that their taper angle is ZERO. But if the dishes have the same size, then in this case, they cannot be stacked as desired, i.e. one dish would not be able to be inserted inside the other. FIGS. 3 through 11 show a study, to see how the taper angle and the thickness of the dishes affect the stacking height SH and vertical separation (VS).

The taper angle is usually measured from the vertical axis, assuming that the tapered surfaces of the dishes are part of a cone, or rather a truncated cone, with its axis being vertical, i.e. perpendicular to the general surface of the plate or dish, or lid for that matter and assuming that the dish main body is sitting on a horizontal surface. FIGS. 3 through 11 show a progression of shapes, changing the HCA from 90 degrees through Zero degrees, in steps of 15 degrees at a time. All the dimensions are based on the assumption that the thickness of the dishes, or rather cups in these figures, are made of a material that has a uniform thickness (T) of 0.010 inch.

FIG. 8 shows the location of the terms used throughout these FIGS. 3 through 11, and as correlated with the section on Abbreviations and Definitions in this specification. It shows the Stacking Heights (SH), the Vertical Separation (VS), the Thickness (T or TH), Truncated Cone (TC), and the Half Cone Angle (HCA), which is referred to also as the Draft Angle.

Now for the new ones. I will refer to the top dish as the OverPosed (OP) dish. The dish that is all the way at the bottom, as the Underposed (UP) dish. Any one of the dishes that is inserted into another UP dish will be referred to as an InterPosed (IP) dish. By this nomenclature, some dishes can have more than one referral names. For example, the second dish from the bottom, the one above the lowest UP dish, can be considered to be an OP dish wrt to the dish below it. It can also be considered an UP dish wrt to the dish above it.

Anyway, the whole idea is to try to make it clear, which dish we would be talking about, when we describe the various figures in this application.

Figure 3:
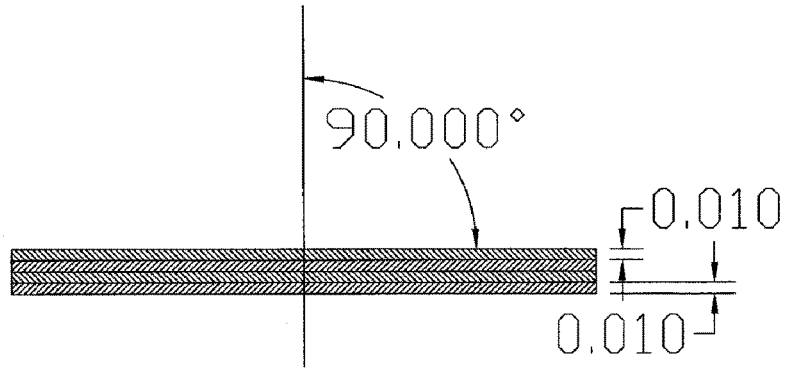
FIGS. 3 through 11 expand on the idea shown in FIG. 2. They show a progression of shapes, changing the HCA from 90 degrees through Zero degrees, in steps of 15 degrees at a time.
Figure 4:
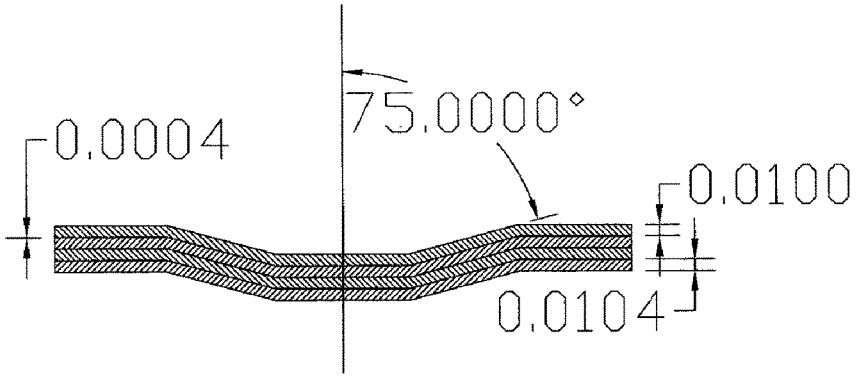
Figure 5:
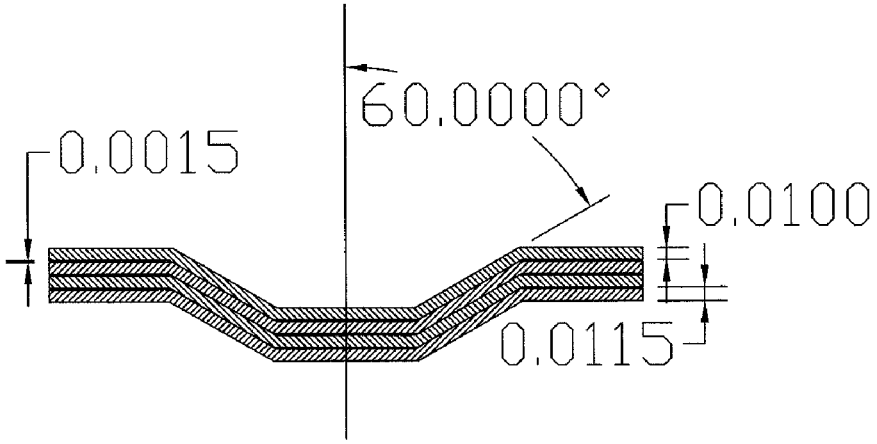
Figure 6:
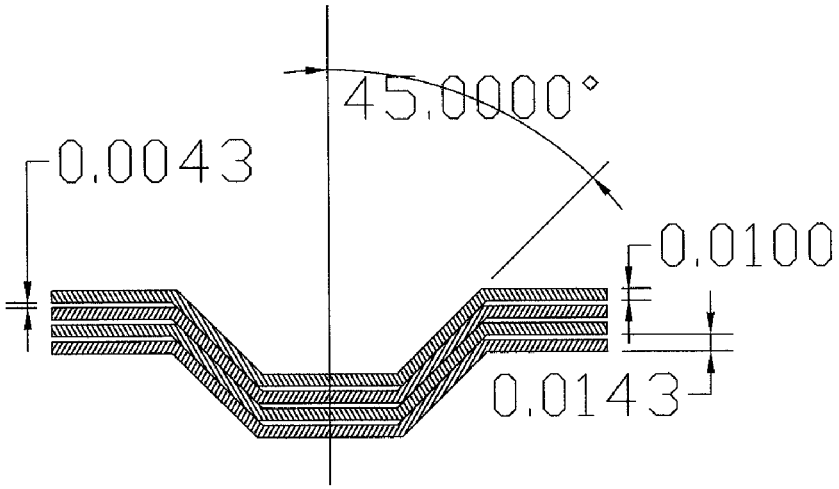
Figure 7:
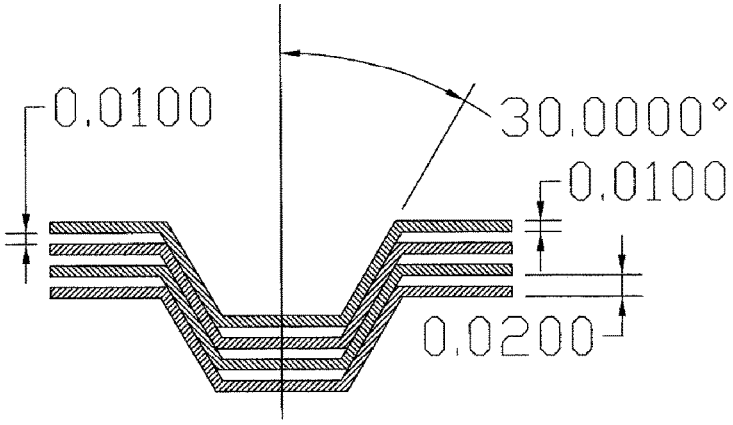

FIG. 3 shows the special or extreme case of a taper angle of 90°, i.e. when the dishes are totally flat or rather like a simple flat sheet of the material. The Vertical Separation VS is ZERO, and the Stacking Height SH is equal to the thickness of the dishes. So we can say that in this case, there will be NO GAIN in the stacking distance between one dish and the next one.

FIGS. 4 through 10 show that when the taper angle is reduced, from 90° to 75°, to 60°, and so on, the dishes start to be separated one from each other, or raised and elevated one above the other, i.e. the top dish i.e. the OverPosed OP dish, from the one below it, i.e. the UnderPosed UP dish, by an increasing/larger distance respectively.

The smaller the taper angle, the larger the separation between the dishes, I will refer to this separation in two different ways. One way, as the "stacking" distance or the "stacking height" SH. The other way as the Vertical Separation [VS] [DEFINITION]. If the material thickness of the dishes is uniform and is equal to "T", then we can say that VS=SH−T.

We can see that when the taper angle is ZERO, as in FIG. 11, which is the other special or extreme case, the dishes can NOT be inserted one inside the other. I will refer to such a case as the dishes are sitting one on top of the other, or for short as "superimposed" or "SUPERPOSED" (SP) [DEFINITION]. In a way, this is theoretically the opposite of the case shown in FIG. 3, but has a similar end effect.

But in the cases of FIG. 4 thru FIG. 10, the dishes are such that one dish can be "inserted" inside the other. So, I will refer to such cases as the dishes being "interposed" "INTERPOSED" [DEFINITION].

Figure 12:
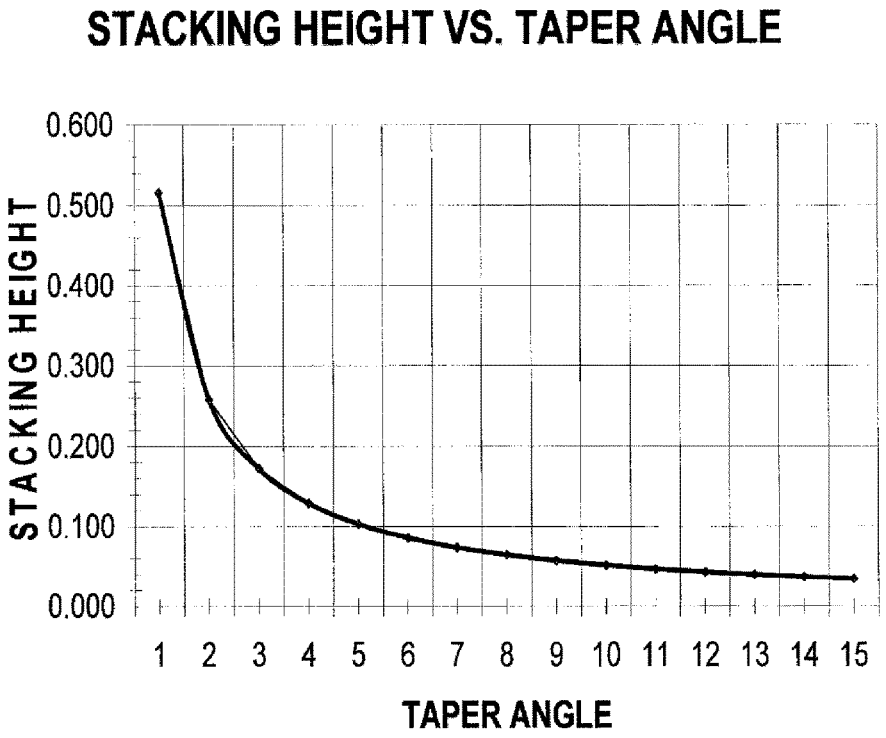
FIG. 12 shows a graph or a chart, which shows the relation between the Half Cone Angle (HCA) or the Taper Angle, and the Stacking Height, for the dishes shown in FIGS. 3 through 11.

FIG. 12 illustrates the relations between the stacking height SH and the Vertical Separation VS and the taper angle, for a material thickness of 0.009 inch. The chart's horizontal axis shows the taper angles, and the vertical axis shows the stacking heights. The taper angle in this case is equivalent to the HCA. Here, the horizontal axis does not show the actual values of the angles in degrees.

We can see that for large taper angles the stacking heights are relatively small, and conversely, for small taper angles, the stacking heights increase rapidly/geometrically with each decreasing angle.

For larger material thicknesses, the stacking heights will be proportionally larger. But in our case, where it is desirable to keep at a minimum the thickness of most of the materials used for food and beverage containers, we do not have much room to maneuver.

So this would lead us to try to use a very small taper angle HCA, in order to achieve a large, very large, stacking height SH and the Vertical Separation if this is our goal.

I will explain later below why we need larger stacking heights.

However, there is a problem.

If the taper angle is relatively small, then the lids (or dishes) would "lock" together.

An example of such locking angle and feature and application is the "MORSE" taper, which is used in machine tools.

Many Machinery and Mechanical Engineering Handbooks describe the Morse Taper and show tables with the dimensions and angles of such Morse Tapers, including for example the Morse tapers by Brown and Sharp. The tables show that these tapers angles range from a min of 2.39° up to a max of 4.68° from Center HCA. With such tapers, any 2 bodies interposed one into the other can "lock" so strongly, that it would be pretty difficult to pull them apart or to rotate one of them with respect to the other.

This is not good for the pull tab lids.

The lids in the sleeves/tubes/bags/magazines/etc. should be easy to separate from each other, so that the seamer can operate at high speeds. If the lids "stick" together, then they would not "feed" easily and then the machine would jam and stop and an operator would need to go to the machine, clear the "jam" and restart the machine. This would mean human intervention and loss of productivity.

So it is imperative to select a "friendly" taper angle, which would prevent "locking and sticking" of the lids and would prevent "jamming" the machines.

FIG. 12 also indicates that the manufacturing tolerances of the taper angle, when the taper angle is small, can have a more drastic effect on the Stacking Height, than in the case of where the taper angle is much smaller.

FIG. 13 shows five sub-figures of prior art lids and of simplified ones. FIG. 13-A shows a typical shape of the lids presently on the market, pretty similar to the one shown in FIG. 1-A, with the tab being flat and pretty snug against the dome of the lid panel. FIG. 13-B shows one of the lids, from my Patent PT1, where the tab has a raised lifter tip and a raised punch tip. FIG. 13-C shows another lid from my PT1 patent, where the lid has a cam protruding above the level of the dome of the lid panel. FIG. 13-C shows a simplified lid, where the lid panel is shown to be flat for simplicity, and where the lid's lips are shown open and flaring outwards and upwards away from the trough. FIG. 13-E shows another lid, with a vet more simplified looks, highlighting the troughs only and showing the lips as just short flat stubs. Again for more simplicity, while studying the troughs.

FIG. 14 shows a study of the troughs and the shape of certain parts of the troughs. It highlights the fact that the stacking height is not influenced by the shapes of the trough's width, or the shape of the top edges or bottom edges. It points to the fact that the stacking height is controlled by the HCA only. This is assuming that the thickness of the trough material is uniform. Here in this figure. I chose the same HCA and the same thickness (T) to be exactly as those used in FIG. 8, and sure enough the Stacking Height (SH) turned out to be 0.0386 inch for the uniform thickness (T) of 0.010 inch. This is exactly the same Stacking Height (SH) as in FIG. 8 and as in FIGS. 14-A, 14-B, 14-C and 14-D. As expected, of course.

FIGS. 15-A and 15-B introduce one of my new proposed approaches, as per present invention. It moves from stacking the troughs on their flanks, as in the previous figures, to stacking them on certain points, within a certain envelope. The envelope is as wide as the material thickness of the lids or of the objects to be stacked. Here again, the stacking height varies as we vary the HCA. The contact forces are concentrated at the contact points and are usually acting in the directions of the normal forces and in a direction of a line reaching between the centers of curvature of the two contacting surfaces, which in this cross sectional view case, look like portions of circles.

Study of the acting forces in the stack system

In order to understand and appreciate why the Morse Taper creates such a locking condition, which as I said is undesirable in the case of our lid stacking situation, I would like to present a study of the forces acting in a system, where two bodies are interposed, such as in our lid stacking situation.

I would first like to talk about gymnastics, like when a gymnast exercises on the rings, which are like a trapeze, but where the horizontal bar of the trapeze is replaced by two rings, each one suspended from an individual rope. Then I would go to a more mechanical system, where a mandrel is inserted on to and into a cup. I will analyze the forces acting on the individual system's parts and the effects of these forces on the respective parts.

Discussion Point #1

Figure 16:
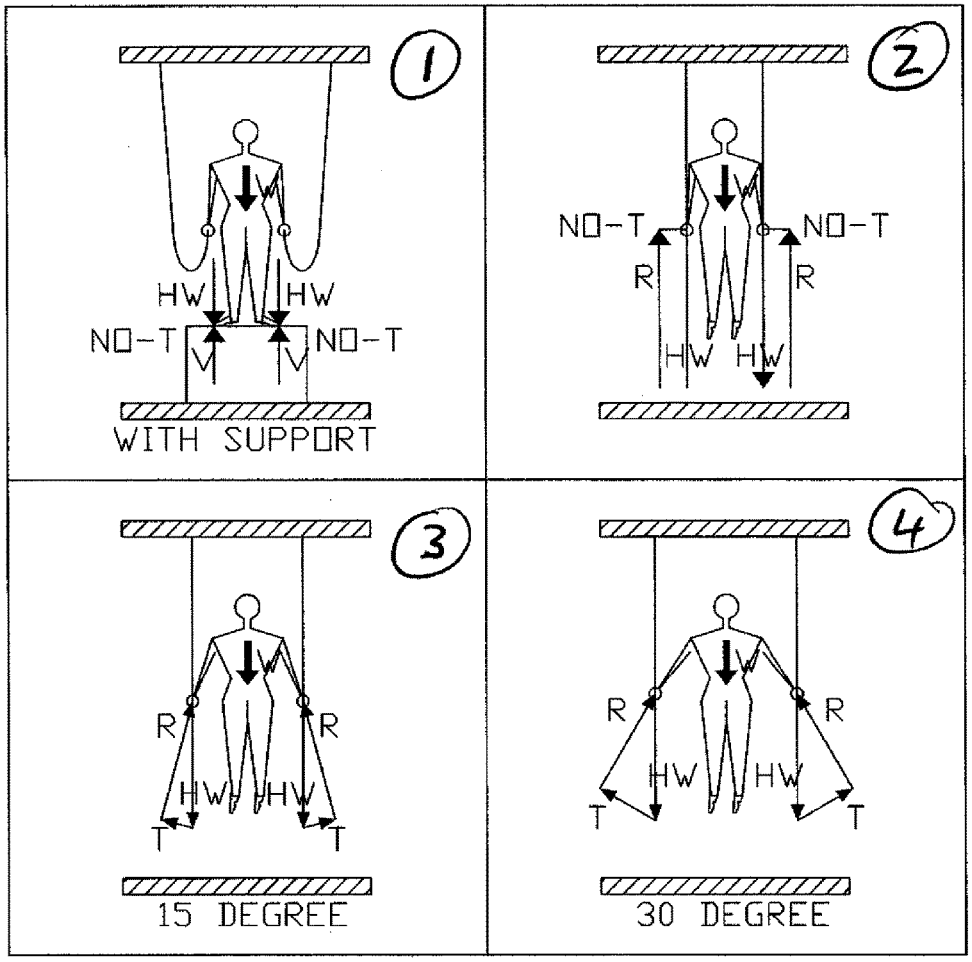
FIGS. 16 through 20 show some analogies and similar situations as in the case of our lids stacking.
Figure 17:
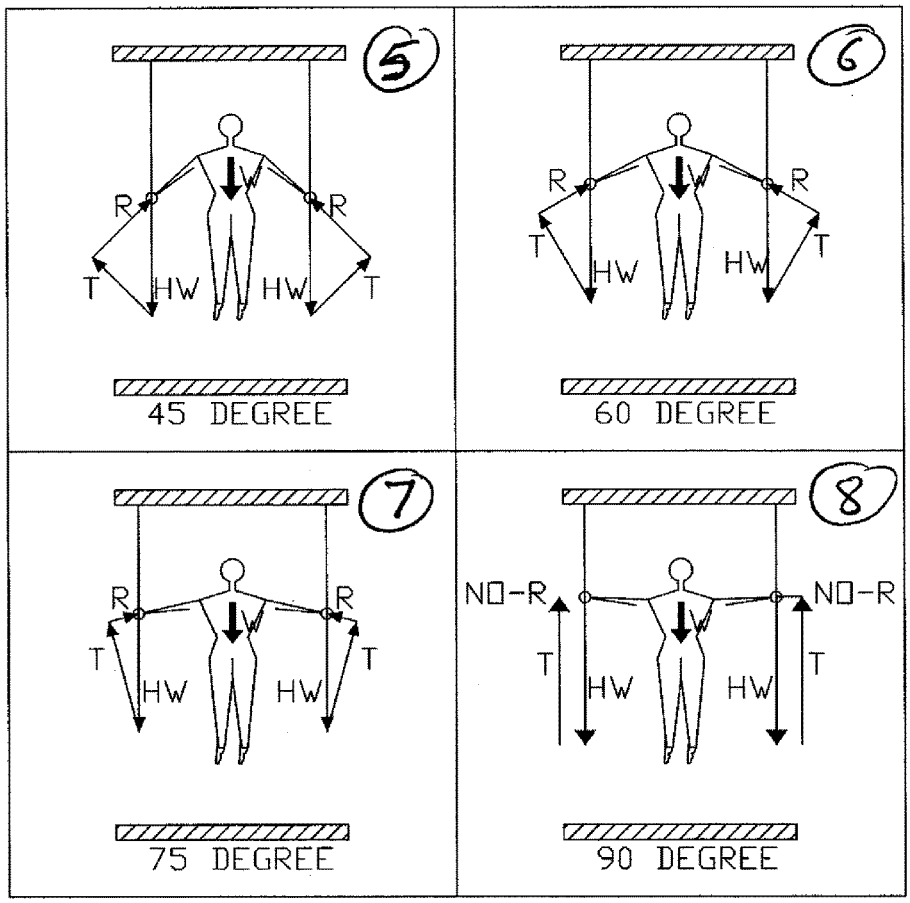
Figure 18:
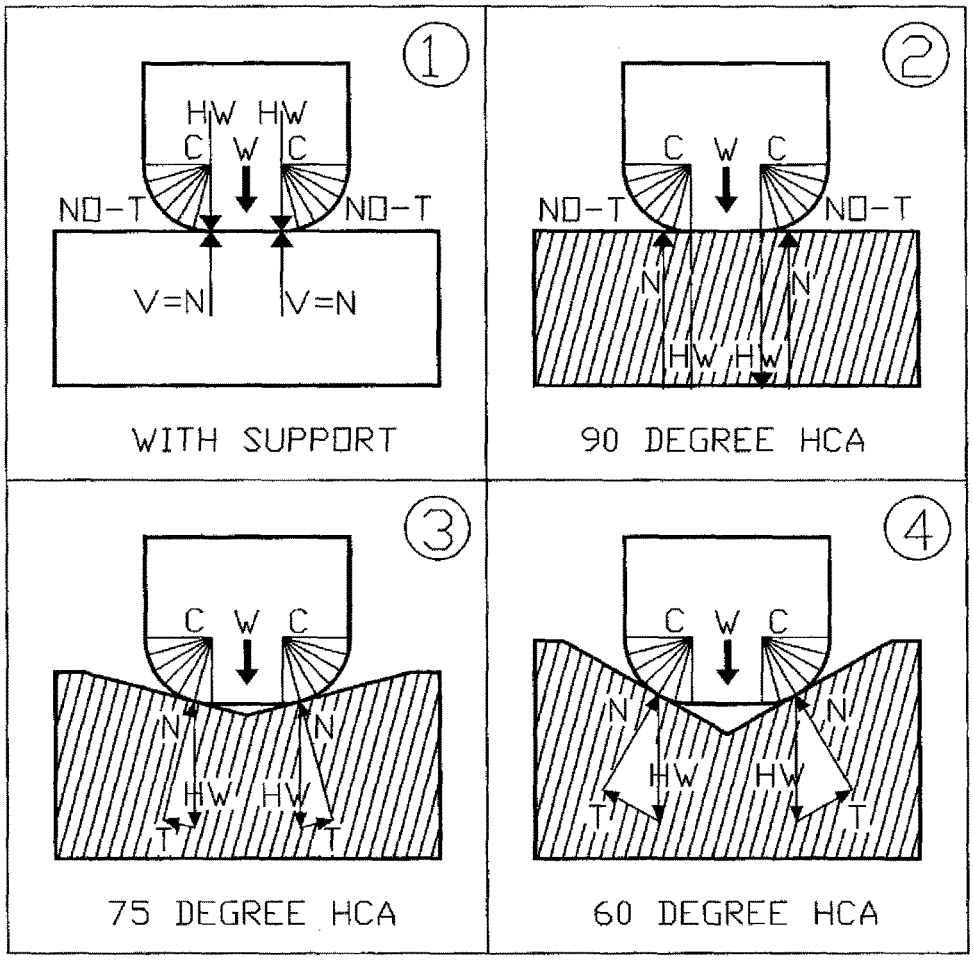
Figure 19:
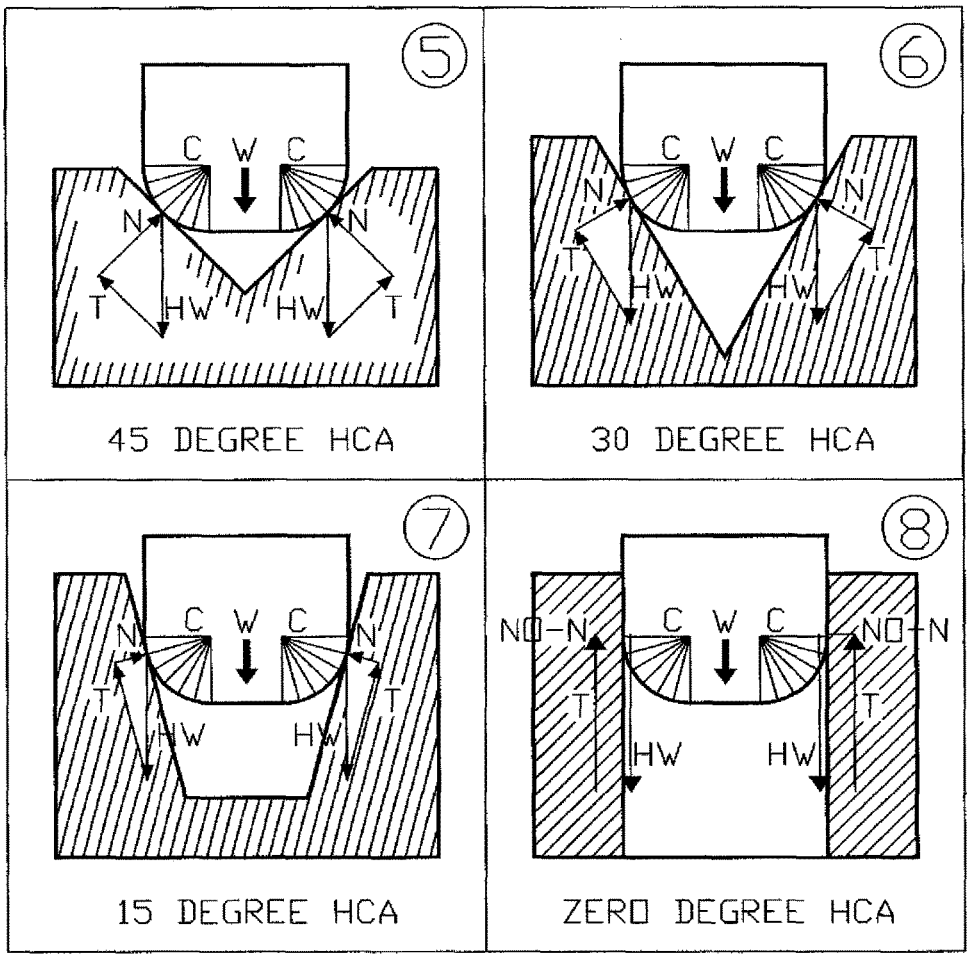
Figure 20:
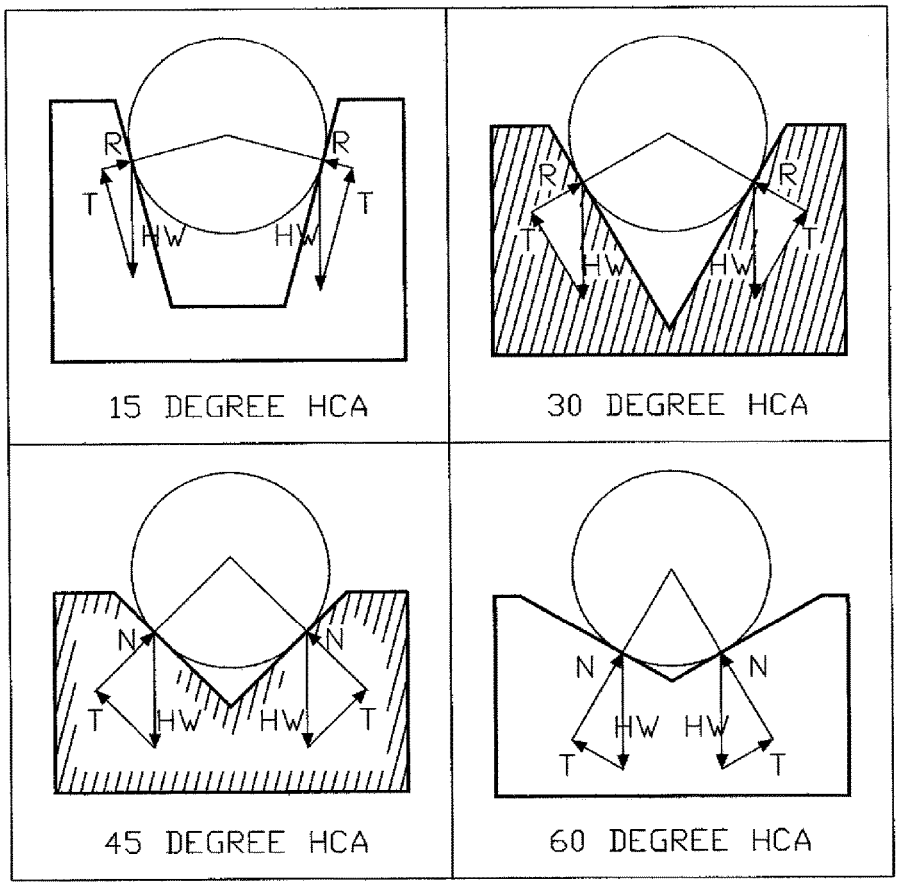

FIGS. 16 through 20 show some analogies and similar situations as in the case of our lids stacking. FIGS. 16 and 17 show an athlete working on the rings. They show the athlete at various positions and how the forces acting on his hands and arms and shoulders are counteracting his body weight. FIGS. 18 and 19 shows a more mechanical version of the analogies, to illustrate the forces acting on components that start to look more like the components of a lid and the troughs. FIG. 20 shows another set of analogies, which again come closer to the components of the lid and the troughs.

First, the gymnast on the rings. FIGS. 16 and 17 show some different positions that the gymnast can take. FIG. 16, view 1 shows the gymnast standing on a pedestal, which is supporting his total weight W. The ropes are slack and do not carry any weight and are not under tension.

FIGS. 16 and 17, i.e. FIGS. 16, view 1 through 16, view 4 and 17, view 5 through 17, view 8, show the gymnast off the pedestal and in different position of his arms. We will assume that his arms will stay straight, between his respective shoulders and hands. Each arm will move, with its respective shoulder as the pivot point, and the respective hands will swing up along a circle, with the shoulders as the center of that circle. The arms will start from a vertical down position, where the angle between each of the two arms and the body will be zero degrees, as in FIG. 16, view 2 then the arms will spread open gradually, increasing the angle between each individual arm and the body. For example, in FIG. 16, view 3 the angle is 15, in FIG. 16, view 4 the angle is 30, and so on, until the arms become horizontal, i.e. the angle will be 90, in FIG. 17, view 8.

The acting forces will be referred to as follows: the force acting in the direction from the hand towards the shoulder will be called the radial force and will be referred to as "R". This is because in the figures, each arm, rather each hand, will be making a circle, with the respective shoulder being the center of the circle. At every position of the hand, the arm will be in a radial direction.

So, if we have a force acting at the individual hand, such a force can be represented vectorially by two orthogonal components, one component in a radial direction, i.e. in the respective direction from the hand to the shoulder, and would be referred to as the radial component, "R", and the second component, which would be perpendicular to the radial component, would be referred to as the tangential component, "T", because this direction will be in the direction of a tangent to the circle, drawn at the respective point of the hand along the circle of the hand motion. So by looking at the FIGS. 16 and 17, we can see the R component and the T component change in magnitude and direction, depending on the angle of the arm with respect to the body, at each angle in each respective figure. Let's analyze a few of these figures.

FIG. 16, view 2 shows the angle between each of the arms and the body being zero. The weight "W" of the gymnast will be assumed to be equally distributed on both hands/arms. Half of weight, "HW", (=W/2), will be carried by each of the two ropes at each hand. The force R acting at the hand will be transferred through the arm to the shoulder in a vertical direction and will be equal to HW. So, R=HW (W/2). In this position, there is no T, no tangential force acting on the hand or shoulder. R in this case is felt by the gymnast as a compressive force, acting in the direction from the hand towards the shoulder.

Let's jump and go to FIG. 16, view 4. FIG. 16, view 4 shows the angle between each individual arm and the body is 30 degrees. Here, HW is counteracted and balanced out by the two components, N and T as shown. N is smaller than HW, but now we do have a T, that has a definite value. Of course, it is larger than zero, which was its value in FIG. 16, view 2. This means that the R component, acting on the hand is still a compressive force, but is smaller in value than HW. It is still acting in the direction from the hand to the shoulder, but is at 30 degrees with respect to the body. Bear in mind that the values of R and T in this case are obtained by the triangle representing the forces vectorially, where the vertical component is HW. Using the same scale which is representing HW in this triangle, we can calculate the exact value of R and T in this case. The same method and approach will apply in any other position. Now let's look at T in the FIG. 16, view 3 case. T is a force, which is always acting at 90 degrees with respect to R. In this case, it is acting at 60 degrees with respect to (wrt) the body. It is trying to push the gymnast hand away from his body. He has to exert a new force to counteract this T. He has to utilize his pectoral or deltoid or whichever appropriate muscles, to keep his arms in this position, otherwise his arms will spread open and he will fall down. We can start here to talk about "moments" etc., but no need to get too technical or scientific, more than we need to.

When we look at the next figures, the situation will become worst for the gymnast. For example, when the angle increases from 30 as in FIG. 16, view 3 to say 60 as in FIG. 17, view 6, we see that R has become much smaller, but T has become much larger. The gymnast must be in good physical shape to maintain such a position hanging from the rings.

And when we get to FIG. 17, view 8, which I believe is called the cross position, the gymnast must be a super athlete to maintain such a position for any length of time. In this case, R is perfectly zero and T is exactly HW, i.e. half of the gymnast weight.

Discussion Point #2

Let's keep all these above details in mind, and now let's go to the next set of figures, FIGS. 18 and 19, which show something more mechanical, closer to our lid stacking situation.

FIGS. 18 and 19 show a mandrel being inserted into a cup or sleeve, as shown. They show the angle of the cup changing from zero to 30 to 60 etc, all the way 90. The angles here are measured from the vertical center/axis of the cone to the generatrix line representing the edge surface of the cone in the various shown cross sectional views. I refer to these angles as Half Cone Angle "HCA".

Comparing the individual FIGS. 18 and 19 to those in FIGS. 16 and 17, we can see a lot of similarities. First of all, we must bear in mind that the HCA and the Arms angles are complementary, which means that they always add up to a total of 90 degrees. This is a trigonometry and engineering term. So, when we show the HCA to be 60 degrees in FIG. 18, view 4, its effects will be similar to the arms angle of 30 degrees in FIG. 16, view 4. I will take this FIG. 18, view 4 as a representative example.

FIG. 18, view 4 shows the Half Cone Angle to be 60 degrees. The mandrel is a cylinder with a filleted tip, as shown. The effect is as if we have a portion of a ball or a sphere contacting the cone. The fact that the top part of the mandrel is cylindrical has no bearing or effect on the nature of the contacts at the contact points themselves, or on the contact forces between the tip of the mandrel and the cone. Again, the fact that the bottom of the mandrel is flat has no bearing or effect either.

The mandrel is resting inside the cone. The cross sectional view shows two points of contact between the mandrel and the cone surfaces. In reality, the contact between these two bodies is along a circle, but we are seeing only the two points of that circle, where the cross section plane is intersecting that contact circle. At each one of these two contact points there are some forces that we will analyze now. Let's take the left hand side contact point. We will assume that the weight W of the mandrel will be equally distributed along the contact circle, and for simplicity, we will assume that the two contact points shown will carry the whole weight of the mandrel. So, we will have Half the Weight (HW) at each contact point. So, at the left contact point, the cone will be carrying Half the Weight (HW) of the mandrel, HW. This force will have to be acting vertically upwards to counteract and to balance out the Half Weight of the mandrel, which is acting vertically downwards. This HW force is broken down vectorially into its two orthogonal components, N and T. N is the Normal force component acting from the cone on the mandrel at the contact point. It is represented by the arrow pointing in the direction from the contact point towards the center of curvature of the mandrel surface at this contact point. T is the Tangential force component, and it is always perpendicular to N at that contact point or at any respective contact point.

In this FIG. 18, view 4, I have selected the HCA to be 60. Its complementary angle is 30 degrees. If we look at and compare this with FIG. 16, view 4, we see that the arms angle is 30. So, the effects of the forces in both figures are very similar. The only difference is in the nomenclature. I used N for normal forces in FIGS. 18 and 19, and used R for the similar forces in FIGS. 16 and 17. Their effects are similar.

In FIG. 18, view 4, we see that N is pointing upwards against the mandrel at 30 degrees wrt the vertical axis, and in FIG. 16, view 4, we see that N is very similar. Of course, if the weight of the mandrel is equal to the weight of the gymnast, then the N force components in both cases will be exactly identical.

Now let's look at Tin FIG. 18, view 4. T will be acting in the direction shown, but at the point of contact. It will be acting upwards at an angle of 60 degrees to the vertical axis. The effect of T is to provide a frictional force to prevent the mandrel from sliding downwards. Here of course the forces are balancing themselves all around the contact circle and are preventing the mandrel from sliding down. The same is happening with the gymnast, where both R and T at each side are balancing themselves out and the gymnast is not falling down or toppling sideways. Now let's proceed and review the rest of the FIGS. 18 and 19.

When we go to FIG. 19, view 6, we can see that N has become much smaller and T has become much larger. Still the T forces and the N forces on all sides are balanced out.

When we go to FIG. 19, view 8, we see a different situation. The HCA is 90. This means that the cone has been now transformed into a tubular sleeve or a cylindrical sleeve or a hollow cylinder, with uniform ID. Here the forces diagrams show that the N is totally horizontal and has a value of zero. The only real forces that can still support the mandrel from falling down through the cylinder are the T, the tangential forces, which we know are the frictional forces. Now, we have to rely on the friction characteristics of the surfaces of the cone/cylindrical sleeve and of the mandrel. If these frictional forces are sufficient to counteract the weight of the mandrel; OK, but otherwise the mandrel will slide downwards and fall off.

FIG. 20 shows the interaction between a sphere/ball and a cone or wedge at different Cone/wedge angles. Again, pretty similar to the gymnast and to the mandrel and cup. Here, I showed that R and N are interchangeable, which in reality they are. To be very correct about it, it would depend on the point from where you are looking at it. If you are looking at it from the side of the round surface of the cone, then R would be a better term. If you are looking at it from the flat surface of the cone, then N would be a better term. Discussion Point #3, the Morse Taper Locking or the Morse Taper Effect.

Now, let's go back to FIG. 19, view 7. The HCA here is 15 degrees. The T force was less than the T in FIG. 19, view 8, but it is pretty large, larger than in FIG. 19, view 6. The point is that as the HCA gets smaller and smaller, the T force gets larger and larger. This leads us to the Morse Taper situation. With the Morse taper, the angle is so small, that the T forces, the frictional forces, do get pretty large and that is why the parts, i.e. the mandrel and the cone, lock together. This is the very important point that I would like to keep in mind for the following discussions.

FIGS. 21-A through 27-B show several studies to find the good shapes and the best shapes of the lid troughs which would satisfy the requirements and objectives of this application.

Various Possible Ways to Interface and Contact the Trough Surfaces

FIG. 21-A through 21-D show a number of possible configurations and shapes as to how the troughs could interface and interact with each other:

1. Cone on top to Cone at the bottom, or flat line edge on flat line edge, as in the cross sectional view in FIG. 21-D.
2. Cone on top to donut at the bottom, or flat line edge on round edge, as in the cross sectional view in FIG. 21-C.
3. Ball on top to cone at the bottom, or a round edge on flat line edge, as in the cross sectional view in FIG. 21-B.
4. Ball on top to donut at the bottom, or a round edge on round edge, as in the cross sectional view in FIG. 21-A.

In all the sub-figures of FIGS. 21-A through 21-D, except in FIG. 21-D, the acting forces are concentrated at the one contact point, where the surfaces, in the cross sectional views, have a round curve. By contrast, in FIG. 21-D, where the contact is spread over a line, in the cross sectional view, which in reality is a flat surface, a portion of the Truncated Cone, then the forces will be distributed over the mutual contact area. The smaller, narrower contact area will control the so-called mutual contact area.

Figure 22:
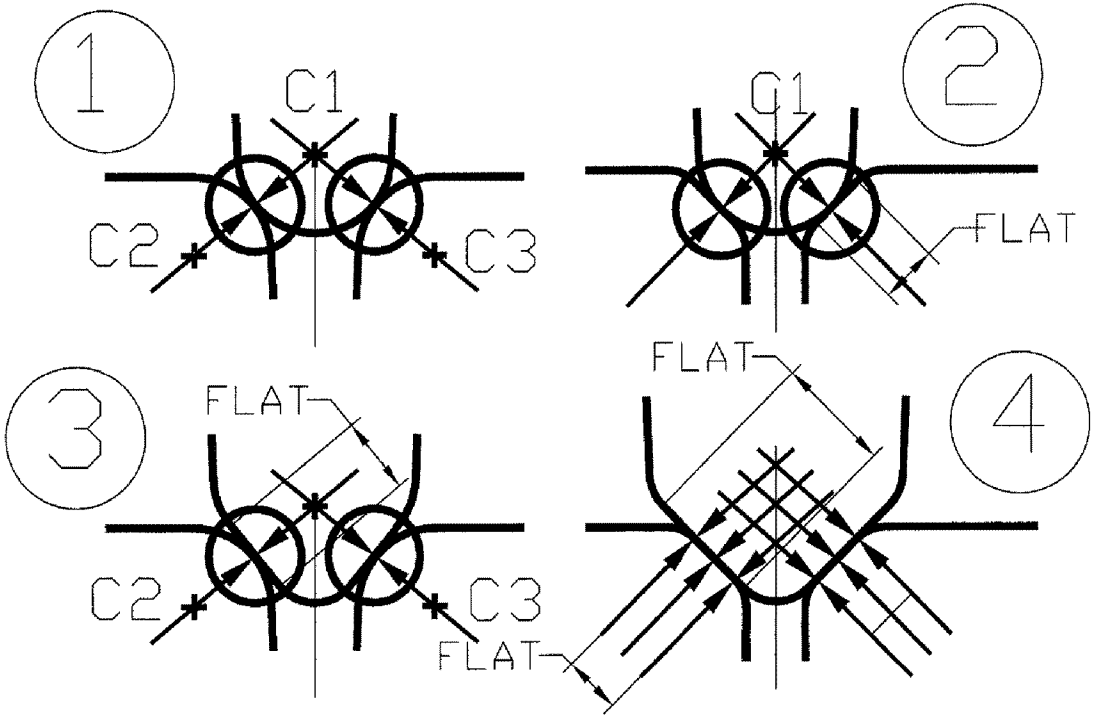

FIG. 22 just shows enlarged views of the corresponding portions shown in FIGS. 21-A through 21-D.

All the above, in either of the following ways:

1. on the outside edge of the trough flanks or walls
2. on the inside edge of the trough flanks or walls
3. on both edges of the trough flanks or walls In the case of Cone to Cone interface, in either of the following ways:

1. the straight contact edge line of the top cone equal in length to the straight contact edge line of the bottom cone
2. the straight contact edge line of the top cone is shorter than the straight contact edge line of the bottom cone 3. the straight contact edge line of the top cone is longer than the straight contact edge line of the bottom cone In the case of any Cone contact/interface, in either of the following ways:

1. the straight contact edge line of the cone has a large HCA, e.g. 45 degrees or larger,
2. The straight contact edge line of the cone has a small HCA, e.g. 45 degrees or smaller.

Requirements for good stacking conditions:

1. Stack should be stable, solid and not "SQUISHY".
2. Material should be thin, ideally 0.009 inch, plus or minus 0.001 inch, for the general food and beverage container industry, as it seems it is at present.
3. Trough shape: Long, to provide a Large Vertical Separation VS, which in turn, requires a large Stacking Height SH.
4. Draft angle of trough or other features should NOT be too small, but rather as large as the design permits
5. Draft angle of trough ideally should NOT be NEGATIVE
6. The whole lid and its design should be easy to manufacture
7. The design should be easy on tooling. The tooling should not wear out fast or break FIGS. 23-A through 23-D expand expands on the concepts covered in FIGS. 18 through 22. Basically, it illustrates the effect of changing the Half Cone Angle (HCA) on the magnitude of the Normal Force (F) and the Tangential Force (T). The lower right figure shows, in a vectorial presentation of the forces, the relation between these forces, actually the force components acting between the round nose cone sitting on the round edge support, at the various HCA. If we visualize that the weight of the cone (W) is one unit (1,000) of force/weight, then the magnitudes of the Normal Force N and the Tangential Force T are shown vectorially to scale by the sides of the respective triangles, shown in this figure. For example, if the HCA is 30 degrees, then T would equal 0.866 times the total weight W of the cone, and at 30 degrees to the cone's vertical axis and the Normal Force N is equal to 0.500 times the total weight W of the cone and at 60 degrees to the cone's vertical axis. The Tangential Force (T) is the one that creates the friction between the cone (SuperPosed "SP" lid) and the supporting member (UnderPosed "UP" lid).

This shows us that it behooves us to have the largest possible Cone Angle or Half Cone Angle (HCA), to reduce the Tangential Force, so as to minimize the frictional forces acting on the cone (SuperPosed "SP" lid) and the support (the Underposed "UP" lid).

FIGS. 24-A and 24-B expands on the concepts covered by FIGS. 18 through 23-D, especially by FIGS. 18 through 20. They introduce the concept of the "support ledge" and the effect of its angle, the "skirt" and the "clearance" between the cone and the "skirt" of the supporting base.

FIG. 24-A shows a cone sitting on a ledge inside a base. The ledge surface is horizontal, i.e. the HCA in this case is 90 degrees. It is similar to the case shown in FIGS. 18, view 1 and 18, view 2. But there is a difference. First of all, we have to realize that the base is an annulus. This ledge carries and supports the flat bottom cone sitting on the ledge. The acting forces are vertical. The weight of the cone is acting downwards, and the opposing forces are Normally Upward (NU). The NU forces are distributed over the total mutual contact surface between the cone and the ledge. Their total magnitude is equal to the total weight of the cone. They are shown in the figure as two smaller arrows just for simplicity.

Second, the base, the UnderPosed (UP) object, is extended upwards, over and beyond the ledge, to create what I would like to refer to as the "SKIRT". Here, the skirt is surrounding the sides of the cone, but with a specific clearance between the skirt's walls and the cone's walls. So, there is no direct contact between the two and consequently, there are no forces acting on either of them, in this shown position. The clearance here is shown to have a uniform width, and that both the outside surface of the cone and the inside surface of the skirt are parallel to each other. This does not have to be so in all situations. See other cases shown later in FIGS. 48-D, 48-F, 49-D and 49-E and 49-F.

The value of such a skirt will apparent when I discuss FIG. 24-B. But for now, let's say that the skirt acts as a fence to guard and to prevent the cone from sliding off the base. Again, the forces are similar to FIGS. 18, view 1 and 18, view 2. The Forces NU, Normal Upwards, equal the Weight, W, of the cone. Of course, they are distributed over the contact surface area between the cone and the base's ledge.

FIG. 24-B shows a similar ledge and skirt and clearance, except that the ledge in this case is slanted on an angle HCA of 60 degrees as an example in this case. The figure shows also the acting forces in this case. FIG. 24-B shows the cone having a Half Cone Angle HCA of 60 degrees, similar to the setup shown in FIG. 18, view 4, but with a skirt. Again, the forces and their components are similar to those in FIG. 18, view 4. Now, let's talk about the skirt. When the cone is inserted into the base with a skirt, as shown. As it is shown, the upright sides of the cone could hit the inside walls of the skirt, during the insertion process. The skirt will guide the cone, during its descent into the base, until the lower surfaces of the cone reach the upper surface of the ledge. At the end of the downward travel of the cone, these two surfaces will meet and will center the cone into the base, in such a way that the cone will not touch the surfaces of the skirt any more. So, the skirt will be simply a guide to help the cone gets centered and once the centering process is accomplished, the skirt value would have been obtained and that will be the end of it. During the extraction of the cone out from the base, the skirt would do the same thing and will guide the cone from wandering too far off line. The height of the skirt walls will be important. They will have to be designed to be effective in guiding the cone during its descent, but not too high, in case the cone will need to be pull upwards and sideways, after being retracted a certain distance upwards.

Figure 34:
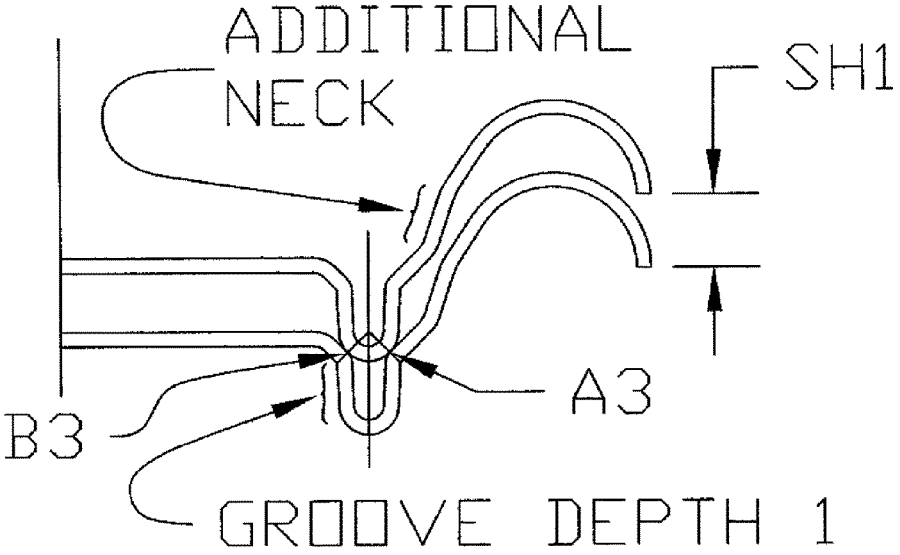
FIGS. 34 and 35 show enlarged details of FIGS. 33-A through 33-C.
Figure 35:
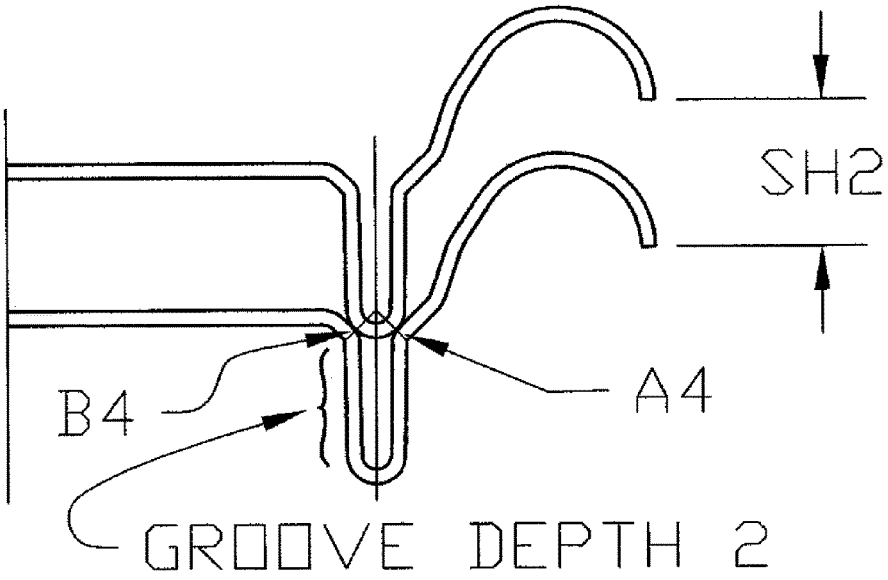

A similar skirt effect can help when stacking lids on top of each others. I am using this skirt and its effect in FIG. 33-C, calling the skirt the "Additional Neck". It is also shown in FIGS. 34, 35, 36-E, 37-A through 37-F, 38, 39-A and 39-B, 40-B, 40-C, 40-E, 40-F, 44, 48-C, 48-D, 48-E, 48-F, 49-C, 49-D and 49-E and 49-F.

Note that I have shown the cross hatching in FIG. 24-A, but not in FIG. 24-B. It is understood that both are cross sectional views, but sometimes I do not show cross hatching, just for clarity and to avoid too much clutter in the drawings.

Figure 25:
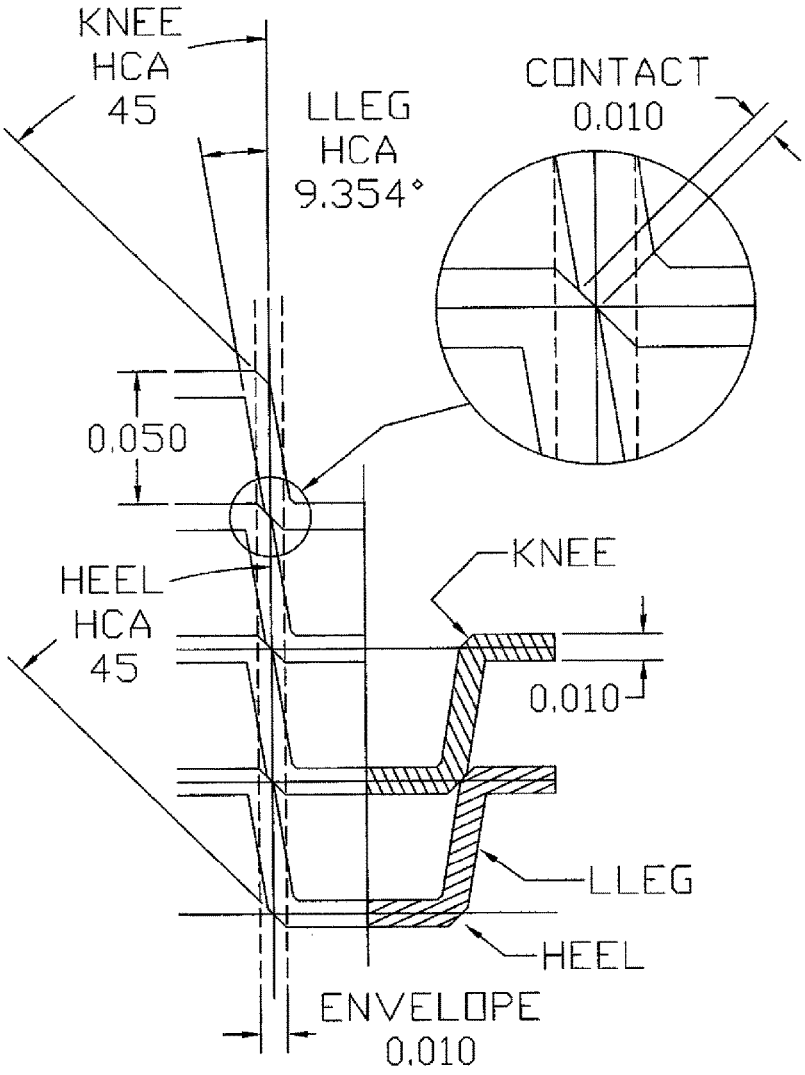

FIGS. 25 through 27-B introduce the concept of the ledge, in terms of HEEL, the KNEE and the "Lower Leg" (LLEG), as parts of the lid's trough, which will interact with each other, when lids are stacked one on top of each other, as per this invention.

FIG. 26-A shows the human analogy, which comes from when some acrobats try to make what is known as a human pyramid and when they get the heel of the OverPosed (OP) person sitting on top of the knee of the UnderPosed (UP) person. The stacking height (SH) in this case will depend on the length of the lower leg of the UP person. Also ideally, all the heels, knees and the lower legs should better stay within a reasonable "envelope", so that the pyramid can keep on going higher if necessary. FIG. 26-B shows how we can apply this analogy to our case of stacking lids, or rather the troughs of the lids, to accomplish our purpose.

FIG. 26-B shows a composite shape where the LLEG (Lower Leg) of the trough is at a steep angle LLEG HCA, i.e. small taper angle, but where the edge of the Knee and the HEEL, i.e. the surfaces of the lids that will make contact between the stacking lids, have good contact angles, KNEE HCA or HEEL HCA respectively, angles which would not "LOCK". Here, I am using a 45° angle.

FIG. 25 builds up on the concepts shown in FIG. 38. It also shows the HCA of the LLEG, which controls the SH, as well as the HCA of the Knees and the Heels. From the geometry, it is obvious that the LLEG HCA is relatively small in order to achieve the desired SH. The HCA of the Heels and the Knees can and should be larger. Ideally these two angles should be as wide as possible to avoid any sticking, as may happen when we get close to the Morse Taper condition. FIG. 25 also shows, on the right hand side, the mirror image of the trough half, which is on the left hand side of the figure. Later on, some figures will show that it is not always necessary to have the troughs exactly symmetrical, as in FIGS. 38, 39-A and 39-B, 40-C, 40-F, 48-E and 48-F. FIG. 25 also shows that the contact areas at the heels and at the knees are flat lines/areas, and that the contact between the heels and the knees can be a flat line/area, as shown in the enlarged view in the bubble at the top right corner of the figure. It can have a definite width as shown.

POTENTIAL CLAIM: This is a good "trick". I have a steep LLEG angle, but a flat shallow-KNEE and/or HEEL angle. The steep LLEG angle gives me a large stacking height, while the shallow KNEE and/or HEEL angle prevents "locking/interlocking" and provides good support.

POTENTIAL CLAIM: FIG. 39 shows another trick. Here the KNEES and HEELS of the dishes have different shapes. In FIG. 27-A, the upper KNEE of the bottom lid/dish, i.e. the UnderPosed UP lids, is radiused/filleted, while the lower HEEL of the top lid/dish i.e. the OverPosed OP lids, is chamfered at a predetermined angle, in this case 45. I sometimes refer to this chamfered surface as "sharp, flat, or straight". It is better to have such an arrangement, as compared to the case, where the two surfaces in contact, are radiused/filleted.

If the 2 contact surfaces are filleted, i.e. each one has a radius, then the point of contact would be a point where the two radii of curvature would meet.

This point of contact will be at the intersection of the line joining the 2 center of curvatures, and the outer surfaces of the parts.

The angle of contact will be the tangent at the particular point of contact at the respective surfaces or perpendicular to the line between the two centers of curvatures.

The major difference between the present invention and the conventional method presently used in the industry is the following:

One source informed me that in the present industry method, the lids are stacked by having the rivets touch each other, to control the stacking and the stacking height.

In my case and according to this present invention, I am having the lids stack on their troughs, providing more space between the lids and at the same time, a more definite concrete stacking condition. The rivets do not need to touch each other in this case. And still the tubes and lids in these tubes will not be SQUISHY.

But if one contact surface is "flat", at a certain "constant steady" angle, then there is a better chance to control how the two surfaces would contact each other.

Here in FIG. 27-A the "chamfered", sharp, flat, straight, lip is at the bottom, i.e. at the HEEL, of the trough. This would work OK, but it may be relatively difficult to shape the bottom of the trough like this. It would depend, of course, on the method used to manufacture the lid.

It may be easier to do the reverse, as shown in FIG. 27-B. In other words, the bottom of the trough i.e. at the HEEL, could be round/filleted/with a radius as in FIG. 27-B, while the top lip of the trough i.e. at the KNEE, i.e. the surface that will carry the trough of the lid on top of it, is "chamfered", i.e. with a "conical" shaped surface, presenting a "flat" surface or line for the trough to sit on.

PS: The above assumes a certain method of manufacturing the lids. But if any of the operations involved in the manufacturing methods chosen, includes a "coining or similar manufacturing step", then it could be as easy to have the "flat chamfer" feature actually on both the Knee as well as the Heel of the troughs. This would be even more desirable. But I would leave this decision to the individual manufacturers.

FIGS. 28-A through 28-D introduce introduces the concept of the domain or the orbital domain.

Many of my lids with pull tab embodiments in PT1 have shapes with recesses and protrusions, which are not symmetrical wrt the center axis CL of the lid. FIGS. 28-A through 28-D give a simple illustration of lids with such protrusions and their effects on stacking. FIG. 28-A shows a dish with a hollow bump at one side. In FIG. 28-A, three such dishes are stacked and are doing well, as long as the bumps line up one on top of the other as shown. In FIG. 28-B, the bumps did not line up and the results can be unpleasant, if not disastrous, as shown. It is almost like when we lay down a number of spoons in a drawer and the spoons did not get parallel nested properly. They take more space than otherwise and they do not stack up in a neat regular stack.

I want here to introduce a new word/term and definition. "ORBITAL DOMAIN" and Domain Envelope. If we spin the dish of FIGS. 28-A through 28-D about its central axis CL and trace an envelope of the space occupied by all the parts of the dish during its rotation, we would see something like the figure shown in heavy dark broken/dashed lines in FIG. 28-C. This is what I would like to call the orbital domain of such a dish.

If we want to stack such dishes and get a neat "straight up" stack, regardless of which orientation or position the "bump" is located at, then we need to find a way to place the next dish on top, i.e. the OverPosed OP dish, at a certain vertical distance or Stacking Height SH from the dish below it, i.e. the UnderPosed UP dish, in this case a Minimum SH distance equal to the distance SH2, so that the two dishes would not encroach on each other orbital domains. SH2 in FIG. 28-D obviously will end up being larger than SH1 shown in FIG. 28-A.

FIGS. 29, 30, 42-A and 42-B and 48-A through 48-F show an example of a lid that has a couple of recesses or indentations, below the general surface of the lid, while the pull tab is bent upwards above the normal shape of conventional tabs. This will lead me to talk more about Domains, Orbital Domains.

FIG. 29 shows a simplified version of some of the lids, used in my PT1.

First of all, the lids in FIG. 29, views A, B, and C do not show the tab at this time. They represent the lids only, shown in my PT1 patent, FIGS. 16, 17, 21, 81, 82, 90, and 101. 110-111 as examples, where certain recesses are shown below the general surface of the lid body. FIG. 29, view A shows the big recess to the left and the smaller one to the right. FIG. 29, view B shows the recesses reversed, right to left, and FIG. 29, view C shows the orbital domain, E1, of the lid with its two recesses.

Some of my lids in PT1 have protrusions above the general surface of the lid body. Some are shown in my PT1 patent, all the FIGS. 30 through 73.

Second, FIGS. 29, views D, E and F show an illustrative pull tab with raised lifter and/or punch. This tab illustrates some of the tabs used in various embodiments of my PT1 patent, such as shown in PT1 FIGS. 16 through 21, 23 through 31A, 66, 67, 68, 90 through 99, 101 through 109, 111 and 117.

FIG. 29, view D shows the tab pointing in one direction, FIG. 29, view E in the opposite direction and FIG. 29, view F shows the orbital domain, E2, of such a pull tab.

FIG. 29, view G shows the combined orbital domain, E3, combining the two previous orbital domains E1 and E2 shown in FIG. 29, view C and FIG. 29, view F.

FIG. 30 shows a stack of lids shown in FIG. 29.

If we want to ensure that the lids, sitting one on top of the other, do not encroach on each other orbital domains, we must place the lids with a SH equal to the distance D shown in the figure. If the SH is smaller than this SH "D", then we would have trouble. We may end up with a situation like the one shown in FIG. 28-B. NG.

FIGS. 41-A and 41-B show a lid, where the tab has been positioned right and left, because the lids when they are stacked on top of each other do not always sit in the same orientation. They can fall on top of each other with their tab pointing in any different direction.

So, we can say that the tabs can be located in anywhere within a certain "orbit" or "space", as indicated. The same goes for any recesses or protrusions in the body of the lids themselves, and they too will have an "orbit" or "space" of their own, again as shown in the figures. See FIGS. 29, 30, 43-A and 43-B, 48-B, 48-C and 48-E.

Now the big question is how to provide the SH of this size.

Figure 31:
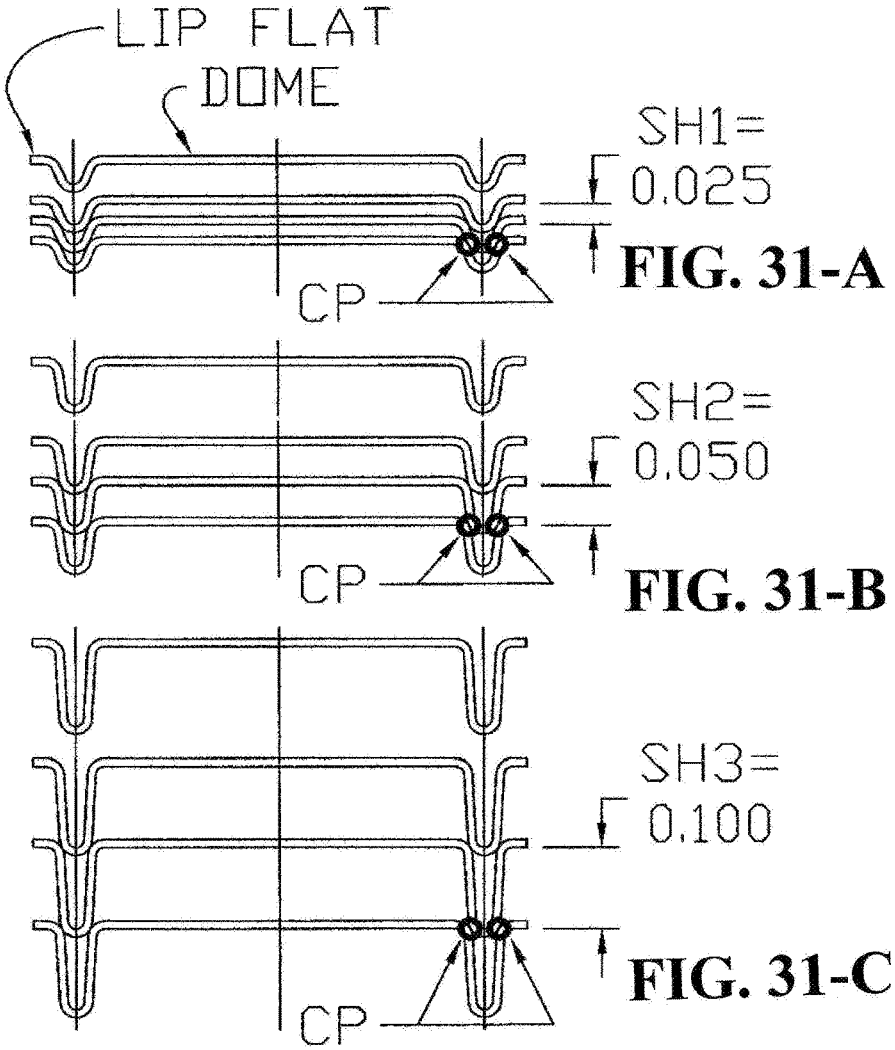
FIGS. 31-A through 31-C introduce a special way of presenting my proposed ideas and concepts in this specification. It shows three groups of lids, in FIGS. A, B, and C. Each one of the different groups shows different features and then compares them against the other groups.

FIGS. 31-A through 31-C show one way to achieve this goal.

First of all, I would like to point out that FIGS. 31-A through 31-C introduce a special way of presenting my proposed ideas and concepts in this specification. It shows three groups of lids, in FIGS. A, B, and C. Each one of the different groups show different features and then compares them against each other.

Each one of these groups includes two sub-groups of lids. The first, top sub-group shows one single lid, with certain shapes and/or features. The second, lower sub-group shows two or more lids, similar to one on top of them, with the purpose of highlighting the interaction between them while in the stacking situation. Then the figure shows the differences between the various sub-groups, to highlight the effect of the changes or differences between those sub-groups. I will follow this presentation approach in several of my subsequent figures.

FIGS. 31-A through 31-C show some ways to achieve different SHs and VSs. FIG. 31-A shows four lids with short troughs. The top lid is standing alone, just to show it details clearer, while the three lower ones are stacked one on top of each other, basically touching each other at the troughs. The empty space between the flat bodies of the lids is the space available for any ancillaries, such as a pull tab or a recess or a protrusion in the lid body. I called the trough here, the short trough. The Stacking Height SH1 in this FIG. 31-A is 0.025 inch.

FIG. 31-B shows a similar group arrangement, but here the troughs are slightly larger. I called them the Medium Troughs. The space available for pull tabs etc is larger than in FIG. 31-A. The Stacking Height SH1 in this FIG. 31-B is 0.050 inch.

FIG. 31-C shows again a similar group arrangement, but with a LONG trough, providing yet a larger space for pull tabs etc. The Stacking Height SH1 in this FIG. 31-C is 0.100 inch.

We can clearly see a pattern starting to emerge here. If we can provide troughs, as shown, with different lengths or depths, then we would be on our way to solving the problem. The lids will be stacked so that the trough of one lid, the OverPosed OP lid, would engage the trough of the underlying lid, the UnderPosed UP lid, and depending on the length/depth/size of the trough, we will be able to control the size of the space between the lids, which in turn control the space allowed for the various shapes of tabs and different sizes and shapes of lid recesses and/or protrusions.

Another benefit of this approach is that it will prevent/eliminate any "SQUISHINESS" in the stack. The troughs could be located along the perimeter of the lids and will provide a steady solid and uniform base for one lid, the UnderPosed UP lid, to carry and support the next lid, the OverPosed OP lid, in the stack.

Active Contact Points

I have yet to get a definite answer as to how the Industry addresses the points of contact between lids in stacks. See examples of possible Active Contact Points in FIGS. 1-A, 1-B, 1-C and other applicable figures in this application.

Typical issues:

1. Where do the lids touch each other in the stack, in the present industry? It seems some manufacturers do it one way while others do it a different way.
2. Do the troughs get inserted inside one another, creating contact areas, as item F in FIG. 1-B ? Or do they just sit on the top opening (mouth) of the trough that is lying underneath the top lid, as proposed in this application?
3. Sometimes they touch at the rivet area, as item "A" in FIG. 1-A, that holds the pull tab to the lid body.
4. Sometimes they touch at the lip, as item "D" in FIGS. 1-A and 1-B, that will be folded and seamed.
5. Sometimes they get interposed inside the troughs and touch at the trough flanks surfaces as item "F" in FIGS. 1-A and 1-B, the troughs being near the perimeter of the lid body, and then the question is whether they touch at the inside flanks surfaces of the trough, the outside flanks surfaces of the trough or at both surfaces.
6. Could be at any other part of the lid and at any other suitable location?

I decided to make sure that the basis/foundation of the stack will always be at the trough, and then at a more discrete, concrete, definite, location wrt to the trough. I chose the trough of the lid body, and ideally if possible, the HEEL, which is at the bottom of the trough of the top lid, i.e. of the OverPosed OP trough, would sit somewhere on the top of the KNEE of the trough of the lid sitting underneath the first one, i.e. on top of the KNEE of the UnderPosed UP trough.

Now, how best to accomplish that?

FIG. 32 highlights the possible contact points between stacked lids. It is possible to have only one set of contact points, at the points shown as "H", at the outside corners of the troughs, as shown at the top of the figure. It is also possible to have only one set of contact points, at the points shown as "G", at the inside corners of the troughs, as shown in the middle of the figure.

And obviously, it is possible to have two contact points, at both corners of the trough, as shown at the bottom of the figure.

It may be good to have the contact points at both corners of the trough, but it is usually difficult to achieve such concurrent multiple contact points at the same time, due to manufacturing tolerances, etc. So, if we can work with only one contact point, at one side of the troughs, either side, then I would rather go this way, instead of having two points at both sides.

Some figures further down below, will show that there may be a case in favor of having the contacts at the outside corners of the troughs, as shown in the middle of this figure. See FIGS. 38, 39-A and 39-B, 40-C, 40-F, 48-E and 48-E.

PS: All the PT1 figures listed above are affected the same way and consequently I would like to include and incorporate them in this present application, and have them covered here by this present application and by the proposed solutions herein.

Also, all the solutions and embodiments presented in this application are useable for other similar stacking situations or applications.

FIGS. 33-A through 33-C show three different options or three possible situations of how the lids can be stacked. The top figure, FIG. 33-A, shows option #1, which is fairly close to the way the lids that are presently used in the market are arranged. The points of contact between the stacking lids can either be at points [A1=CP], which are near the tips of the open lips, i.e. the portions of the lids that will be rolled and seamed, or at point [B1=CA] along the trough of the lids. CP indicates that it is a Contact POINT, while CA indicates that it is a Contact AREA. In the cross-sectional view, the CA area would look like a Line, but in reality, it is the generatrix for a specific AREA.

Potential Claim:

Option #2 is shown in the middle figure of FIGS. 33-A through 33-C, i.e., FIG. 33-B. Here, we rely more on making contact between the lids, at points [A2=CP] and [B2=CP], which are at the troughs. They are like the ones shown FIG. 31-A. They are at the points where the bottom HEEL of the trough of the upper lid i.e. of the OverPosed OP lid, sits on the top KNEE of the trough of the lower lid, i.e. of the UnderPosed UP lid. The seaming lips need not touch each other, although there is nothing to say that they should not.

Potential Claim:

The lower figure in FIGS. 33-A through 33-C, i.e., FIG. 33-C shows another option, option #3.

Potential Claim:

Here we see an "additional" "Neck", or "SKIRT", similar to the skirt shown in FIGS. 24-A and 24-B, above the trough. This can help in guiding the lids, during the stacking operation. We can also make sure that there is some clearance, to avoid any "sticking" between the lids stacked up one above the other.

Figure 47:
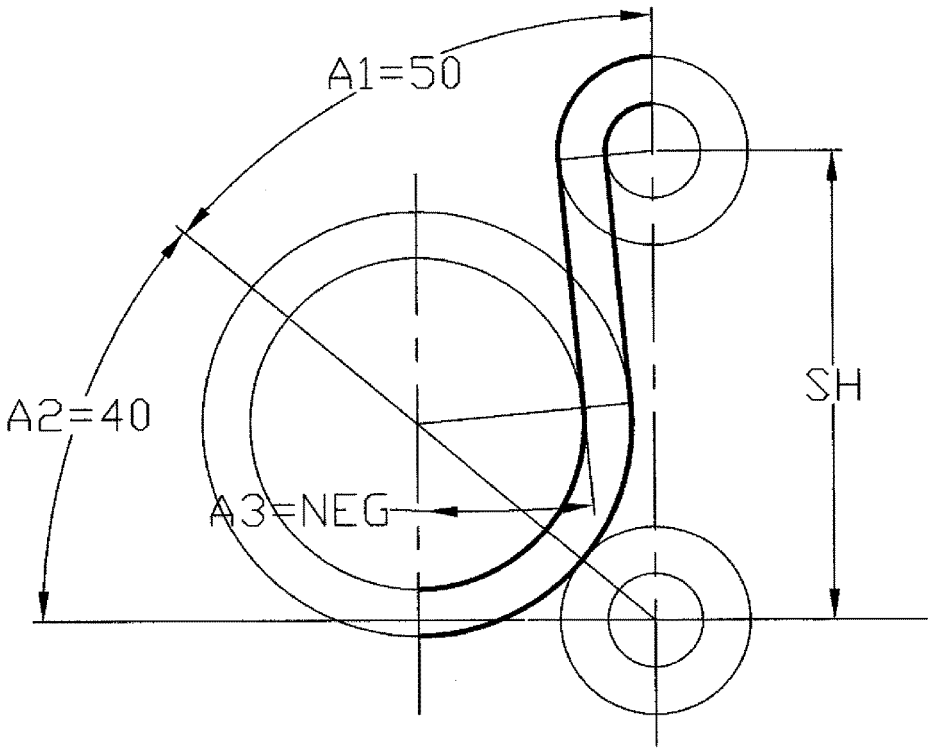

FIGS. 34 and 35 are enlarged views of the right hand side of the lids shown in FIGS. 33-B and 33-C. They show one way that can be used to increase the stacking height. FIG. 34 shows a geometry of the trough, which results in having a stacking height of SH1. Incidentally, it also shows a certain "additional neck" or "SKIRT", FIG. 47 shows a geometry which results in a stacking height of SH2, where SH2 is larger than SH1 of FIG. 34, hence the stacking height of FIG. 47 is larger that the one in FIG. 34

These 2 figures indicate that one way to increase the stacking height is to increase the "GROOVE DEPTH" or the "trough depth" or "trough length" as shown in FIGS. 34 and 35.

FIGS. 36-A through 36-E and 37-A through 37-F show similar arrangements as in FIGS. 31-A through 31-C.

However, there may be some limitations as to how far we can go, i.e. how deep we can make the trough/groove in the lid. If we go too deep, there is a chance that we would overstretch the material and the lid would break. Also the tooling may become too difficult or problematic. It could become too expensive and too fragile and may wear too fast.

Note re FIGS. 36-A through 36-E and 37-A through 37-F, and many of other similar figures: Like in most of the figures, the Points of Contact "CP" are identical on both sides of the figure, i.e. the right side, as shown, as well as the left side of the figure. They are highlighted on only one side of the figure, in this case the right side only, so as not to clutter the figure more than necessary.

FIGS. 36-A through 36-C shows an arrangement similar to the one shown in FIGS. 31-A through 31-C, but with certain differences. First of all, the lids have their lips shown. Then FIG. 36-A shows that the troughs are touching along their flanks. And that the contact is an area designated as CA="F". Compare this with the contact situation "F" in FIGS. 1-A and 1-B. FIG. 36-B shows the lids contacting at points CP="H" at two specific points of the troughs. Compare this with the contact situation "H" in FIGS. 1-A and 1-B. FIG. 36-C shows a similar situation as in FIG. 36-B, but with a deeper/longer trough/groove, which results in that we have a larger SH and a larger space between the lids, which could accommodate some higher tabs or other protrusions or recesses in the lids. FIG. 36-D and 36-E shows details of FIGS. 36-A through 36-C. FIG. 36-D shows the details of FIG. 36-A, while the details in FIG. 36-E apply to both FIGS. 36-B and 36-C.

FIGS. 37-A through 37-F introduce another important point or feature. They show lids pretty similar to the ones shown in FIGS. 36-B, 36-C and 36-E. The difference here is that the lids have a skirt. The skirt starts after a specific neck or jog in the lid, just beyond and outwards from the edge of the trough. Depending on the height of the skirt and the depth of the trough, we may or may not have a touching point between the skirts themselves, when such lids are stacked. We have to be careful about and try to avoid such points touching. See FIGS. 37-D, 37-E and 37-F for enlarged details and the geometric relations between Points A, B, and C.

FIGS. 38, 39-A and 39-B show lids, with troughs that have been opened up to get larger draft angles etc., for more ease of manufacturing and/or better tooling.

FIG. 38 shows a modification on FIGS. 37-A through 37-F. Here the trough has a slanted wall (can be the inside wall or the outside wall). In this case, I opened up the trough and provided the larger, wider draft angle towards the inside of the lid. It provides a larger angle between the walls of the trough. This shape provides a "LARGER SPACE FOR the Mfg tooling", which will "form" the trough, and could make it easier to manufacture the lid, and could help in extending the life of the manufacturing tooling and machinery.

FIGS. 51-A and 51-B show yet another modification/improvement over the previous designs. The trough is shaped so as to have a relatively large radius of curvature at the bottom, as shown in FIG. 51-A, or even to have a flat area at the bottom, as shown in FIG. 51-B. This further improves the tooling cost and life and reduces the stresses on the material of the lid.

APPLICATION OF WHAT WE LEARNED TO SPECIFIC PREFERRED EMBODIMENTS

One Preferred Embodiment

FIGS. 40-A through 40-F show a direct application of the previous concepts, applied to one of my PT1 lids. Here the prior art lid has a protrusion above the lid panel or dome, and the lifter tip of the tab has been tilted upward, higher than the standard flat tabs. It is almost the same situation as the case shown in FIGS. 48-A through 48-F and 49-A through 49-F.

FIGS. 40-A through 40-F show how to solve the problem with my old PT1-FIGS. 66 through 68, which include a cam on top of the lid panel or dome, which is intended to lift the tab and its lifter tip high above the lid panel or dome, to facilitate opening the lid and the container. Please see the discussion about the domain, etc., and the interferences, in FIGS. 28-A through 28-D through 30 and in the description of FIGS. 48-A through 48-F, further down below. The problem I am trying to solve here in these FIGS. 40-A through 40-F is two-fold. First, the interference between stacked lids, before they are joined to their respective container bodies. Second, the potential problem that we may face, when the finished containers are placed and stacked on the shelves at the grocery stores or during shipping. The second problem could occur, if and when the lid has protrusions, which are higher than the edge of the finished seam, at the top of the container.

FIGS. 40-A and 40-D show the protrusion of the lifter tip of the tab, which is bent upwards, being now at a level that is above the level of the open lip, and potentially above the level of the closed seam. If we try to stack such lids, we would have some interference between the lids in the stack.

FIGS. 40-B and 40-E show how to solve the problem, when stacking the lids themselves, before they are joined to the containers' body. The solution is to have a deeper trough and to have the lids sit trough on trough, as described in the earlier figures already.

However, we may still have certain parts of the ancillary components on top of the lid panel/dome, which could protrude higher than the top edge of the seam of the finished container. This may be objectionable. So, to eliminate such objections, we can do what is shown in FIGS. 40-C and 40-F.

FIGS. 40-C and 40-F introduce a new trick. Here, we can place the lid panel or dome at a lower level than its level shown in FIGS. 40-A, 40-B, 40-D and 40-E. Lower wrt the KNEE of the carrying trough, which is the outside KNEE of the trough, in this case. Another way is to do the opposite. We can raise the level of the KNEE and of the lip and seam. Or we can do both. The net effect should be the same. We would end up with a measurable, acceptable distance "CLBS", the Clearance Below Seam, i.e. Clear Distance between HP and highest point of Closed Seam where the highest point of any ancillaries on the lid, will end up below, i.e. at a lower level than, the seam by a safe distance, as seen in FIG. 40-F. Here, we get two birds with one shot. We solve the problem of lid stacking, before the joining/seaming process, as well as the problem with stacking the finished containers on the shelves or during shipping and handling.

FIGS. 40-D, 40-E and 40-F are enlarged view of the important features.

FIGS. 41-A and 41-B show another application of the concepts of this invention, to solve a stacking problem with another one of my Prior Inventions. It shows how we can apply what we have learned so far to ensure proper acceptable stable solid stacking of the embodiment in my design U.S. Pat. No. D579,771, as well as any similar embodiments in my PT1, U.S. Pat. No. 7,617,945, e.g. similar to FIGS. 90 and 97 of PT1.

FIG. 41-A shows the lid of my Design U.S. Pat. No. D579,771, with the raised tab tips, both the lifter tip and the punch tip. The top figure shows only one lid, while the lower figure shows two such lids stacked one on top of the other. We can see where the tab tips will be interfering with the dome of the lid sitting above them. No Good. Notice that the trough depth, TRD1, here is equal to 0.083 inch.

FIG. 41-B shows that by increasing the trough depth, to TRD2, which is equal to 0.220 inch, we have solved the problem. No interferences. And the other important benefit now is that the lids will rest on the troughs. The trough heels of the OverPosed OP lids will sit on the trough knees of the UnderPosed UP lids, and will not rely on making contact with the flanks of the troughs as in the old lids. The stack will be solid, stable, reliable, and NOT SQUISHY.

FIGS. 42-A, 42-B, 43-A, 43-B and 44 show another application of the present invention's concept to vet another lid of my PT1 patent. They show how we can apply what we have learned so far to my embodiments shown in FIGS. 81 and 82 of my PT1 patent.

We solved the problem with FIG. 81-82 of my PT1 patent, as shown in the present FIGS. 42-A, 42-B, 43-A, 43-B and 44 by using similar solutions for the stacking problem, when using the long troughs.

If it weren't for the fact that the trough heels of the OverPosed OP lids are now sitting on the trough knees of the UnderPosed UP lids, the upper trough would have been interposed into the long neck of the trough sitting underneath it, sitting on the flanks of the UP trough which has a draft angle of less than one degree HCA, and it would have been locked in there, like a Morse Taper.

And by following the above mentioned approach, as proposed by the present invention, we obtain a solid reliable stack, which is NOT SQUISHY.

But the way it is now, it is quite free to be disengaged and taken off the trough without exerting any appreciable forces. Very easy. And yet, it is well nested sideways, but with plenty adequate amount of free clearances, which we can provide as we did in FIGS. 48-C, 48-D, 48-E, 48-F, 49-D and 49-E and 49-F.

FIG. 42-A shows the old PT1 shape at the bottom of the figure, and then at the top, FIG. 42-B shows the new shape as modified according to the present invention. It can be seen that the trough has been lengthened by 0.1300 inch. See a similar procedure in FIG. 49-A through 49-F, although the dimensions are different.

FIGS. 43-A and 43-B show how the old and the new lids would stack. The old lids in FIG. 43-A would create interference between the individual lids in the stack. The new lid would not, as can be seen in FIG. 43-B.

FIG. 44 shows close details as to the dimensions, angles, etc of the new lid and how it would work when stacked together with similar lids. It shows the longer trough depth, and it shows how the trough of the OP lid, touches the trough of the UP lid at the points of contact "H" and "G". The HCA in this case is shown to be 60 degrees.

It is important to notice that the draft angle of the inside walls of the trough ended up to be 0.7343 degrees on each side of the trough center line. So, the total draft angle in this case is 1.4686 degrees. This is a larger draft angle than other ones created by the industry. So I believe that they will be able to manufacture such a lid without much difficulty.

Figure 46:
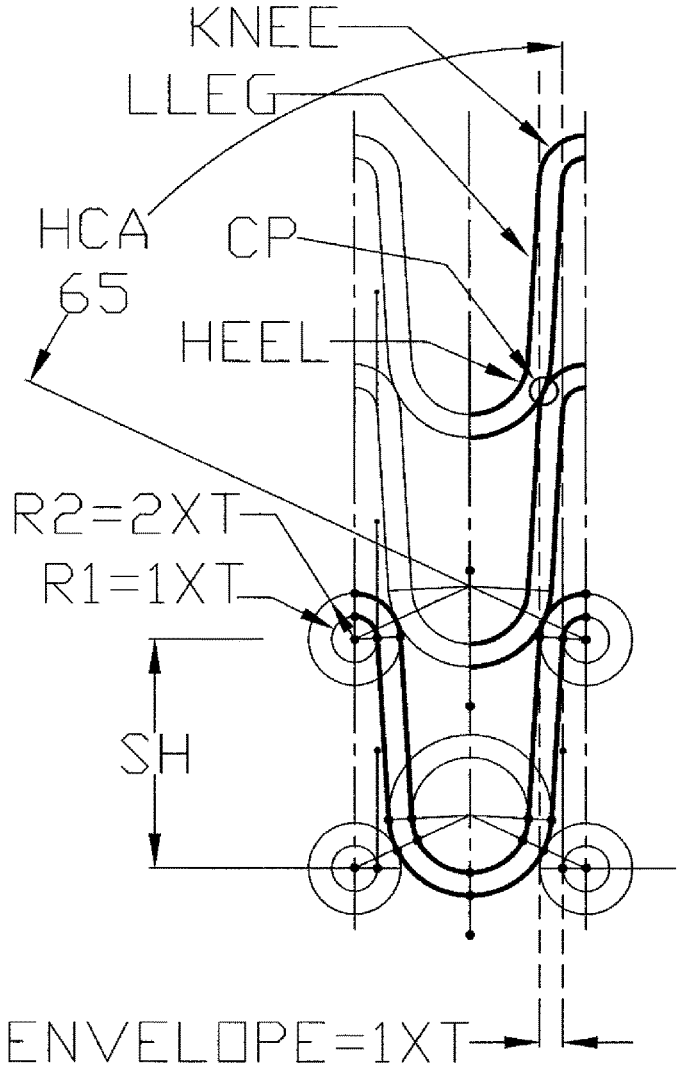

FIGS. 45, 46 and 47 show one way to design the trough as per this invention.

FIG. 45 shows the way to design the basic shape of one half side of the trough. It shows in close details, the steps that I went through to create the elongated trough of FIGS. 42-A, 42-B, 43-A, 43-B and 44. The same steps can be used to create similar elongated troughs for any other similar applications.

FIG. 46 shows how to use the basic shape of FIG. 45 to build the complete trough and how such a trough would stack up, one above the other.

FIG. 47 shows what could go wrong, if we start by choosing some bad choice of starting dimensions or angles. We may end up with a negative draft angle on the flanks of the trough, which is usually more difficult to attain.

The key points in the procedure are to make sure that you end up with a positive draft angle for the trough; otherwise it would be more difficult to manufacture. This is what could happen for example if we try to be too ambitious, as shown in FIG. 47. By trying to have a more favorable angle for the Supporting force, we were forced to increase the diameter of the shape of the bottom of the trough. This in turn would create a negative draft angle for the whole well of the through. The manufacturers would not be too thrilled with such a design.

Method of Finding/Designing an Appropriate Trough for the Required "SH".

Here I would like to summarize the steps that I took to form the trough in FIG. 45. I am sure that any person skilled in the art can come up with other or comparable ways to obtain the same end result.

1. I started by drawing the two radii of curvature, R1 and R2, of the mouth of the trough. I figured that the inside radius, R1, should not be smaller than the thickness, T, of the material. This leads automatically to determine the size of R2.
2. Then, I drew another set of R1, R2, underneath the first set, with a distance SH between the two sets. This SH represents the desired Stacking Height that I want to end up with.
3. These two sets of circles are placed at a distance, Half Trough Width, "HTW", away from the imaginary Center Line of the Trough, CLT.
4. Then, I arbitrarily chose an angle A2, to represent the HCA for the Contact Point P9. I extended the line D-P9 until it intersected the CLT at point G. The angle A12 is the complementary angle to A2, i.e. A1+A2 add up to 90 degrees. We would like to make A2 as large as possible, and consequently A1 as small as possible, to avoid getting any Morse Taper Effect. But if we chose A1 to be too small, we may end up with a negative draft angle, A3. So, we iust start with a first iteration, go through the steps and determine the value of the resulting A3. If it is not acceptable, then we try a smaller A2, i.e. a larger angle A1, and so on, until we get a satisfactory Angle A3. In the iteration shown in FIG. 45, A1 is 65 degrees, which made A2 equal 25. A2 is the HCA for the point of contact P9, and it is fairly far away from the Morse Taper angles.
5. With the chosen A1 and A2, I drew the Circle C1, with its center at point G and the radius going to point P9.
6. Then, I drew the Circle C2, making sure that the difference between the two radii would equal to the material thickness.
7. Then I drew the line P2-P3, to be tangent at P2 to the upper circle with the radius R2, and tangent at P3 to the circle C2.
8. I repeated step 7, and drew the line P7-P8, to be tangent at P7 to the upper circle with the radius R1, and tangent at P8 to the circle C1.
9. Here, we can already determine whether the choice of the Angles A1 and A2 was a good one or not. We can measure the draft angle A3, between the lines P2-P3 and the CLT, or between the lines P7-P8 and the same CLT. If the angle draft A3 is positive, as shown in FIG. 45, then we are on the right track. Then we want to make sure that such an angle can be manufactured rather easily and safely. Some beverage containers bodies have a draft angle of less than one degree. I don't like to push it and make the draft angle too small; otherwise the forming operation could be too difficult and could create problems. If necessary, we can choose a larger angle A1, or we can make the trough wider, say by changing the distance HTW, or the like.
10. Once I determined that I have a satisfactory draft angle, I finished the drawing, as shown, to end up with the complete shape of the trough, the part shown in FIG. 45, starting at point P1, going to P2, P3, etc until P5, for the inner/upper contour of the trough, and starting at point P6 and ending at P10 for the outer/lower contour of the trough.

Notes:

1. The goal is to have the minimum Angle A1 and the maximum angle A2, which would result in a positive draft angle A3, which is relatively easy to manufacture with good quality results.
2. Angles A1 plus A2 add up to 90 degrees.
3. Start by choosing the smallest angle A1 that would result a positive draft angle A3.
4. I feel that you can start with angle A1 close to 45 degrees or larger. If that does not result a positive draft Angle A3, then make A1 larger, but try to stay between 45 and 70 or 75 degrees, unless really squeezed to go larger.
5. But if you end up with a draft angle A3 that is larger than you like or larger than you need, then go back and select a smaller angle A1 to get a smaller draft angle A3, which you can still manufacture relatively easily.
6. R2−R1=T=Material thickness.
7. Selecting a small angle A1 that is too small could result a negative draft angle A3, like the example shown in FIG. 47. It is more difficult to manufacture such a trough and I would rather stay away from doing that. However, I discovered that some manufacturers do create some equivalent situation, albeit they require a secondary operation to accomplish their end product. That is their choice, of course.

A Preferred Embodiment

FIGS. 48-A through 48-F show another application of this present invention applied to another one of my prior art PT1 patent's lids. They show how to solve the stacking problem for the embodiment shown in FIG. 21 of my PT1 patent. It is very similar to the solution used for the FIG. 81-82 embodiments of my PT1 patent, and as shown in present FIGS. 42-A, 42-B, 43-A, 43-B, and 44.

FIG. 48-A shows that Prior Art from my PT1 patent. It is basically a copy of PT1-FIG. 21 of my PT1 patent. See Reference list. It shows a number of deep finger wells underneath the lifter tip of the tab. These finger wells are intended to provide more room for the user's finger, to get under the lifter tab and to help in grabbing and pulling the tab upwards, in order to open the lid and the container.

FIG. 48-B shows details of how that prior art lid would create interferences, if it is stacked one on top of the other.

View 1 in FIG. 48-B shows a combination of the lid shown in FIG. 48-A (PT1-FIG. 21) and the lids in PT1-FIGS. 66 through 68 of my PT1 patent. See Reference list. FIGS. PT1-66 through 68 show a cam on top of the lid panel/dome, which is intended to lift the tab and its lifter tip high above the lid surface to facilitate opening the lid and the container. So, view 1 in FIG. 48-B shows a combination of the deep finger wells/recesses together with the top lifting cam. This combination shows one of the worst case scenarios for stacking the lids on top of each other. I chose this combination to illustrate a possible way/method to overcome such a problematic stacking situation. Most situations expected to be encountered in real life would not be as problematic or as demanding. Notice also that the tab is in its lowest position, the position in which it is manufactured and in which it is placed on the shelves in the grocery store and the like.

View 2 in FIG. 48-B shows the domain or orbital domain of the lid shown in view 1 in FIG. 48-B. The domain is overlaid on top of the components of the lid. It shows the space utilized by the components, if and when the lid were to be rotated about its central axis. It is similar to the domains illustrated in FIGS. 28-A through 28-D, 29 and 30. This orbital domain should be provided and protected, if lids like this one are stacked on top of each other, realizing that the lids can be deposited one on top of the other and positioned, in any possible rotational position about their central axis. Again, I chose the largest finger well/recess, just to show the worst case scenario.

View 3 in FIG. 48-B shows only the outside contour of the orbital domain for this lid. I eliminated the details of the components inside this domain, to reduce the clutter and to make the figure more understandable.

View 4 in FIG. 48-B shows what happens when we stack two such lids on top of each other. Notice the areas of interference between the two domains, areas A, B, and C. Notice also that in this figure, I purposely positioned the two domains in the same direction.

View 5 in FIG. 48-B show a similar interference situation, but when the two domains are positioned at 180 degrees with each other. Notice the interference areas D, E, and F.

View 6 in FIG. 48-B shows a combination of the views shown in the two previous figures. It shows how the interference areas can happen depending on how the lids are positioned on top of each other.

FIG. 48-C shows one possible way to solve the interference problem. This was done by increasing the depth/length of the trough. It shows lids, similar to the one shown in view 1 FIG. 48-B, except that the troughs have been changed. The troughs here are larger, longer, deeper. They force the lids to be stacked at a higher Stacking Height (ST). Here the stacking height SH is 0.270 inch. Compare that with the Stacking Height of 0.0827 inch in the original lids, as shown in view 4 in FIG. 48-B.

FIG. 48-D highlights some of the important details.

It highlights for example that the SH2 now is 0.270 inch compared to the original stacking height SH1 of 0.0827 inch, and that is due to the longer deeper trough. It also highlights the skirt, which I introduced at the lid's skirt, above the Contact Points (PC), above the knees, above the bell mouth of the trough. And the skirt angle, which results in us having a clearance between the skirt of the UP lid and the trough of the OP lid. The skirt angle here is 10 degrees, but it can be chosen to have any more desirable or more manufacturable angle.

The draft of the trough is 0.5986 degrees on each side of the imaginary center line of the trough, which is a pretty steep draft angle.

This clearance prevents the lids from sticking together, when stacked on top of each other. It makes it more easy to separate the lids from each other, during the time, the lids are presented to the double seamer machine, which loins the lid to the container body. This would be very desirable to the assembly operation. The manufacturers would love this feature, because it reduces the chances of having the lids stick together. If they do, then the double seamer machine may get a lam and it is very painful to clear such jams to get the machine back in operation. So, this clearance reduces the risk of getting machine jams.

Notice the draft angle, also known as the Half Cone Angle (HCA), in FIGS. 48-C and 48-D. It is 0.5986 degrees on each side of the trough center line. This is a steep draft angle. It can be done, but it is relatively difficult. It can also make the tooling more expensive and more sensitive to wear and tear.

FIGS. 48-E and 48-F show another improvement. Here the trough is opened wider, towards the central part of the lid. The External Draft Angle remained the same at 0.5986 degrees, but the INTERNAL Draft Angle, the one towards the inside part of the lid, was opened to 11.1689 degrees. This makes the total opening angle equal to 11.7675 degrees, which is a much more friendly draft angle. Of course, these angles can be chosen and designed according to the needs of any specific situation. This makes life easier on the tool makers and the machines that produce the lids. In essence, this is one application of the figures shown in FIGS. 38, 39-A and 39-B.

FIGS. 48-C through 48-F could also be made like FIGS. 40-C and 40-F, by dropping the lid's panel or dome to a lower level, so as to avoid having any part of the tab from protruding above the lid's seam top edge.

A Preferred Embodiment

FIGS. 49-A through 49-F show yet another application of the present invention. They show again how to solve the stacking problem for the embodiment shown in FIG. 66 of my PT1 patent. Again it is very similar to the solution shown in FIGS. 42-A, 42-B, 43-A, 43-B and 44. FIGS. 49-A and 49-B show another one of my prior art PT1 patent. Here the problem is that the lid has a protrusion above its general flat surface or dome of the lid. It is the cam that will raise the lifter end of the tab, when the tab is rotated sideways, plus we have the tab, with both lifter tip and punch tip raised higher than normal. The top view, in FIG. 49-A, shows one single lid, while the lower view, in FIG. 49-B, shows two such lids stacked one on top of the other and we can see where and how the lids will interfere with each other. The stacking height here is SH1 equal to 0.100 inch. The solution is pretty much the same.

FIG. 49-C shows the improved lid, with a deeper longer trough and the SH2 now is equal to 0.1480 inch. Now, there are no interferences.

FIG. 49-D shows an enlarged view of the trough area, highlighting the skirt, the clearance and the contact points between the troughs.

FIGS. 49-E and 49-F compare the old with the new.

However, we have an additional trick we could use. Please look at FIGS. 40-A through 40-F. In the previous solutions of FIGS. 40-B and 40-E, and FIGS. 41-A, 41-B, 42-A, 42-B, 43-A, 43-B and 44, I have increased the dimension shown as TRD in FIGS. 40 A through 40-F. But here for this case of FIG. 49-A through 49-F, we can increase the dimension LIPH or SMH instead, like we did in FIGS.

40-C and 40-F. The effect of that will be that the whole main flat body (panel or dome) of the lid, together with any components attached on top of it, will become lower than the uppermost lip of the can, i.e. lower than the upper edge of the seam. The benefit here would be to prevent any of the protrusions of the lid from sticking higher than the container lip. This may look more beneficial to the Industry.

Recap of some important notes and remarks:

1. Notice that in view 1 and in view 2 in FIGS. 48-B, and 48-C through 48-F, like in some other figures in this specification, I am showing the lids with an open lip as well as with a closed seam. In real life, we usually have either the open lip or the closed seam, but not both of them at the same time. Unless we have a malfunction in the double seamer machine. The reason I am showing them both in these figures is to show the relation between them and to make sure that the design is correct.
2. Practically all the figures show cross-sectional views of the lids. We can visualize that the lids are round, circular, looking at them from the top. But we could visualize as well that they can be oblong, or they can be square or rectangular, with filleted rounded corners, like a sardine can for example.
3. I am not showing the cross hatching in the material thickness of the cross sectional views, just to eliminate the clutter. It should be understood that the views are cross sectional views.
4. In the cross sectional views, the drawings can be a bit misleading. For example, in FIGS. 23-A through 23-D, the two circles underneath the round nosed cone can mean that they are two spheres carrying the cone, or they can also mean that they show the cross sectional view of a donut, going around beneath the cone, and the cross section of this donut looks like the two shown circles. In both cases, the forces and their components are almost identical. If the carrying devices are individual balls or spheres, then the acting forces N and T will be acting on the points of contact shown here, which are actually individual points. But if we are talking about a donut, then the points of contact shown in the figures are the cross sectional view of a circle of contact, going around the round nose cone, and this circle cross sectional view is represented by the two points of contact shown. In this case, the acting forces will be distributed along this contact circle.

The Iteration Approach; Method to Find a Good Trough.

When we try to find the best angle of contact between the bottom HEEL of the OverPosed OP top trough and the bell mouth KNEE of the UnderPosed UP bottom supporting trough, we can go through an iterative approach and try a first desirable guess and check the end result. Especially regarding the draft angle of the long trough neck, or what I rather call the LLEG. If the angle is too small or negative, then we should try a different guess, then go through the whole procedure and check the new results. And keep repeating such iterative approach until we find a solution that is satisfactory.

For example, we can start with a contact angle, where the normal force provided by the supporting trough's bell mouth is applied on the spherical bottom of the top trough, say at 45 degrees. Work through the geometry steps and determine the resulting draft angle of the trough neck. If the draft angle is NEGATIVE, then make the force act at a shallower angle. Say at 30 degrees from the horizontal. Make the angle XYZ equal to 30 degrees from the Horizontal. This will be equivalent to having a HCA of 30 degrees. Again, go through the geometric exercises and see what the resulting draft angle is with this choice. If it is now too generous, then you can try to go back and increase the angle say to 35 or 40 and so on until you get the best compromise that you can work out. Of course, we can figure out a mathematical approach to calculate all the required dimensions, curves, circles, arcs, etc, but I will leave that to the skilled person in the art to do so.

Other notes and important criteria to keep in mind, regarding the trough and its design etc.

1. Rely on the distance between the HEEL and the KNEE for the stacking height (SH).
2. The skirt walls can be loose, i.e. can have clearance between them and the trough enclosed between them. See FIGS. 24-A and 24-B.
3. The acting forces:
4. Vertical support, V, Vertical, Axial
5. Horizontal, Guidance, Radial.
6. The angle is usually measured as the "CONE" angle, or as the "HALF CONE" angle, from the axial center line (CL) of the cone or of the lid.
7. for vertical support, it is better to have a large cone angle
8. for Horizontal guidance, it is better to have a small angle
9. ALL WITHIN THE BOUNDARY OR ENVELOPE OF THE ACTUAL MATERIAL THICKNESS, as much as possible.
10. Ideally, the trough should have a FLAT bottom, or as close to FLAT as possible. For practical and manufacturing reasons, better start with a 45 degree Half Cone Angle
11. Keep in mind the Effect of the thickness of the material on the stacking height.
12. Stay within the ENVELOPE, which is pretty close to the material thickness.
13. Limitation: the Draft Angle during the manufacturing process of the can body and/or of the lid.
14. Seven Up can bodies had a draft angle around less than one degree.
15. So the Industry is capable to get very small draft angles.
16. Remember that the main purpose and end goal is to have the HEEL of the OP lid's trough to be sitting on top of the KNEE of the UP lid's trough.

Other Notes and Helpful Points

Stability of the Stack

Think about the "Round Manhole Covers".

The manholes are always made as round holes, and their covers are round too, but with a slightly larger outside diameter that the manhole opening inside diameter itself. The purpose, as you most probably know, is that with such an arrangement, the cover will never be able to fall through the hole and hurt somebody working underground in the hole. The same idea can be utilized for our problem here. The cover has an outside diameter that is larger than the inside diameter of the hole, so the cover will always stay on top of the hole and will never slide or fall through.

We can utilize the same approach with our troughs. We can make the trough's bottom large enough so that it will not slide down through the mouth or bell mouth of the trough below it, but will always be captured above it, by what I call the bell mouth or what I would rather like to refer to now as the KNEE CIRCLE DIAMETER [DEFINITION]. I sometimes like to refer to the bell mouth as the "ledge".

Mechanism and acting forces, in stacking the lids on top of each other.

Rely on the bottom support/base support for the height.

The Guidance Walls can be loose and can have plenty of clearance and tolerance.

So, together, the side guidance walls will keep the stack from drifting too far off sideways, while the bottom base support will ensure that the lids will form a solid stable stack. (Not Squishy).

Nomenclatures:

V=Vertical Support Force Component.

H=Horizontal Force Component.

HCA=Half Cone Angle

If we have a supporting cone, with a LARGE HCA, then we would get a large V supporting angle and a small tangential, frictional, binding force. This is the more desirable situation.

If we have a supporting cone, with a SMALL HCA, then we will have the opposite. The V supporting or carrying force will be smaller than, in proportion to, the frictional forces. The frictional forces will create a binding, locking situation, more serious with smaller and smaller HCAs.

All this has to be done with consideration of, and within the boundaries of, the thickness of the material being used.

Re Shapes of parts at the Interface points or areas:

Flat on Flat has a lot of appeal, except that it may bind and lock, depending on the HCA angle.

Flat on Round or vice versa, Round on Flat, seems to be a preferred choice.

Round on Round seems to be an acceptable choice.

Effect of Thickness.

Thickness of the material, together with the Vertical Separation VS, affects the draft angle. See FIGS. 25 through 27-B. So, we have to make sure that we stay within the "Drawing ENVELOPE", as shown in these figures. Roughly, I would like to start by assuming that the width of the envelope equals the material thickness, with some variations, as seen in FIGS. 45 and 47.

The draft angle would be the limiting factor, in my opinion. However, the industry seems to be capable of accomplishing great deeds in this regards. For example, assuming that my measurements were accurate enough, one of the soda cans that is on the market showed that the draft angle of the body is around 0.073 degrees from center, i.e. the HCA is equal to 0.073 degrees. And that was on the standard size container, of almost 4 inch tall and almost 2.6 inch in diameter.

Many of the drawings show the lips of the lids, as if they have already been rolled and seamed. Sometimes. I show the lips in two positions. One position, as if the lip is open, i.e. before it is joined to the body of the can, and the second position, as if the lip has been already joined and is part of the double seam. I show it this way to show the relation between the two conditions, to make sure that there will be no problem in either case. In fact the stacking problem occurs before the lips are seamed. Once the lips are seamed and the lids are attached to their container bodies, a different set of stacking issues come into play. It is usually the problem that can occur when the completed cans are stacked on top of each other, say during shipping or when they are placed on the shelves in the stores at the market, etc. These are not the main problem that I am trying to solve by this invention, except for what I am showing in FIGS. 40-C and 40-F. In these two figures, I am showing that we can "sink" the main general body of the lid, what is also called lid panel or lid dome, lower than it is being used in the industry at the present time. We can sink it enough below the rim of the container, so that when we shape the tips of the pull tab to a higher position, these tips will still be below the edges of the containers so that these raised tabs and their raised tips will not protrude higher than the rims and would not "catch". Of course, by lowering the lid panel or dome deeper inside the container body, we are reducing the inside volume of the container. The other alternative is to raise the level of the seam/rim higher. It is basically a geometric relation between the lid panel and seam/rim. This may or may not be a big issue, depending on a number of factors that the industry deals with and may or may not be acceptable to them.

Trough Description

The trough will have an inner surface, see FIGS. 1-B and 1-C, and an outer surface and because of the non-orientation requirement and the orbital domain considerations, then, the trough surfaces will be considered as part of conical shaped, truncated cones.

If the taper is narrow, i.e. with a small axial angle, HCAs, then it would lock, as in the case of the Morse Tapers. Then it behooves us to have a stop, some transverse stop, to limit the travel of the cone inside the cup. The transverse stop will limit how far the cone will penetrke inside the cup, with the purpose of stopping the cone before it reaches the locking position also known as the Morse Taper position.

This transverse stop, which I could call a ledge of some sort, can be formed at the bell mouth of the trough. It can be the flared out shape of the trough, like the flare out shape of a trumpet or the like. Also keep in mind, that in most of my figures, I am showing the troughs in a cross sectional view. The trough actually goes around and along the perimeter of the lid, like a moat around a castle. Most of the beverage containers presently on the market have already a relatively small trough, that goes along and adjacent the lid perimeter, like the one that I am proposing, albeit my troughs would most probably be deeper.

Alternatives to "Bagging"

Vibratory Feed of the lids to stream flow along a channel/chute to be delivered to a spot where the lid can be located on top of the container body and then the two could be joined together, to be so called "double seamed" or the like.

This is in contrast to the present prevalent method which is:

Collect the lids into/inside a magazine, where the magazine looks like a hollow tube, with an opening at a top end and an opening at the other end/bottom end.

The individual lids are placed inside the tube or magazine and trapped inside it by some temporary closure/cap at each end of the magazine.

The lid inside the magazine are stacked one on top of the other.

The lids are shaped in such a way so as to take the least amount of space, so as to be able to carry many lids in each magazine.

For this main reason, the lids are shaped to have a least amount of axial space inside the magazine.

For that reason, the lids are designed so that they can be stacked one on top of the other and collected in individual "bags" for ease and speed of handling in subsequent machines/operations.

In order to achieve this goal, it is desirable that the lids do not have too many protrusions, either on the top surface of the lid, or recesses on its bottom.

However, my parent patent application PT1 advocates providing the lids with a number of features that would look like protrusion on the top or the bottom surfaces of the lids. Such lids can still be used to close the containers, except that they may not be easily carried in the kind of magazine used presently in the industry in the high production rate machines. However they can be handled using other methods such as the vibratory feeder and the [pick and place] tools mentioned earlier above, or other commonly known manufacturing methods.

In this present patent application I am describing certain improvements to the lids, which would make it more convenient to the industry to go back to using their "magazines", tubes, sticks, bags, to carry and transport the lids, so that they would be able to use their present high speed mfg tools, machines and methods. In other words, they would not need to drastically change their operating methods, and consequently they would be more receptive to adopt the new proposed lids.

Of course, like anything else in engineering, and in life in general, everything is with a give and take, i.e. there is always a trade-off. In this case, the trade-off includes the "space available to have the larger radii, the possibility of creating a deeper trough to create more room for the new redesigned pull tab and lids versus the ease of opening the pull tab can, etc.

I claim:

1. A stackable lid, for closing of container bodies, a) said lid being made of a material having a generally uniform thickness, b) said lid comprising at least a generally horizontal lid panel, having a generally flat shape and a lid perimeter and an imaginary vertical axis, which is perpendicular to the lid panel, c) said lid being intended to be stacked, one lid on top of the other, in a vertical parallel stack, wherein vertical indicates that the stack is in the direction of said imaginary vertical axis, and wherein parallel indicates that the lids in the stack and their individual lid panels are parallel to each other, and wherein d) each individual lid in the stack is intended to provide a solid base to carry and support the next lid above it in the stack, so that the stack feels solid and so as to prevent vertical movement of the lids within the stack, e) said lid further comprising certain irregularly shaped elements, protruding outside and beyond the generally flat shape of the lid panel, f) said lid further comprising a lid lip, located outside said lid panel, along and adjacent to said lid perimeter, for joining said lid lip to a corresponding lip of the container bodies to be closed by said lid, thus creating a seam, and said lid lip, having a lid lip height above the generally flat shape of the lid panel, and wherein said seam will have a certain expected seam height above the generally flat shape of the lid panel, and g) said lid further comprising an outer ramp, located as a transition between the lid lip and the lid panel, said outer ramp being shaped as a concave portion, when looking down at the lid in a top view, and running along the lid lip and the lid perimeter, h) said outer ramp, starting adjacent to the lid lip, then extending downwardly and inwardly, when looking at it in a cross-sectional view of the lid, then joining the lid panel, i) said outer ramp itself comprising at least four distinct portions, a skirt, an outer knee, an outer lower leg, and an outer heel, j) said skirt, starting generally near the lid lip then extending downwardly and inwardly and having a skirt length, and a skirt angle, with respect to the imaginary vertical axis, k) said outer knee, being disposed below the skirt and acting as a transition between the skirt and the outer lower leg, and starting at the end of the skirt and ending at the outer lower leg, l) said outer lower leg, starting at the end of the outer knee, then extending downwardly and inwardly, having an outer lower leg length, and an outer lower leg angle, with respect to the same imaginary vertical axis, wherein the shape of the outer lower leg creates a sloping lower leg flank and being disposed below the skirt and the outer knee, m) said outer heel, being located at the end of the outer lower leg, and shaped to end up joining the lid panel, wherein n) said outer knee, is shaped, so that together with the skirt and the lower leg, they form a curve, that looks like an upper-case letter "Z" or letter "S", when looking at it in a cross-sectional view of the lid, said outer knee acting as a supporting ledge, o) the skirt angle is larger than the outer lower leg angle, wherein the outer lower leg angle is steeper than the skirt angle, and wherein p) when any two said stackable lids are stacked one on top of the other, the lower stacked lid provides a solid heel over knee interface and support to the upper stacked lid, wherein the heel of the upper stacked lid will rest on top of the knee of the lower stacked lid, ensuring that the stack feels solid, so as to prevent vertical movement of the lids within the stack and to keep the lids and their lid panels horizontal and parallel to each other within the stack, and wherein q) the skirt of the lower stacked lid will not touch the outer lower leg of the upper stacked lid, because the skirt angle, being larger than the outer lower leg angle, creates a skirt clearance angle and a skirt clearance space between the skirt of the lower stacked lid and the outer lower leg of the upper stacked lid, and wherein r) the only contact between the two stacked lids will occur only at the solid heel over knee interface which is between the heel of the upper stacked lid and the knee of the lower stacked lid, which is supporting said upper stacked lid, and that at any position during a rotation of one stacked lid with respect to the other stacked lid, all the other elements of the two stacked lids are sufficiently spaced apart vertically, so that there will be no contact between any of these other elements of the two stacked lids, wherein s) a minimum vertical stacking height is defined and measured as the vertical distance starting at the solid heel over knee interface between the heel of the upper stacked lid and the knee of the lower stacked lid of a first pair of stacked lids in a stack, and ending at the comparable solid heel over knee interface between the heel and the knee of the pair of stacked lids, which is immediately above or below said first pair, and wherein t) said required minimum vertical stacking height is provided by selecting the proper shapes and dimensions of the heel and the knee of the stacked lids, and by the length of the outer lower leg of the stacked lids, and wherein u) said minimum vertical stacking height is chosen to be large enough, so as to ensure that the only contact between any pair of stacked lids, at any relative rotational position between the upper stacked lid and the lower stacked lid of said pair of stacked lids, will occur only at the solid heel over knee interface between the heel of the upper stacked lid and the knee of the lower stacked lid, which is supporting said upper stacked lid.

2. A stackable lid, as in claim 1, wherein said irregularly shaped elements are in the form of a frangible seal in said lid panel, and a pull tab opener o said pull tab opener having an elongated body, with two ends and a tip at each end comprising a nose portion with a nose tip at one end and a lifter portion with a lifter tip at the other end ; said pull tab opener being pivotally secured to said stackable lid, at a point along said elongated body, between said nose portion and said lifter portion, by a rivet, at a certain fixation point near said frangible seal; and at least a portion of said nose portion overlying at least a portion of said frangible seal.

3. A stackable lid, as in claim 2, wherein said lid further comprises an inner ramp, located between the lid panel and the outer ramp, said inner ramp being shaped as a convex portion, when looking down at the lid, and running along the outer ramp, said inner ramp starting at the end of the outer heel of the outer ramp, then extending upwardly and inwardly, when looking at it in a cross-sectional view of the lid, then joining the lid panel, thus creating a trough, made out of the inner ramp and the outer ramp together, said trough running between the lid lip and the lid panel.

4. A stackable lid, as in claim 3, wherein said inner ramp itself comprises at least three distinct portions, an inner heel, an inner lower leg and an inner knee, which are generally shaped to be similar to the outer heel, the outer lower leg and the outer knee of the outer ramp, but are inverted inwardly and generally look as the mirror image of those of the outer.

5. A stackable lid, as in claim 3, wherein said irregularly shaped elements are in the form of at least one recess in the lid panel, protruding downwardly, below and beyond the generally flat shape of the lid panel.

6. A stackable lid, as in claim 5, wherein said at least one recess in the lid panel is located generally under the lifter portion of the pull tab opener, to create a deep finger well.

7. A stackable lid, as in claim 5, wherein said lifter portion of the pull tab opener comprises at least one cam follower, which protrudes downwardly underneath the general level of the pull tab opener, and said at least one recess in the lid panel is located generally under the cam follower of the pull tab opener, creating at least one camming ramp, so that when the pull tab opener is rotated about the rivet, then a camming action is created, to raise the lifter portion of the pull tab opener upwards, above the general level of the lid panel.

8. A stackable lid, as in claim 5, wherein said at least one recess in the lid panel is located generally at the frangible seal and under the nose portion of the pull tab opener, so as to create a nose clearance space and a nose clearance angle, between the nose portion of the pull tab opener and the frangible seal.

9. A stackable lid, as in claim 3, wherein said irregularly shaped elements are in the form of at least one elevated feature, protruding upwardly above and beyond the generally flat shape of the lid panel.

10. A stackable lid, as in claim 9, wherein said at least one elevated feature is in the form of a cam, located generally near the lifter portion of the pull tab opener, to create a camming action to raise the lifter portion, including the lifter tip, of the pull tab opener, when the pull tab opener is rotated about the rivet, to create a large finger space underneath the lifter tip.

11. A stackable lid, as in claim 9, wherein said at least one elevated feature is a result of the fact that at least one tip of the pull tab opener, is shaped to be pointing upwards, thus creating a certain tab protrusion, having tab protrusion height above the generally flat shape of the lid panel, and creating a clearance space between said at least one tip of the tab opener and the underlying lid panel.

12. A stackable lid, as in claim 11, wherein said lid is constructed in a way so as to control the relative height position between the tab protrusion and the lid lip, to ensure that the tab protrusion is at a lower vertical level than that of the lid lip, by a certain vertical clearance height, to avoid interferences during handling, wherein the generally flat lid panel is used as a reference point, and wherein the vertical dimensions of the lid elements are selected, so as to end up with the desired vertical clearance height between the tab protrusion and the lid lip.

13. A stackable lid, as in claim 9, wherein said lid is constructed in a way so as to control the relative height position between said at least one elevated feature and the seam, which is expected to be created when the lid lip is joined to a corresponding lip of the container bodies to be closed by said lid, to ensure that said at least one elevated feature is at a lower vertical level than that of said seam, by a certain vertical clearance height, to avoid interferences during handling, wherein the generally flat lid panel is used as a reference point, and wherein the vertical dimensions of the lid elements are selected, so as to end up with the desired vertical clearance height between said at least one elevated feature and said seam.

14. A stackable lid, as in claim 3, wherein the lid panel further comprises a transition section, located at the bottom of the trough, between the outer ramp and the inner ramp, connecting the two ramps together, wherein said transition portion creates a larger, wider space at bottom of trough, for the purpose easy tooling and manufacturing.

15. A stackable lid, as in claim 3, wherein when any two lids are stacked one on top of the other, the heels of all the stacked lids, as well as the knees of all the stacked lids, at the contact surfaces where the respective heels and knees touch each other at the solid heel over knee interface between the heels and the knees of the lids in the stack, are shaped, so as to prevent the stacked lids from binding, locking and sticking to each other, and wherein when looking at a cross-sectional view of the lids, the normal contact forces acting between said contact surfaces of the heels and of the knees, will be at a normal contact forces angle with respect to the imaginary vertical axis of the lid panel, wherein this normal contact forces angle will be at least smaller than 90 degrees minus the Morse Taper angle, and at least larger than 0 degrees, and wherein said Morse Taper Angle is known in the industry as being a small angle between a minimum of 2.39° and up to a max of 4.68° from Center and wherein stacked lids having such an angle of contact between them would lock together and it would be difficult to separate them from each other.

16. A stackable lid, as in claim 15, wherein the contact surfaces at the solid heel over knee interface of the heels and the knees of the stacked lids, are shaped to look like portions of two truncated cones, creating contact cones, one sitting on top of the other, and wherein the half cone angle of the contact cones, with respect to the imaginary vertical axis of the lid panel, is at least larger than the Morse Taper angle and at least smaller than 90 degrees.

17. A stackable lid, as in claim 16, wherein one of the two contact surfaces has a rounded profile, looking as part of a donut.

18. A stackable lid, as in claim 16, wherein both of the two contact surfaces have rounded profiles, looking as parts of two donuts, one larger than the other, sitting one on top of the other.

19. A stackable lid, as in claim 15, wherein said normal contact forces angle with respect to the imaginary vertical axis of the lid panel is 45 degrees.

20. A stackable lid, as in claim 3, wherein the stackable lid is circular in shape, with a round perimeter, when looking down at the lid in a top view.

21. A stackable lid, as in claim 3, wherein the stackable lid is not circular in shape, when looking down at the lid in a top view.

22. A stackable lid, as in claim 1, wherein when at least two lids are stacked one on top of the other, and when looking at a cross- sectional view of the lids, all the points of contact between the heels and the knees of all the lids in the stack, are at the solid heel over knee interface between the stacked lids, and will be within a certain vertical cylindrical envelope, to ensure that the stack would keep repeating vertically, and to ensure that the outer lower legs of the stacked lids would not touch each other, and wherein a cross-sectional thickness of this vertical cylindrical envelope is approximately equal to the thickness of the material of the lid panel.

* * * * *